US006107981A

United States Patent [19]

Fujita

[11] Patent Number: 6,107,981

[45] Date of Patent: Aug. 22, 2000

[54] DRIVE CIRCUIT FOR LIQUID CRYSTAL DISPLAY DEVICE, LIQUID CRYSTAL DISPLAY DEVICE, AND DRIVING METHOD OF LIQUID CRYSTAL DISPLAY DEVICE

[75] Inventor: Masaya Fujita, Kawasaki, Japan

[73] Assignee: Fujitsu Limited, Kawasaki, Japan

[21] Appl. No.: 08/727,746

[22] Filed: Oct. 8, 1996

[30] Foreign Application Priority Data

Nov. 6, 1995 [JP] Japan ..... 7-287632

[51] Int. Cl.[7] ..... G09G 3/36

[52] U.S. Cl. ..... 345/95; 345/210; 345/211

[58] Field of Search ..... 345/87, 98, 100, 345/96, 94, 58, 209, 210, 211, 212, 99, 95; 349/33

[56] References Cited

U.S. PATENT DOCUMENTS

| | | | |
|---|---|---|---|
| 5,229,761 | 7/1993 | Fuse | 345/99 |
| 5,576,737 | 11/1996 | Isozaki | 345/212 |
| 5,691,739 | 11/1997 | Kawamori et al. | 345/94 |
| 5,731,796 | 3/1998 | Furuhashi et al. | 345/94 |
| 5,764,212 | 6/1998 | Nishitani et al. | 345/98 |

FOREIGN PATENT DOCUMENTS

| | | |
|---|---|---|
| 54051 | 2/1993 | Japan . |
| 61-75610 | 6/1994 | Japan . |
| 6208337 | 7/1994 | Japan . |

*Primary Examiner*—Dennis-Doon Chow
*Attorney, Agent, or Firm*—Greer, Burns & Crain, Ltd.

[57] ABSTRACT

A drive circuit for a liquid crystal display device, includes first and second bus lines; a reference voltage selecting circuit for selecting one reference voltage corresponding to the driving voltage from a plurality of reference voltages generated by dividing an arbitrary power source by a plurality of voltage dividing resistors; a reference voltage selection controlling circuit for stopping the supply of the driving voltage by the reference voltage selecting circuit after the driving voltage is applied to the second bus lines for a predetermined period; and a power source controlling circuit for stopping the supply of the voltage from the power source to the dividing resistors. This invention provides also a driving method of a liquid crystal display device including steps of selecting a driving voltage corresponding to predetermined image data from a plurality of reference voltages generated by dividing an arbitrary power source by a plurality of voltage dividing resistors; applying the driving voltage of the second bus lines for a predetermined period; then stopping the supply of the driving voltage to the second bus lines; and stopping the supply of the voltage from the power source to the voltage dividing resistors after the driving voltage is applied to the second bus lines for a predetermined time.

23 Claims, 45 Drawing Sheets

DRIVE CIRCUIT FOR LIQUID CRYSTAL DISPLAY DEVICE, LIQUID CRYSTAL DISPLAY DEVICE, AND DRIVING METHOD OF LIQUID CRYSTAL DISPLAY DEVICE

BACKGROUND OF THE INVENTION

1. Field of the Invention

This invention relates to a drive circuit for a liquid crystal display device (generally abbreviated to "LCD") for supplying analog driving voltages for displaying desired image data to selected pixels among a plurality of pixels that constitute a liquid crystal display panel of the liquid crystal display device, a liquid crystal display device equipped with this kind of drive circuit, and a method for driving the liquid crystal display device.

More particularly, the present invention is directed to an active-matrix type liquid crystal display device for executing gradation display by writing image data to pixels to be selected, by utilizing ON/OFF operations of TFTs (Thin Film Transistors), etc., connected to the pixels of the liquid crystal cells disposed at the points of intersection between a plurality of parallel, first bus lines for serially scanning the pixels (first bus lines are generally referred to as "scan bus lines") and second bus lines crossing orthogonally these first bus lines and supplying a write voltage (driving voltage) in accordance with the gradation to be displayed (second bus lines are generally referred to as "data lines").

Thin and light-weight display devices, such as liquid crystal display devices, are generally used for portable personal computers. These kinds of liquid crystal display devices are expected to be used as the display devices which will replace CRTs (Cathode-Ray Tubes), and a technical development has been vigorously done. Among these liquid crystal display devices, an active-matrix type liquid crystal display device employing the driving system by the TFTs described above is very promising because its display speed is high and its display quality is excellent.

In the latest application software, a multiple-color display system for displaying a variety of colors by various combinations of variable densities (gradations) of three primary colors, that is, red, blue and green, has become general. Therefore, the performance of such application software cannot be fully exploited when the number of gradations capable of displaying each primary color is small. For this reason, the liquid crystal display device described above needs a drive circuit suitable for multiple-stage gradations capable of generating write voltages of various magnitudes in accordance with the gradation data to be displayed.

2. Description of the Related Art

The construction of a drive circuit for a liquid crystal display device according to the prior art will be hereby explained with reference to the accompanying drawings (FIGS. 1 to 12) in order to have the problem in the conventional drive system in the active-matrix type liquid crystal display device more easily understood.

To begin with, the conventional structural example of the active-matrix type liquid crystal display device using the TFTs described above, and a drive circuit for driving such a liquid crystal display device, will be explained with reference to FIGS. 1 to 5.

FIGS. 1 and 2 are circuit block diagrams showing the constructions of the first and second portions of a conventional liquid crystal display device, respectively; FIGS. 3 and 4 are circuit block diagrams showing the first and second portions of the principal part of the conventional liquid crystal display device shown in FIGS. 1 and 2, respectively; and FIG. 5 is a circuit diagram showing a detailed example of a liquid crystal display panel shown in FIG. 2.

In order to simplify the explanation of the liquid crystal display device, however, it will be hereby assumed that a liquid crystal display panel 10 has a pixel number comprising a 4×4 matrix, and a system for controlling the display of image data is a so-called "digital driver system".

Symbols P11 to P44 that constitute the liquid crystal display panel 10 (FIG. 2) in the liquid crystal display device shown in FIGS. 1 and 2 represent a plurality of pixels each defined as the smallest unit for displaying image data. Further, transistor switch devices Q11 to Q44, each comprising a TFT, are connected to these pixels P11 to P44 as shown in FIG. 5. Each of these transistor switch devices Q11 to Q44 play a role of a switch when a signal voltage for displaying the gradation of the image data to liquid crystal capacities Cmn [where m and n represent the number of data lines (number of column electrodes) and the number of scan bus lines (number of row electrodes), respectively; m and n=1 to 4, respectively; and Cmn=C11 to C44 in this explanation]. In FIG. 5, a line of pixels in the transverse direction, that is, a line of pixels in the direction extending along each of the scan bus lines Y1 to Y4, is called "one line". Data for displaying image data to the liquid crystal display device is written to each line of the scan bus lines, and such operations are repeated 60 times per second so as to provide images devoid of flickers when a person watches the images with his own eyes.

Further, as shown in FIG. 5, the data lines X1 to X4 comprise a kind of a distributed constant circuit which in turn includes distributed resistors r11 to r44 and distributed capacities c11 to c44. Each of the distributed resistors r11 to r44 is made of a material forming the data line, and each of the distributed capacities c11 to c44 has a synthesized value which is obtained by synthesizing a capacitance brought about by defining a liquid crystal interposed between the data line and the opposed electrode as a dielectric and a capacitance brought about by defining an insulator at the point of intersection between the data line and the scan bus line as a dielectric, as the main capacitive components.

The number of pixels inside the liquid crystal display panel 10 in the practical liquid crystal display device is generally much larger than the number of pixels of the conventional liquid crystal display device shown in the explanatory view of FIGS. 1 to 5. Typically, a liquid crystal display device having about 640 pixels in the transverse direction of the liquid crystal display panel 10 (in the direction along the scan bus lines) and about 480 pixels in the longitudinal direction (in the direction along the data lines) is ordinarily available. However, in this case, the liquid crystal display device comprising a 4×4 matrix is hereby illustrated for ease of explanation. Furthermore, in order to effect color display, pixels must be provided for each of R (Red), G (Green) and B (Blue).

Now, the explanation will be hereby given as to how the image data can be correctly written into each pixel with reference to FIGS. 1 and 2. In FIGS. 1 and 2, a control circuit portion 400 for controlling various operations of all the drive circuits inclusive of the below-mentioned data driver unit 200 and scan driver 30 is shown disposed.

A horizontal synchronous signal (generally abbreviated to "sync signal") HS representing the scanning cycle when displaying the image data (that is, the signal representing the cycle for each line), a vertical sync signal VS for inputting the image data per frame from the upper end of the display surface (that is, the signal representing the cycle per frame), and other control signals are inputted to this control circuit portion 400. Symbols D1 to DN inputted to the control circuit portion 400 represents binary image data, and symbol N represents the bit number for effecting gradation display. Symbols CLK inputted to the control circuit portion 400 represents the timing signal (clock signal) applied in synchronism with the image data. This clock signal sets the timing for writing the image data D1 to DN. However, because the clock signal CLK can be generated inside the drive circuit by measuring the cycle of the horizontal sync signal HS, it is not essentially necessary as one of the interfaces.

In FIG. 1, further, reference numeral 210 denotes a shift register. This shift register 210 generates timing signals TS1 to TS4 for serially writing display data to the first memories 610 to 640, when the start signal T1 representing the start of the display of the image data for each line and the clock CK1 for advancing the register are delivered for every line from the control circuit 400. Each of these first memories 610 to 640 comprises a memory having an N-bit memory capacity, and image data DT1 to DTN having an N-bit parallel system are stored in these first memories 610 to 640, respectively. Second memories 710 to 740, too, comprise a memory having an N-bit memory capacity. In this construction, soon after the image data are written into the first memories 610 to 640, the image data stored in the first memories 610 to 640 for one line (scan bus line) are simultaneously written into the second memories 710 to 740 by the write control signal T2 before the data of the next line (scan bus line) arrive.

In FIG. 1, further, selectors 910 to 940 are disposed on the output side of the second memories 710 to 740. These selectors 910 to 940 are deemed to be a kind of digital-to-analog conversion circuit for generating analog signals corresponding to the digital data stored in the second memories 710 to 740. Decoders 810 to 840 interposed between the selectors 910 to 940 and the second memories 710 to 740 decode the image data represented by the binary number and generate a signal for turning ON only one analog switch inside each of the selectors 910 to 940. In this way, each of the selectors 910 to 940 selects any one of M kinds (V1 to VM) of voltages and output the thus selected voltage to the data lines X1 to X4. The M kinds of voltages V1 to VM and the N-bit data stored in the second memories 710 to 740 have the relation $M=2^N$ when the data are represented by the binary number. When it is assumed that N=3, for example, it is derived that M=8, and when it is assumed that N=4, it is derived that M=16.

The whole circuit gathering the shift register 210, the first memories 610 to 640, the second memories 710 to 740, the decoders 810 to 840, and the selectors 910 to 940 is generally integrated (into an IC circuit) as a data driver (generally abbreviated to "DD") unit, and it is represented by reference numeral 200 in FIG. 1. In FIG. 1, further, a reference power source unit 500 for generating a plurality of kinds of reference voltages VA to VX is not generally included in the integrated circuit. As for this reason, it can be mentioned that the data driver necessary for constituting a drive circuit of a display device generally comprises a plurality of ICs, whereas the reference power source unit 500 may be only one common power source and it is not advantageous to constitute a power source capable of supplying a large current inside an integrated circuit.

Further, the portion represented by reference numeral 510 inside the data driver unit 200 shown in FIG. 1 is a circuit which generates M kinds, that is, V1 to VM, of second reference voltages by dividing the first reference voltages VA to VX outputted from the reference power source unit 500 by a plurality of divided type resistors (i.e., voltage dividing resistors), that is, a resistor dividing circuit portion. In the construction of the main part of the liquid crystal display device (inclusive of the drive circuit) shown in FIGS. 3 and 4, an example is illustrated in which eight kinds of second reference voltages V1 to V8 (i.e., a plurality of kinds of the second reference voltages about twice as many as kinds of the first reference voltages) are finally generated from five kinds of the first reference voltages VA to VE. In this case, a larger number of kinds of reference voltages can be generated by increasing the number of division of a plurality of voltage dividing resistors.

In order to write the data voltages outputted from the data driver unit 200 and sent to the data lines X1 to X4, into the liquid crystal capacities through the TFTs, each of these TFTs functioning as an analog switch must be turned ON and OFF by controlling the gate voltage of each TFT. It is the scan driver (generally abbreviated to "SD") unit 30 that plays such a function as an analog switch. The scan driver unit 30 comprises a shift register 31 and driver units DV1 to DV4. The shift register 31 is a register which starts its operation by the start signal T3 and advances in accordance with the clock CK2. The start signal T3 has the same cycle as the vertical sync signal, and the clock CK2 has the same cycle as the horizontal sync signal. The shift registers 31 serially generates signals for turning ON the TFTs for every line of the liquid crystal display panel 10 (these signals are called the "scan signals").

Further, each of the driver units DV1 to DV4 shown in FIG. 2 has a function of a conversion circuit for effecting level conversion from the output of the shift register 31 to a voltage capable of controlling the ON/OFF operations of the TFTs, and it can be regarded as a binary output circuit which generates either a voltage capable of turning OFF the TFTs or a voltage capable of turning them ON.

FIGS. 3 and 4 are views showing in detail the selector 910 including a plurality of analog switches (eight switches, in FIG. 3), the decoder 810, the resistor dividing circuit portion 510, and the reference power source unit 500 shown in FIG. 1 and 2. The drawings illustrate the example in which one voltage is selected from among V1 to V8 by turning ON only one analog switch inside the selector 910. In other words, the example shows the case in which N described above is 3.

The explanation will be given in further detail. The decoder 810 (FIG. 3) includes three NOT devices 850-1 to 850-3 to which the binary image data D1 to D3 are inputted; four AND devices 860-1 to 860-4 which decode the image data outputted from these NOT devices 850-1 to 850-3; and NOR devices 870-1 to 870-8 which are connected to the output side of these AND devices 860-1 to 860-4, and which generate a control signal for turning ON one of the eight analog switches inside the selectors 910 to 940.

Further, the reference power source unit 500 includes one power source VR, five voltage dividing resistors RA to RE for dividing this power source VR and generating five kinds of the first reference voltages VA to VE, and buffer amplifiers A1 to A5 for sending the reference voltages from these voltage dividing resistors RA to RE to the resistor dividing circuit portion 510.

The resistor dividing circuit portion 510 includes eight voltage dividing resistors R1 to R8 in order to generate eight kinds of the second reference voltages V1 to V8 by further dividing the five kinds of the first reference voltages VA to VE from the buffer amplifiers A1 to A5.

The example shown in FIGS. 1 and 2 deals with a simple image having a 4×4 matrix in order to explain the driving method according to the prior art. However, as described before, the practical liquid crystal display device generally drives 640 lines of pixels in the transverse direction and 480 lines of pixels in the vertical direction, or 640×480=307,200 pixels in total. Therefore, the size of the data driver unit for this purpose becomes relatively large in scale. Moreover, in order to effect color display, separate pixels are necessary for each of R, G and B. Therefore, the total value of the number of pixels becomes three times as large as the value given above (307,200 pixels). Further, to accomplish gradation display so as to make the color display more closely approach to a full color display, the number of bits of the data driver unit, described with reference to FIGS. 1 and 2, must be increased.

FIGS. 3 and 4 illustrate an example equipped with a data driver unit having a 3-bit configuration or 8-value ($2^3$=8) configuration. The number of gradations required for each color to express 260,000 colors (called a "full color display") is sixty-four (64). In this case, 64 analog switches are necessary inside each selector, and 64 kinds of voltages are necessary from the resistor dividing circuit portion 510. The IC constituting the driver inclusive of the data driver unit 20 is generally formed on the basis of a fabrication technology of MOSs (Metal Oxide Semiconductors). With regard to the fabrication technology of the MOSs, it is extremely easy to produce a small-sized analog switch and there is no serious problem. However, to obtain finally 64 kinds of reference voltages, 64 terminals are necessary at the terminal portions of a plurality of integrated circuits (IC1 and IC2) 42 and 44 in the liquid crystal display device shown in FIG. 12, and this is one of the greatest problems for putting a multi-gradation driver into practical application.

When the number of necessary terminals increases as described above, a wiring region of this reference power source line Lr has a relatively large width. Therefore, a frame portion of the display screen of the liquid crystal display panel 10 cannot be reduced, so that the liquid crystal display device cannot be made compact. In other words, the display screen of a portable notebook type personal computer used as the useful application of the liquid crystal display device cannot be easily enlarged. To cope with this problem, an attempt has been made to decrease the number of signal lines extending from the resistor dividing circuit portion 510 through the integrated circuits 42 and 44, and to increase the number of reference voltages inside the integrated circuits.

However, even the drive system of the liquid crystal display device according to the prior art described above is not yet free from the following problem. The problem encountered when the liquid crystal display panel is driven by using the drive circuit of the liquid crystal display device according to the prior art is shown in FIGS. 6 to 11.

FIGS. 6 and 7 show the first portion and the second portion of the circuit diagram for explaining the problem of the drive circuit of the liquid crystal display device according to the prior art, respectively; FIG. 8 is a timing chart for explaining the problem of the drive circuit of the liquid crystal display device according to the prior art; FIGS. 9 and 10 show the first portion and the second portion of an equivalent circuit diagram for explaining in more detail the problem of the prior art system, respectively; and FIG. 11 is a timing chart for explaining in further detail the problem of the prior art system.

The particular problem in the drive circuit of the conventional liquid crystal display device is that excessive power consumption occurs due to the current flowing steadily through the resistor dividing circuit portion. More concretely, as shown in FIGS. 6 and 7, the current It flowing from the resistor dividing circuit portion into the liquid crystal display panel is a transient current which becomes zero when charging of the distributed capacities c11 to c41 of the data line (e.g. X1) is finished. In contrast, the current Is supplied from the reference power source unit to the resistor dividing circuit portion is a steady state current and remains constant. FIG. 8 shows the mode of the changes of these transient current It and steady current Is and the change of the voltage VX1 on the data line X1 (hereinafter merely called the voltage "VX") with respect to the horizontal sync signal HS, the scan signals supplied to the scan bus lines Y1 to Y4 and the write control signal T2. The current value of the steady state current Is can become small in inverse proportion to the dividing resistance value of the voltage dividing resistor by increasing this resistance value, but when the resistance value is increased, the time constant required for charging the data line up to the predetermined voltage level becomes larger as shown in FIG. 11, and therefore an accurate gradation voltage cannot be written into the liquid crystal capacities within the period in which a scan voltage (i.e., scan signal) is supplied to each of the scan bus lines Y1 to Y4.

Therefore, in order to have the problem resulting from the voltage dividing resistors more easily understood, an example of calculation of numerical values on the basis of the equivalent circuit diagrams of FIGS. 9 and 10 will be given. By the way, symbols R, RS, RD and C in FIGS. 9 and 10 represent the resistance value of the voltage dividing resistor, the resistance value of the equivalent resistor of the analog switch, the resistance value of the equivalent resistor of the data line and the capacitance value of the equivalent distributed capacity of the data line, respectively.

It will be hereby assumed that the resistance value R of one voltage dividing resistor is 1 kΩ, the capacitance value C of the equivalent distributed capacity of the data line is 100 pF and the number of data lines is 240. Then, the resistance value of the equivalent output resistor of the resistor dividing circuit portion is, in the worst case (the case in which all the image data are the same), NR/2 (NR/2=240×1,000/2=120 kΩ) by simplifying the equivalent circuit for charging a portion (1) of FIG. 9 into the equivalent circuit such as a portion (2). Therefore, even when the resistance value RS of the equivalent resistor of the analog switch and the resistance value RD of the equivalent resistor of the data line are set to zero, the time constant for charging the data line is 120 kΩ×100 pF=12 μsec. In consequence, the charging of the data line can be carried out up to only 81% of the final value of the voltage VX within the period of 20 μsec permitted as the charging time of the data line [20 μsec is a typical value in an example of the number of pixels in a conventional VGA (Video Graphic Array)].

In contrast, when the resistance value R of the voltage dividing resistor is set to 250Ω, the time constant for charging the data line is 3 μsec, and the charging of the data line can be carried out up to 99.8% within the period of 20 μsec. The resistance value RS and the resistance value RD are set to zero in this calculation, but the resistance value RS of several kΩ is likely to be practically brought about, and the resistance value RD is typically the value from 10 to 20 kΩ. Therefore, the resistance value of the voltage dividing resistor must be further decreased to a smaller value (the equivalent circuit of portions (3) and (4) in FIG. 10 is approximate to the equivalent circuit for actually charging the data line).

When the resistance value R of the voltage dividing resistor is 100Ω, for example, the resistance value of the equivalent resistance for the worst case is 12 kΩ. When the resistance value of the data line is 20 kΩ and the ON resistance during ON state of the analog switch is 5 kΩ, the time constant for charging the data line is (12+20+5) kΩ×100 pF=3.7 μsec, and according to the same calculation procedure as in an example mentioned above (i.e., the case in which the resistance value R is 250Ω), the charging of the data line can be carried out up to 99.5%.

As can be understood from the calculation results described above, the resistance value of each voltage dividing resistor must be about 100Ω. When the difference between a certain reference voltage V8 and another reference voltage V1 is 3V (a typical value necessary when driving a conventional liquid crystal display device), in this case, the steady state current Is is 3/800Ω=3.75 mA. Therefore, power consumption consumed by the portion having the voltage dividing resistors is 5V×3.75 mA≈19 mW when the voltage value of the reference voltage V8 is 5V. This value is a calculation example in the case of the number of data lines of 240. Therefore, in the case of the number of data lines 640×3=1,920 for a color liquid crystal display device having the VGA pixels, power consumption is 19 mW×8=152 mW as large as eight times that consumed in the above calculation example.

As described above, the resistance value of the voltage dividing resistors must coincide with the characteristics of the liquid crystal display panel. However, when the resistance value is too small, power consumption increases, and when the resistance value is too large, a write voltage for the liquid crystal display panel becomes insufficient It is difficult in the IC type data driver unit, on the other hand, to change the value of the voltage dividing resistors in accordance with the characteristics of the liquid crystal display panel, and therefore the voltage dividing resistors must be designed so as to have a margin to some degree for their driving capacity. Thus, the drawback are brought about that unnecessary power consumption occurs. Since notebook type personal computers having a built-in TFT type color liquid crystal display panel will become widespread rapidly in future, a drive circuit of a low power consumption type liquid crystal display panel becomes naturally necessary. Though the prior art drive system described above is an advantageous system in that the frame portion of the display screen of the liquid crystal display panel can become small, it is obvious that the problem occurs regarding the increase of power consumption due to the voltage dividing resistors inside the resistor dividing circuit portion in the prior art drive system.

SUMMARY OF THE INVENTION

In view of the problem described above, an object of the present invention is to provide a drive circuit for a liquid crystal display device, which is capable of reducing power consumption inside a circuit while keeping the area of the frame portion of a liquid crystal display panel small, and capable of accomplishing a liquid crystal display panel having a high display speed of image data and having excellent display quality, a liquid crystal display device equipped with this kinds of drive circuit, and a driving method of such a liquid crystal display device.

To accomplish the object described above, a drive circuit for a liquid crystal display device according to the first principle of the present invention is directed to a drive circuit of the type which disposes first bus lines for serially scanning a plurality of pixels constituting a liquid crystal display panel of a liquid crystal display device for the pixels, and second bus lines for supplying a driving voltage for displaying predetermined image data to the pixels selected on the first bus lines. Such a drive circuit comprises a reference voltage selecting circuit for selecting a reference voltage corresponding to the driving voltage from a plurality of reference voltages generated by dividing an arbitrary power source by a plurality of voltage dividing resistors, and supplying the selected reference voltage to the second bus lines; a reference voltage selection controlling circuit for stopping a supply of the driving voltage by the reference voltage selecting circuit after the driving voltage is supplied to the second bus lines for a predetermined period; and a power source controlling circuit for stopping the supply of the voltage from the power source to the voltage dividing resistors after the driving voltage is applied to the second bus lines for a predetermined period.

Preferably, the drive circuit in accordance with the first principle described above further comprises a control circuit portion for controlling the scanning timing of the pixels and the display timing of the image data to the selected pixels, in which the timing of a start of the supply of the driving voltage by the reference voltage selecting circuit to the second bus lines, the timing of a stop of the supply of the driving voltage by the reference voltage selection controlling circuit, and the timing of a stop of the supply of the voltage by the power source controlling circuit to the voltage dividing resistors, are determined by control signals sent from the control circuit portion.

Preferably, further, the reference voltage selecting circuit described above comprises a plurality of selectors for selecting a reference voltage corresponding to the driving voltage and supplying it to the second bus lines, and the reference voltage selection controlling circuit comprises a plurality of switch devices interposed between the selectors and the second bus lines, for controlling whether or not to supply the reference voltage from the selectors to the second bus lines on the basis of the control signals from the control circuit portion. The power source controlling circuit comprises a switch device connected to a power source terminal side of the power source, for controlling whether or not to supply a voltage from the power source to a plurality of the voltage dividing resistors on the basis of the control signals from the control circuit portion.

Preferably, further, the reference voltage selecting circuit described above comprises a plurality of selectors for selecting a reference voltage corresponding to the drive voltage and supplying it to the second bus lines, respectively. The reference voltage selection controlling circuit comprises a plurality of switch devices interposed between the selectors and the second bus lines, respectively, for controlling whether or not to supply the reference voltage from the selectors to the second bus lines on the basis of the control signals from the control circuit portion. The power source controlling circuit comprises a plurality of analog switches mounted with a plurality of the voltage dividing resistors, for controlling whether or not to supply the reference voltage from a plurality of the voltage dividing resistors to the reference voltage selecting circuit on the basis of the control signals from the control circuit portion.

Preferably, further, the reference voltage selection controlling circuit described above comprises a plurality of selectors for selecting a reference voltage corresponding to the driving voltage and supplying it to the second bus lines, respectively. The reference voltage selection controlling circuit described above comprises a plurality of switch devices interposed between the selectors and the second bus lines, respectively, for controlling whether or not to supply the reference voltage from the selectors to the second bus lines on the basis of the control signals from the control circuit portion. The power source controlling circuit comprises a switch device connected to a ground terminal side of the power source, for controlling whether or not to supply a voltage from the power source to a plurality of the voltage dividing resistors on the basis of the control signals from the control circuit portion.

Preferably, further, the reference voltage selecting circuit described above comprises a plurality of selectors for selecting a reference voltage corresponding to the driving voltage and supplying it to the second bus lines, respectively. The reference voltage selection controlling circuit described above comprises a plurality of switch devices interposed between the selectors and the second bus lines, for controlling whether or not to supply the reference voltage from the selectors to the second bus lines on the basis of the control signal from the control circuit portion. The power source controlling circuit described above comprises a switch device connected to a ground terminal side of the power source, for controlling whether or not to supply a voltage from the power source to a plurality of the voltage dividing resistors on the basis of the control signals from the control circuit portion. These control signals from the control circuit portion are supplied to the switch devices through the buffer devices.

Preferably, further, the reference voltage selecting circuit described above comprises a plurality of selectors for selecting a reference voltage corresponding to the driving voltage and supplying it to the second bus lines, respectively. The reference voltage selecting circuit has a plurality of memory units for temporarily storing display data outputted from the control circuit portion so as to display the display data for each scanning period of the first bus lines; and a plurality of decoders for converting the display data read out from a plurality of the memory units to display data signals corresponding to the second bus lines and supplying them to a plurality of the selectors on the basis of the control signals from the control circuit portion. The plurality of decoders have a function of controlling whether or not to supply the reference voltage from the selectors to the second bus lines on the basis of the control signals from the control circuit portion.

Preferably, further, the reference voltage selecting circuit described above comprises a plurality of selectors for selecting a reference voltage corresponding to the driving voltage and supplying it to the second lines, respectively. The reference voltage selecting circuit has a plurality of memory units for temporarily storing display data outputted from the control circuit portion so as to display the display data for each scanning period of the first bus lines; and a plurality of decoders for converting the display data read out from a plurality of the memory units to display data signals corresponding to the second bus lines, respectively, and supplying them to a plurality of selectors. The plurality of the decoders have a function of controlling whether or not to supply the reference voltage from the selectors to the second bus lines on the basis of the control signals from the control circuit portion. Further, the plurality of the memory units are reset on the basis of the control signals from the control circuit portion at the time when the display data signals are outputted from a plurality of the decoders.

A drive circuit for a liquid crystal display device in accordance with the second principle of the present invention comprises a reference voltage generating circuit portion for generating a plurality of first reference voltages by dividing an arbitrary power source by a plurality of voltage dividing resistors; a resistor dividing circuit unit for further dividing a plurality of the first reference voltages outputted from the reference voltage generating circuit portion and generating a plurality of second reference voltages inclusive of driving voltages of all levels (or all the magnitudes); a selector unit for selecting a second reference voltage corresponding to the driving voltage for displaying predetermined image data from a plurality of the second reference voltages outputted from the resistor dividing circuit unit and supplying it to the second bus lines; and a buffer amplifier unit comprising a plurality of buffer amplifiers interposed between the reference voltage generating circuit portion and the resistor dividing circuit unit. In this case, the period in which the second reference voltage is applied to the second bus line is divided into at least two periods, and the output voltage passing through a plurality of the buffer amplifiers inside the buffer amplifier unit is supplied to the second bus lines during the first period, and the second reference voltage corresponding to the driving voltage for displaying the predetermined image data is supplied to the second bus line during the second period.

Preferably, the drive device according to the second principle of the present invention described above comprises a control circuit portion for controlling the timing of a scanning of the pixels and the timing of displaying the image data to the selected pixels; and a decoder unit for converting the display data sent from the control circuit portion to a display data signal corresponding to each of the second bus lines on the basis of the control circuit portion, and supplying it to the selector unit. In this case, the supply of the display data signal from the decoder unit to the selector unit is stopped by the control signals from the control circuit portion during the first period, and the supply of the display data signal from the decoder unit to the selector unit is permitted during the second period.

A drive circuit for a liquid crystal display device according to the third principle of the present invention comprises a reference power source unit for generating a plurality of first reference voltages by dividing an arbitrary power source by a plurality of voltage dividing resistors; a resistor dividing circuit portion for further dividing a plurality of the first reference voltages outputted from the reference power source unit and generating a plurality of second reference voltages inclusive of driving voltages of all levels; and a selector unit for selecting a second reference voltage corresponding to a driving voltage for displaying the predetermined image data from a plurality of the second reference voltages outputted from the resistor dividing circuit portion, and supplying it to the second bus lines. In this case, the resistor dividing circuit portion has a buffer circuit unit including a plurality of voltage dividing resistors for outputting a plurality of the second reference voltages and a plurality of buffer amplifiers interposed between the junctions of a plurality of the voltage dividing resistors and the selector unit. Further, the period in which the second reference voltage is applied to the second bus lines is divided into at least two periods, and the output voltage passing through a plurality of buffer amplifiers inside the buffer circuit unit are supplied to the second bus lines in the first period, and a second reference voltage corresponding to a driving voltage for display the predetermined image data is supplied to the second bus lines during the second period.

Preferably, the drive circuit according to the third principle of the present invention further comprises a control circuit portion for controlling the timing of a scanning of the pixels and the timing of displaying the image data to the selected pixels; and a decoder unit for converting the display data sent from the control circuit portion to a display data signal corresponding to each of the second bus lines, and supplying it to the selector unit on the basis of the control signals from the control circuit portion. In this case, the supply of the display data signal from the decoder unit to the selector unit is restricted by the control signals from the control circuit portion during the first period, and the supply of the display data signal from the decoder unit to the selector unit is permitted during the second period.

Preferably, further, in the drive circuit according to the third principle described above, a power source voltage for a plurality of the buffer amplifiers inside the buffer circuit unit is supplied from the reference power source unit.

Preferably, further, in the drive circuit according to the third principle described above, a power source voltage for a plurality of the buffer amplifiers inside the buffer circuit unit is supplied from a power source commonly used for other logical circuit devices constituting the drive circuit.

On the other hand, a liquid crystal display device associated with the first principle of the present invention includes a liquid crystal display panel including a plurality of pixels, first bus lines for serially scanning the pixels and second bus lines for supplying a driving voltage for displaying predetermined image data on the pixels selected on the first bus lines; and a drive circuit for driving the first and second bus lines. In this case, the drive circuit includes a reference voltage selecting circuit for selecting a reference voltage corresponding to the driving voltage from a plurality of reference voltages generated by dividing an arbitrary power source by a plurality of voltage dividing resistors, and supplying it to the second bus lines; a reference voltage selection controlling circuit for stopping the supply of the driving voltage by the reference voltage selecting circuit after the driving voltage is applied to the second bus lines for a predetermined period; and a power source controlling circuit for stopping the supply of the voltage from the power source to the voltage dividing resistors after the driving voltage is applied to the second bus lines for a predetermined period.

Further, a liquid crystal display device associated with the second principle of the present invention includes a liquid crystal display panel including a plurality of pixels, first bus lines for serially scanning the pixels, and second bus lines for supplying a driving voltage for displaying predetermined image data on the pixels selected on the first bus lines; and a drive circuit for driving the first and second bus lines. In this case, the drive circuit includes a reference voltage generating circuit portion for generating a plurality of first reference voltages by dividing an arbitrary power source by a plurality of voltage dividing resistors; a resistor dividing circuit unit for further dividing a plurality of the first reference voltages outputted from the reference voltage generating circuit portion and generating a plurality of second reference voltages inclusive of driving voltages of all values; a selector unit for selecting a second reference voltage corresponding to a driving voltage for displaying the predetermined image data from a plurality of the second reference voltages outputted from the resistor dividing circuit unit, and supplying it to the second bus lines; and a buffer amplifier unit comprising a plurality of buffer amplifiers interposed between the reference voltage generating circuit portion and the resistor dividing circuit unit.

Further, a liquid crystal display device associated with the third principle of the present invention includes a liquid crystal display panel including a plurality of pixels, first bus lines for serially scanning the pixels, and second bus lines for supplying a driving voltage for displaying predetermined image data on the pixels selected on the first bus lines; and a drive circuit for driving the first and second bus lines. In this case, the drive circuit includes a reference power source unit for generating a plurality of reference voltages by dividing an arbitrary power source by a plurality of voltage dividing resistors; a resistor dividing circuit portion for further dividing a plurality of the first reference voltages outputted from the reference power source unit and generating a plurality of second reference voltages inclusive of driving voltages of all values; and a selector unit for selecting a second reference voltage corresponding to a driving voltage for displaying the predetermined image data from a plurality of the reference voltages outputted from the resistor dividing circuit portion, and supplying it to the second bus lines.

On the other hand, in a liquid crystal display device which disposes a plurality of pixels, first bus lines for serially scanning the pixels and second bus lines for supplying a driving voltage for displaying predetermined image data to the pixels selected on the first bus lines, a driving method of a liquid crystal display device associated with the first principle of the present invention includes steps of selecting a driving voltage corresponding to the predetermined image data from a plurality of reference voltages generated by dividing an arbitrary power source by a plurality of voltage dividing resistors; stopping the supply of the driving voltage to the second bus lines after the driving voltage is applied to the second bus lines for a predetermined period; and stopping the supply of a voltage from the power source to the voltage dividing resistors after the driving voltage is applied to the second bus lines for a predetermined period.

In a liquid crystal display device which disposes a plurality of pixels, first bus lines for serially scanning the pixels and second bus lines for supplying a driving voltage for displaying predetermined image data to the pixels selected on the first bus lines, a driving method of a liquid crystal display device associated with the second principle of the present invention includes steps of generating a plurality of first reference voltages by dividing an arbitrary power source by a plurality of voltage dividing resistors, outputting the first reference voltages through buffer amplifiers, and further dividing the first reference voltages by a plurality of voltage dividing resistors to generate second reference voltages; and dividing a period in which the second reference voltages are applied to the second bus lines into at least two periods, supplying the output voltages passing through the buffer amplifiers to the second bus lines in the first period, and supplying the second reference voltage corresponding to the driving voltage for displaying the predetermined image data to the second bus lines during the second period.

In a liquid crystal display device which disposes a plurality of pixels, first bus lines for serially scanning the pixels and second bus lines for supplying a driving voltage for displaying predetermined image data to the pixels selected on the first bus lines, a driving method of a liquid crystal display device associated with the third principle of the present invention includes steps of generating a plurality of first reference voltages by dividing an arbitrary power source by a plurality of voltage dividing resistors, outputting the first reference voltages through buffer amplifiers, and further dividing the first reference voltages by a plurality of voltage dividing resistors to generate second reference voltages, and outputting the outputs from the junctions of the voltage dividing resistors among the second reference voltages through buffer amplifiers; and dividing a period in which the second reference voltages are applied to the second bus lines into at least two periods, supplying the output voltages passing through the buffer amplifiers to the second bus lines in the first period, and supplying the second reference voltages corresponding to the driving voltage for displaying the predetermined image data to the second bus lines during the second period.

According to the drive circuit for a liquid crystal display device based on the first principle of the present invention, the driving method by using this drive circuit and the liquid crystal display device equipped with this drive circuit, after the driving voltage corresponding to the selected reference voltage is written into the second bus line by the drive circuit of the liquid crystal display device, the switches inside the reference voltage selecting circuit are all turned OFF so as to cut off the steady state current flowing through a plurality of voltage dividing resistors for generating the reference voltages. Therefore, even when the resistance values of the voltage dividing resistors are relatively reduced so as to improve the charging speed of the second bus line, power consumption inside the circuit caused by the steady state current inside the dividing resistors can be saved, and a liquid crystal display panel, which is advantageous for multiple gradation display and has excellent display quality, can be accomplished.

According to the drive circuit for a liquid crystal display device, etc., based on the first principle of the present invention, the timing for turning OFF the switches inside the reference voltage selecting means, the timing for starting and stopping the supply of the driving voltage to the second bus lines and the timing for stopping the supply of the voltage to a plurality of dividing resistors are generated by the control circuit portion having substantially the same construction as that of the prior art circuits. Therefore, power consumption in the driving circuit can be reduced by a simple circuit construction, and the charging speed of the second bus line can be improved.

According to the drive circuit for a liquid crystal display device, etc., based on the first principle of the present invention, means for turning OFF all the switches inside the reference voltage selecting circuit such as the selectors, after the driving voltage is written into the second bus line, is constituted by a plurality of switch devices, and means for cutting OFF the steady state current flowing through a plurality of dividing resistors for generating the reference voltages is constituted by one switch device. Accordingly, a lower power consumption in the drive circuit can be accomplished by readily integrating these switch devices into the IC while keeping the small size of the frame portion of the liquid crystal display device.

According to the drive circuit for a liquid crystal display device, etc., based on the first principle of the present invention, power controlling semiconductor devices such as economical switches, having a small ON resistance during ON state and called "VMOSs", are interposed between the reference power source unit and a plurality of voltage dividing resistors as means for cutting off the steady state current flowing through a plurality of dividing resistors for generating the reference voltage after the driving voltage is written into the second bus line. Therefore, the size of the liquid crystal display device can be reduced, and a lower power consumption in the drive circuit can be accomplished.

On the other hand, according to the drive circuit for a liquid crystal display device, the driving method and the liquid crystal display device equipped with the drive circuit based on the second principle of the present invention, the charging operation of the second bus lines is carried out dividedly in two periods, the voltage value itself applied in the latter half period or a value approximate to this value is selected in the first period and the charging operation is carried out at high speed by the output of the buffer amplifiers having a low output resistance. Therefore, even when the resistance value of the voltage dividing resistors is increased, power consumption in the drive circuit can be reduced, and a higher liquid crystal display speed can be accomplished.

According to the drive circuit for a liquid crystal display device based on the second principle of the present invention, the driving method by using this drive circuit and the liquid crystal display device equipped with this drive circuit, when the charging operation of the second bus lines is carried out by dividing the period into two periods, the least significant bit for data display from the memory unit to the decoder is controlled by the gate circuit device, and the supply of the display data signal from the decoder unit to the selector unit is inhibited in the first period corresponding to this least significant bit. Therefore, a lower power consumption in the drive circuit can be accomplished by merely adding the simple logical circuit device.

On the other hand, according to the drive circuit for a liquid crystal display device based on the third principle of the present invention, the driving method by using this drive circuit and the liquid crystal display device equipped with this drive circuit, a plurality of buffer amplifiers, which can be easily integrated and have a low output resistance, are disposed at the posterior side of a plurality of voltage dividing resistors for generating a plurality of the reference voltages. Therefore, even when the resistance value of the voltage dividing resistors is increased to a considerable extent, a lower power consumption in the drive circuit and a higher liquid crystal display speed can be accomplished while keeping the small area of the frame portion of the liquid crystal display panel.

According to the drive circuit for a liquid crystal display device based on the third principle of the present invention, etc., further, a plurality of buffer amplifiers having a low output resistance are disposed at the posterior side of a plurality of voltage dividing resistors for generating a plurality of reference voltages, the output voltages passing through the buffer amplifiers are supplied to the second bus lines during the first period of charging, and the reference voltage corresponding to the driving voltage for displaying the image data is supplied to the second bus lines. Therefore, even when the resistance value of the voltage dividing resistors is increased to a considerable extent, a lower power consumption in the drive circuit and a higher liquid crystal display speed can be accomplished by a simple circuit construction.

BRIEF DESCRIPTION OF THE DRAWINGS

The above object and features of the present invention will be more apparent from the following description of the preferred embodiments with reference to the accompanying drawings, wherein.

DESCRIPTION OF THE PREFERRED EMBODIMENTS

Some basic embodiments of the present invention as well as some preferred embodiments related thereto will be hereinafter explained in detail with reference to FIGS. 13 to 47 of the accompanying drawings.

To begin with, three kinds of basic embodiments (FIGS. 13, 34 and 43) based on the first to third principles of the present invention will be explained in detail in order to clarify the concepts of the basic embodiments based on the afore-mentioned first to third principles of this invention.

Figure 13:
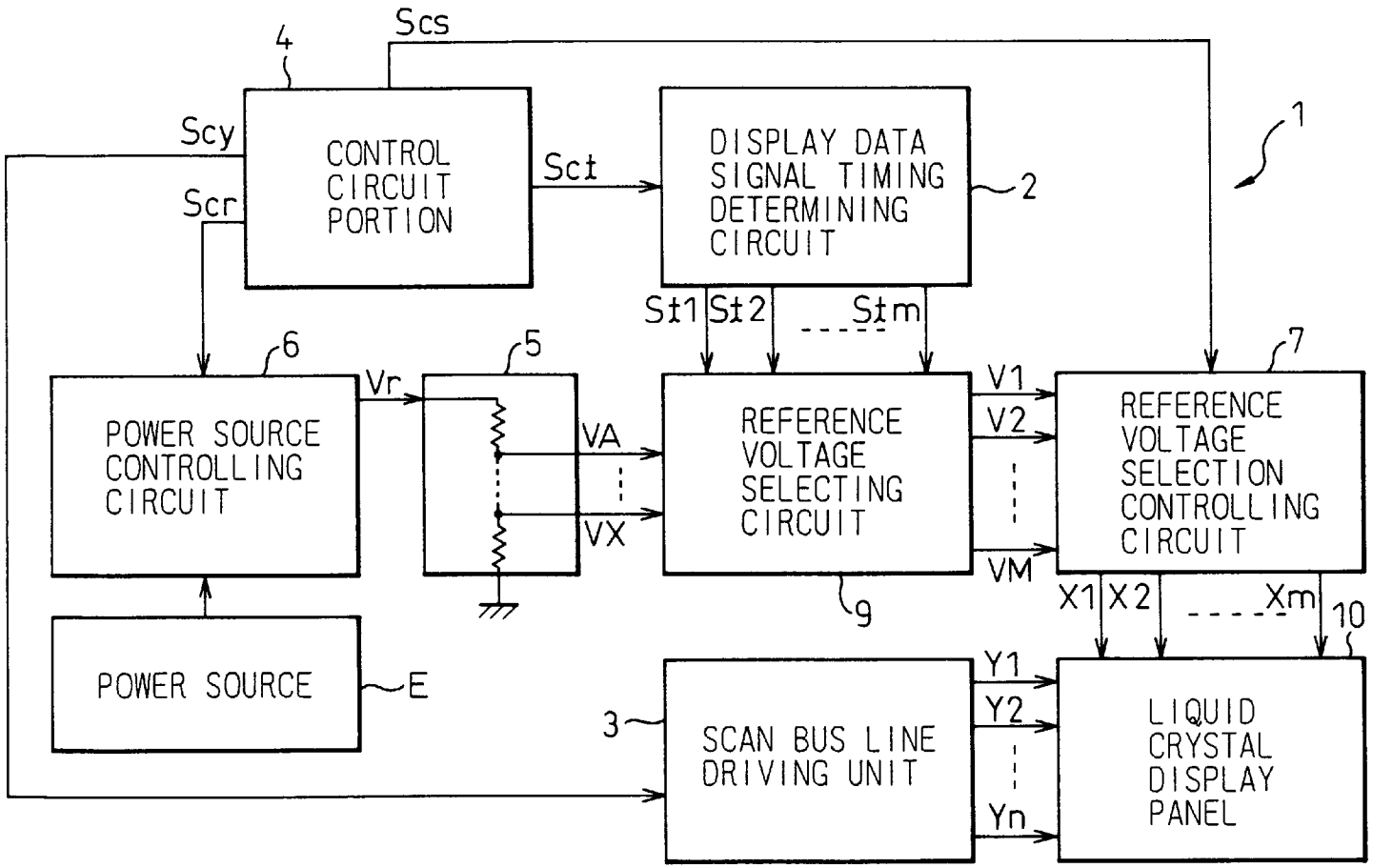
FIG. 13 is a block diagram showing the construction of a basic embodiment on the basis of the first principle of the present invention.
Figure 14:
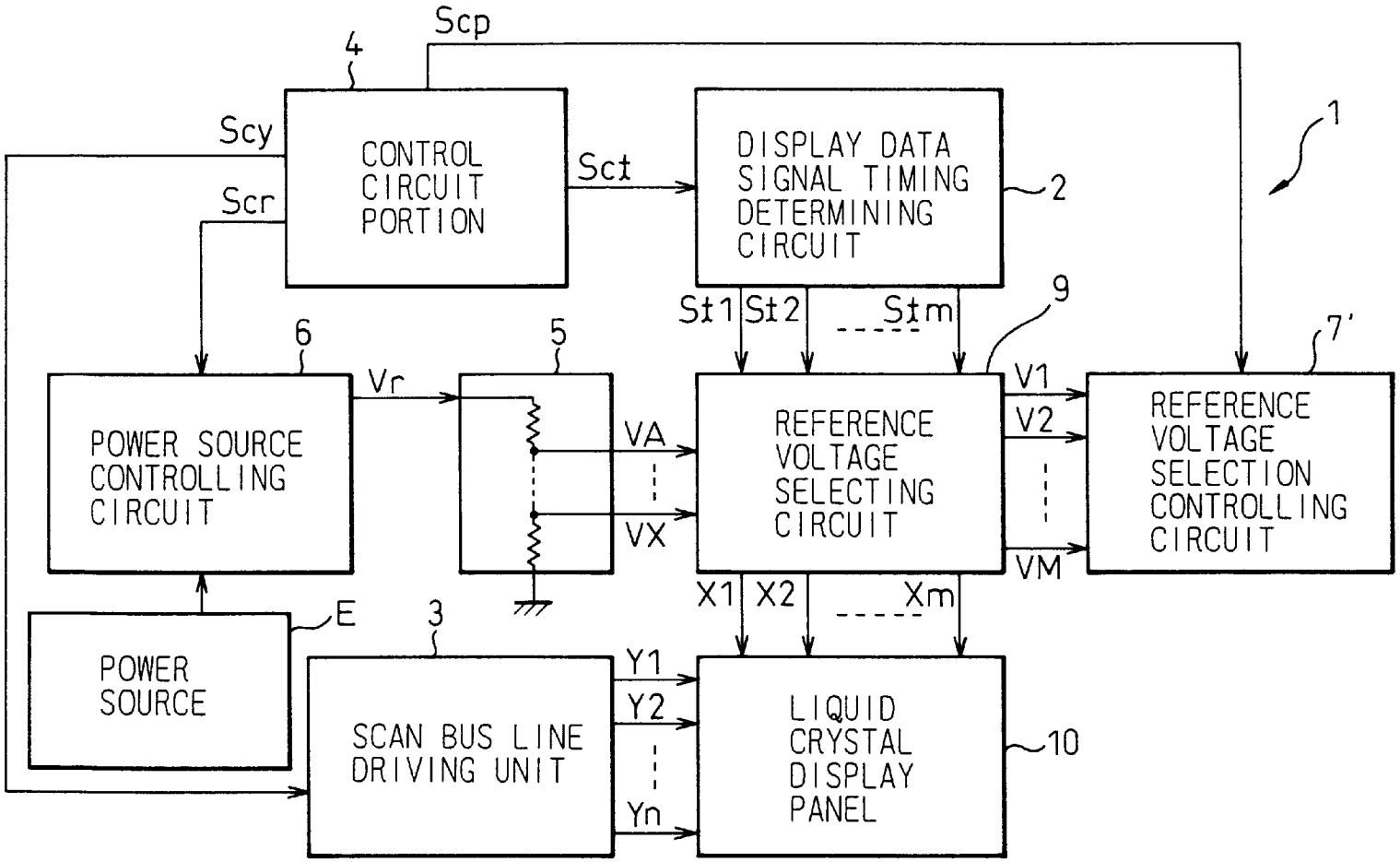
FIG. 14 is a block diagram showing a modified embodiment of the basic embodiment based on the first principle of the present invention.

FIG. 13 is a block diagram showing the construction of the basic embodiment based on the first principle of the present invention, and FIG. 14 is a block diagram showing a modified embodiment of the basic embodiment based on the first principle of the invention. By the way, like reference numerals as used in the drawings for explaining the prior art (FIGS. 1 to 12) will be used to identify like constituent elements.

As shown in FIGS. 13 and 14, the basic embodiment based on the first principle of the present invention is directed to a drive circuit of a liquid crystal display device 1 including first bus lines for serially scanning a plurality of pixels P11 to P44 constituting a liquid crystal display panel 10 (that is, scan bus lines Y1 to Yn), and second bus lines for supplying a driving voltage for displaying predetermined image data on selected pixels on the first bus lines (that is, data lines X1 to Xm).

As shown in FIGS. 13 and 14, further, the drive circuit of the liquid crystal display device 1, that constitutes the basic embodiment based on the first principle of the present invention, includes a reference voltage selecting circuit 9 for selecting a reference voltage corresponding to the driving voltage described above from a plurality of reference voltages VA to VX generated by dividing an arbitrary power source voltage of a power source E by a plurality of voltage dividing resistors and supplying it to the second bus lines; a reference voltage selection controlling circuit 7 (or 7') for stopping a supply of the driving voltage by the reference voltage selecting circuit 9 after the driving voltage is supplied to these second bus lines for a predetermined period; and a power source controlling circuit 6 for stopping the supply of the voltage to the voltage dividing resistors from the power source E after the driving voltage is applied for the predetermined period. The reference voltages VA to VX are generated for each of the second bus lines by reference voltage generating circuit 5 including a plurality of voltage dividing resistors, and are converted to a plurality of kinds of voltages V1 to VM (M: a value greater than the number of reference voltages) inside the reference voltage selecting circuit 9.

In the drive circuit sewn in FIG. 13, the reference voltage selection controlling circuit 7 is disposed in series with the reference voltage selecting circuit 9. On the other hand, in the drive circuit shown in FIG. 14, the reference voltage selection controlling circuit 7' is disposed in parallel with the reference voltage selecting circuit 9. This reference voltage selection controlling circuit 7' has a function equivalent to that of the reference voltage selection controlling circuit 7 described above.

As shown in FIGS. 13 and 14, the drive circuit of the liquid crystal display device 1 based on the first principle of the present invention is preferably equipped with a control circuit portion 4 for controlling the scanning timing of a plurality of pixels and the timing of image data display on the selected pixels. The drive circuit is further equipped with display data signal timing determining circuit 2 for generating image data signals St1 to Stm for each second bus line by decoding the image data, and finally setting the timing of display of the image data signals on the basis of control signals Sct from the control circuit portion 4.

In FIGS. 13 and 14, the timing of the start of the supply of the driving voltage by the reference voltage selecting circuit 9 to the second bus lines, the timing of the stop of the supply of the driving voltage by the reference voltage selection controlling circuit and the timing of the stop of the supply of the voltage to a plurality of voltage dividing resistors by the power source controlling circuit 6 are determined by control signals Sct, Scs (or Scp) and Scr, respectively.

In FIGS. 13 and 14, further, the drive circuit is equipped with scan bus line driving unit 3 for supplying the voltage for scanning the pixels for each line of the first bus lines. The timing of scanning of each line by this scan bus line driving unit 3 is decided by control signals Scy from the control circuit portion 4.

Further, preferably, the reference voltage selection controlling circuit 7 (or the reference voltage selection controlling circuit 7') comprises a plurality of selectors for selecting a reference voltage corresponding to the driving voltage and supplying it to the second bus line. Further, the reference voltage selection controlling circuit 7 comprises a plurality of switch devices disposed between these selectors and the second bus lines, for controlling whether or not the reference voltage should be supplied from the selectors 91 to 94 to the second bus lines on the basis of the control signals from the control circuit portion 4. Further, the power source controlling circuit 6 comprises switch devices connected to the power source terminal side of the power source E, for controlling whether or not the voltage should be supplied from the power source E to a plurality of voltage dividing resistors on the basis of the control signals from the control circuit portion 4.

Preferably, further, the reference voltage selection controlling circuit 7 (or the reference voltage selection controlling circuit 7') comprises a plurality of switch devices interposed between the selectors described above and the second bus lines, for controlling whether or not the reference voltage should be supplied from the selectors to the second bus lines on the basis of the control signals from the control circuit portion 4. The power source controlling circuit 6 comprises an analog switch mounted with a plurality of voltage dividing resistors, for controlling whether or not the reference voltage should be supplied from a plurality of these dividing resistors to the reference voltage selection controlling circuit 7 on the basis of the control signals from the control circuit portion 4.

Preferably, further, the power source controlling circuit 6 comprises a switch device connected to the ground terminal side of the power source E, for controlling whether or not the voltage should be supplied from the power source E to a plurality of voltage dividing resistors on the basis of the control signals from the control circuit portion 4.

Preferably, further, the power source controlling circuit 6 comprises a switch device connected to the ground terminal side of the power source E, for controlling whether or not the voltage should be supplied from the power source E to a plurality of voltage dividing resistors on the basis of the control signals from the control circuit portion 4, and the control signals from this control circuit portion 4 are supplied to the switch device through a buffer device.

Preferably, further, the drive circuit of the liquid crystal display device 1 based on the first principle of the present invention includes a plurality of memory units for temporarily holding display data so as to display the display data outputted from the control circuit portion 4 for each scanning cycle of the first bus line, and a plurality of decoders for converting the display data read out from these memory units to the display data signals corresponding to the second bus lines, respectively, on the basis of the control signals from the control circuit portion 4, and supplying the display data signals to a plurality of selectors. Further, these decoders have a function of controlling whether or not to supply the reference voltage to the second bus lines from the selectors on the basis of the control signals from the control circuit portion 4.

Preferably, further, a plurality of decoders described above have a function of controlling whether or not to supply the reference voltage to the second bus lines from the selectors on the basis of the control signals from the control circuit portion 4, and a plurality of the memory units described above are reset at the point when the display data signals are outputted from these decoders, on the basis of the control signals from the control circuit portion 4.

On the other hand, the constructions of the basic embodiments based on the second and third principles of the present invention, respectively, will be explained with reference to FIGS. 34 and 43, respectively.

Figure 34:
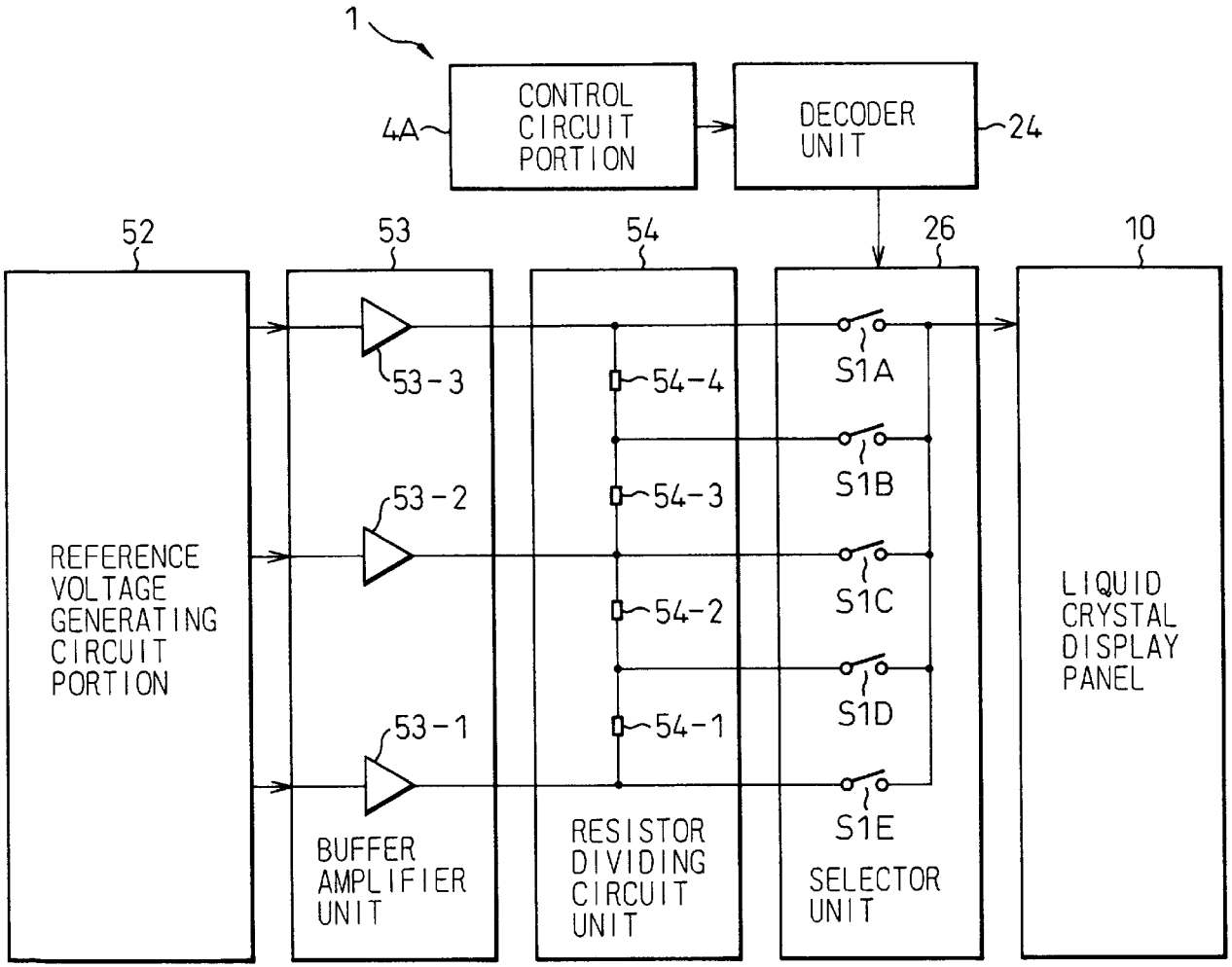
FIG. 34 is a block diagram showing the construction of a basic embodiment based on the second principle of the present invention.

As shown in FIG. 34, the drive circuit of the liquid crystal display device 1 constituting the basic embodiment on the basis of the second principle of the present invention includes a reference voltage generating circuit portion 52 for generating a plurality of first reference voltages by dividing an arbitrary power source voltage of a power source by a plurality of voltage dividing resistors; a resistor dividing circuit unit 54 for generating a plurality of second reference voltages inclusive of driving voltages of all the magnitudes by further dividing a plurality of first reference voltages outputted from the reference voltage generating circuit portion 52 (by, for example, dividing the first voltages by a plurality of voltage dividing resistors 54-1 to 54-4); a selector unit 26 including a plurality of analog switches S1A to S1E, for selecting the second reference voltage corresponding to the driving voltage for displaying predetermined image data from a plurality of second reference voltages outputted from the resistor dividing circuit unit 54 and supplying it to the second bus lines; and a buffer amplifier unit 53 comprising a plurality of buffer amplifiers (that is, driver units) 53-1 to 53-3 interposed between the reference voltage generating circuit portion 52 and the resistor dividing circuit unit 54. The period in which the second reference voltage is applied to the second bus line is divided into at least two periods. In the first period, the output voltages passing through a plurality of buffer amplifiers inside the buffer amplifier units 53 are supplied to the second bus lines, and in the second period, the second reference voltage corresponding to the driving voltage for displaying the predetermined image data described above is supplied to the second bus lines.

Preferably, further, the drive circuit of the liquid crystal display device based on the second principle of the present invention includes a control circuit portion 4A for controlling the scanning timing of a plurality of pixels and the timing of the image data display on the selected pixels, and a decoder unit 24 for converting the display data sent from the control circuit portion 4A to each corresponding display data signal and supplying it to the selector unit 26 on the basis of the control signals from the control circuit portion 4A. In the first period described above, the supply of the display data signal from the decoder unit 24 to the selector unit 26 is restricted by the control signals from the control circuit portion 4A, and in the second period, the supply of the display data signal from the decoder unit 24 to the selector unit 26 is allowed.

Figure 43:
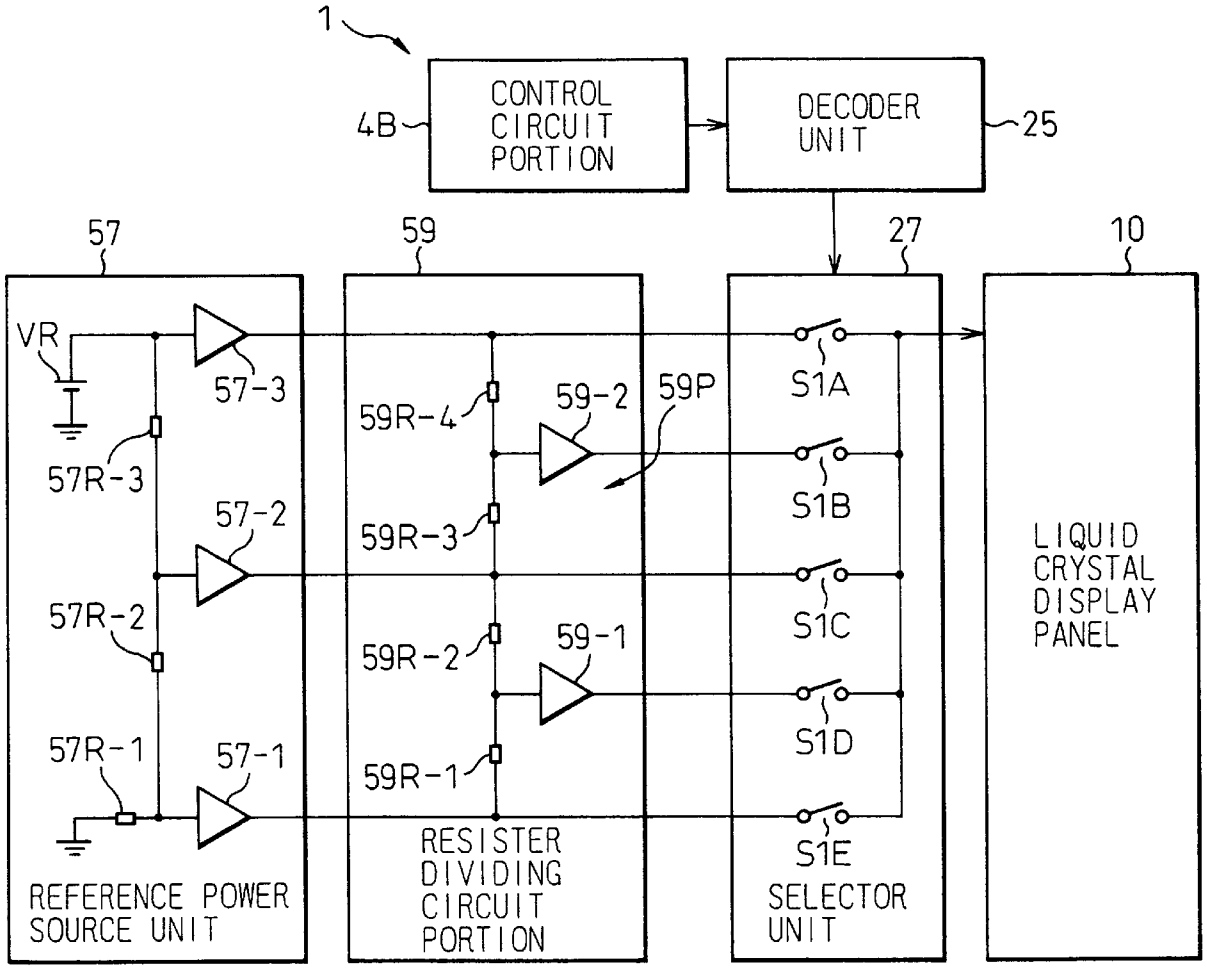
FIG. 43 is a block diagram showing the construction of a basic embodiment on the third principal of the present invention.

Further, as shown in FIG. 43, the drive circuit of the liquid crystal display device 1 constituting the basic embodiment on the basis of the third principle of the present invention includes a reference power source unit 57 for dividing an arbitrary power source voltage VR by a plurality of voltage dividing resistors 57R-1 to 57R-3 so as to generate a plurality of first reference voltages; a resistor dividing circuit portion 59 for further dividing a plurality of reference voltages outputted from the reference power source unit 57 through a plurality of buffer amplifiers (driver units) 57-1 to 57-3 (by, for example, a plurality of voltage dividing resistors 59R-1 to 59R-4), and generating a plurality of second reference voltages inclusive of driving voltages of all the magnitudes; and a selector unit 27 including a plurality of analog switches S1A to S2E for selecting the second reference voltage corresponding to predetermined image data from a plurality of second reference voltages outputted from the resistor dividing circuit portion 59 and supplying it to the second bus lines. Further, the resistor dividing circuit portion 59 includes a plurality of voltage dividing resistors for outputting a plurality of second reference voltages, and buffer circuit unit 59P comprising a plurality of buffer amplifiers 59R-1 to 59R-4 disposed between the junctions of these dividing resistors and the selector unit 27. The period in which the second reference voltage is applied to the second bus line is divided into at least two periods. In the first period, the output voltages passed through a plurality of buffer amplifiers inside the buffer circuit unit 59P are supplied to the second bus lines and in the second period, the second reference voltage corresponding to the driving voltage for displaying the predetermined image data is supplied to the second bus line.

Preferably, further, the drive circuit of the liquid crystal display device 1 on the basis of the third principle of the present invention includes a control circuit portion 4B for controlling the scanning timing of a plurality of pixels and the timing of the image data display on the selected pixels, and a decoder unit 25 for converting the display data sent from the control circuit portion 4B to the display data signal for each of the second bus lines and supplying it to the selector unit 57 on the basis of the control signals from the control circuit portion 4B. In the first period, the supply of the display data signal from the decoder unit 25 to the selector unit 27 is restricted by the control signal from the control circuit portion 4B and in the second period, the supply of the display data signal from the decoder unit 25 to the selector unit 27 is allowed.

Preferably, further, in the drive circuit of the liquid crystal display device 1 based on the third principle of the present invention, power source voltages of a plurality of buffer amplifiers inside the buffer circuit unit 59P described above are supplied from the reference power source unit 57.

Preferably, further, in the drive circuit of the liquid crystal display device 1 based on the third principle of the present invention, the power source voltages of a plurality of buffer amplifiers inside the buffer circuit unit 59P are supplied from a power source which is used in common with other logic circuit devices.

Further, the liquid crystal display device associated with the first principle of the present invention comprises a liquid crystal display panel 10 including a plurality of pixels, first bus lines for serially scanning these pixels and second bus lines for supplying a driving voltage for displaying predetermined image data to the selected pixel on the first bus lines, and a drive circuit for driving the first and second bus lines, as shown in the afore-mentioned FIG. 13. This drive circuit includes a reference voltage selecting circuit 9 for selecting a reference voltage corresponding to the driving voltage from among a plurality of reference voltages generated by dividing an arbitrary power source voltage by a plurality of voltage dividing resistors and supplying the selected reference voltage to the second bus lines; a reference voltage selection controlling circuit 7 for stopping the supply of the driving voltage by the reference voltage selecting circuit after the driving voltage is applied to the second bus lines for a predetermined time; and a power source controlling circuit 6 for stopping the supply of the power source from the power source to the voltage dividing resistors after the driving voltage is applied to the second bus lines for the predetermined time.

As shown in FIG. 34, the liquid crystal display device associated with the second principle of the present invention is equipped with a liquid crystal display panel 10 including a plurality of pixels and first bus lines for serially scanning these pixels and second bus lines for supplying a driving voltage for display predetermined pixel data on the selected pixels on the first bus lines, and with a drive circuit for driving the first and second bus lines. This drive circuit includes a reference voltage generating circuit portion 52 for generating a plurality of first reference voltages by dividing an arbitrary power source voltage by a plurality of voltage dividing resistors; a resistor dividing circuit unit 54 for generating a plurality of second reference voltages inclusive of driving voltages of all the magnitudes by further dividing a plurality of first reference voltages outputted from the reference voltage generating circuit portion 52; a selector unit 26 for selecting a second reference voltage corresponding to the driving voltage for displaying predetermined image data from among a plurality of second reference voltages outputted from the resistor dividing circuit unit 54 and supplying the selected voltage to the second bus line; and a buffer amplifier unit 53 comprising a plurality of buffer amplifiers interposed between the reference voltage generating circuit portion 52 and the resistor dividing circuit unit 54.

As shown in FIG. 43, further, the liquid crystal display device associated with the third principle of the present invention includes a liquid crystal display panel 10, having a plurality of pixels and first bus lines for serially scanning these pixels, and second bus lines for supplying a driving voltage for displaying predetermined image data on the selected pixels on the first bus line; and a drive circuit for driving the first and second bus lines. This drive circuit includes a reference power source unit 57 for generating a plurality of first reference voltages by dividing an arbitrary power source voltage by a plurality of voltage dividing resistors; a resistor dividing circuit portion 59 for generating a plurality of second reference voltages inclusive of driving voltages of all the magnitudes by further dividing a plurality of first reference voltages outputted from the reference power source unit 57; and a selector unit 27 for selecting a second reference voltage corresponding to the driving voltage for displaying the predetermined image data and supplying the selected reference voltage to the second bus line.

In a liquid crystal display device including a plurality of pixels, first bus lines for serially scanning these pixels and second bus lines for supplying a driving voltage for displaying predetermined image data on the selected pixels on the first bus line, a driving method of a liquid crystal display device associated with the above-mentioned FIG. 13 according to the present invention includes steps of selecting a driving voltage corresponding to the predetermined image data from among a plurality of reference voltages generated by dividing an arbitrary power source voltage by a plurality of voltage dividing resistors; applying the selected voltage to the second bus line for a predetermined period; stopping then the supply of the driving voltage to the second bus line; applying the driving voltage to the second bus line for a predetermined period; and stopping the supply of the voltage from the power source to the voltage dividing resistors.

In a liquid crystal display device including a plurality of pixels, first bus lines for serially scanning these pixels and second bus lines for supplying a driving voltage for displaying predetermined image data on the selected pixels on the first bus lines, a driving method of a liquid crystal display device associated with the above-mentioned FIG. 34 according to the present invention includes steps of generating a plurality of first reference voltages by dividing an arbitrary power source voltage by a plurality of voltage dividing resistors and outputting them through a buffer amplifier; dividing further the first reference voltage by a plurality of voltage dividing resistors to generate second reference voltages; and dividing the period, in which the second reference voltage is applied to the second bus line, into at least two periods, supplying the output voltage passing through the buffer amplifier to the second bus line in the first period, and supplying the second reference voltage corresponding to the driving voltage for displaying the predetermined image data to the second bus line in the second period.

In a liquid crystal display device including a plurality of pixels, first bus lines for serially scanning these pixels and second bus lines for supplying a driving voltage for displaying predetermined image data on the selected pixels on the first bus line, a driving method of a liquid crystal display device associated with the above-mentioned FIG. 43 includes steps of generating a plurality of first reference voltages by dividing an arbitrary power source voltage by a plurality of voltage dividing resistors; generating second reference voltages by further dividing the first reference voltage by a plurality of voltage dividing resistors, outputting the output from the junctions of the voltage dividing resistors among the second reference voltages, through a buffer amplifier, dividing the period, in which the second reference voltage is applied to the second bus line, into at least two periods, supplying the output voltage passing through the buffer amplifier to the second bus line during the first period, and supplying the second reference voltage corresponding to the driving voltage for displaying the predetermined image data to the second bus line in the second period.

Figure 15:
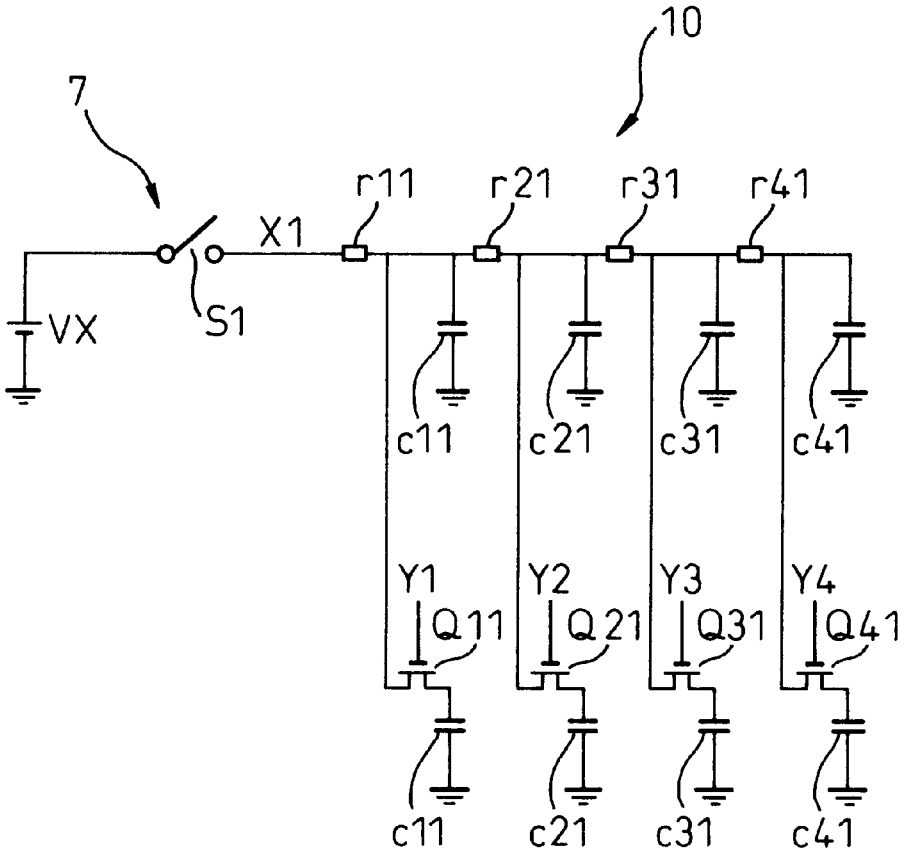
FIG. 15 is a circuit diagram showing an equivalent circuit of a data line and useful for explaining the first principle of the present invention typified by the basic embodiment shown in FIG. 13.
Figure 16:
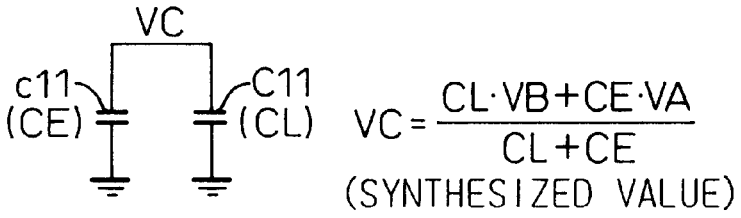
FIG. 16 is a circuit diagram showing an equivalent circuit in the movement of electric charges and useful for explaining the first principle of the present invention typified by the basic embodiment shown in FIG. 13.

FIG. 15 is an equivalent circuit diagram useful for explaining the first principle typified by the basic embodiment of the present invention shown in FIG. 13, and FIG. 16 is an equivalent circuit diagram showing the movement of electric charges and useful for explaining the first principle described above.

In the drive circuit of the basic embodiment based on the first principle of the present invention, after the driving voltage (typically, a gradation voltage) is written into the data line as the second bus line (for example, the data line X1), the reference voltage selection controlling circuit 7 (or 7') turns off all the switches such as the selectors inside the reference voltage selecting circuit 9, and then the power source controlling circuit 6 makes the steady state current flowing through a plurality of voltage dividing resistors inside the reference voltage generating circuit 5 zero so as to reduce electric power for driving the liquid crystal display panel, as shown in FIGS. 15 and 16 which are explanatory views of the first principle.

Referring to the explanatory views of the principle of FIGS. 15 and 16, the explanation will be given in further detail as to the reason why no problem occurs even when the connection between the data line and the data driver portion (display data signal timing determining circuit 2, reference voltage selecting circuit 9 and reference voltage selection controlling circuit 7) is cut off by the reference voltage selection controlling circuit 7 after a charging of the data line of the liquid crystal display panel 10 is finished.

FIG. 15 shows an equivalent circuit of each data line (for example, a data line X1). This data line comprises a kind of distributed constant circuit consisting of distributed resistors and distributed capacities. In this case, the distributed resistors r11 to r41, each having a resistance value 4, are formed by a material that forms the data line, and distributed capacities c11 to c41, each having a capacitance value c, include, as the main capacitance component, the synthesized value of a capacitance brought about by defining the liquid crystal interposed between the data line and an opposed electrode as a dielectric and a capacitance brought about by defining an insulator at the point of intersection between the data line and a scan bus line i.e., the first bus line, as a dielectric.

In the case of a liquid crystal display panel 10 having a size of 10.4 in. and 640×480 pixels, the typical values are as follows. The total resistance value of the resistance values r is about 10 kΩ and the total capacitance value of the capacitance values c is about 100 pF. On the other hand, the capacitance value of each of the liquid crystal capacities C11 to C41, into which the gradation voltage is written through the TFT, is 1 pF at the most. When a voltage VX is applied to the data line, the gradation voltage is written into the object liquid crystal capacities through the TFT, which is turned ON, while electric charges corresponding to this voltage are being charged into the distributed capacities described above. When it is desired to write the voltage into the object liquid crystal capacities, the voltage may be selectively written to the liquid crystal capacities of only the pixels whose scan bus line is raised to the high level. Since the resistance value of the TFT during the ON state (generally called the "ON resistance", as described before) is several MΩ, the charging of the voltage to the liquid crystal capacities is not always completed even when the charging of the distributed capacities of the data lines is finished.

Figure 4:
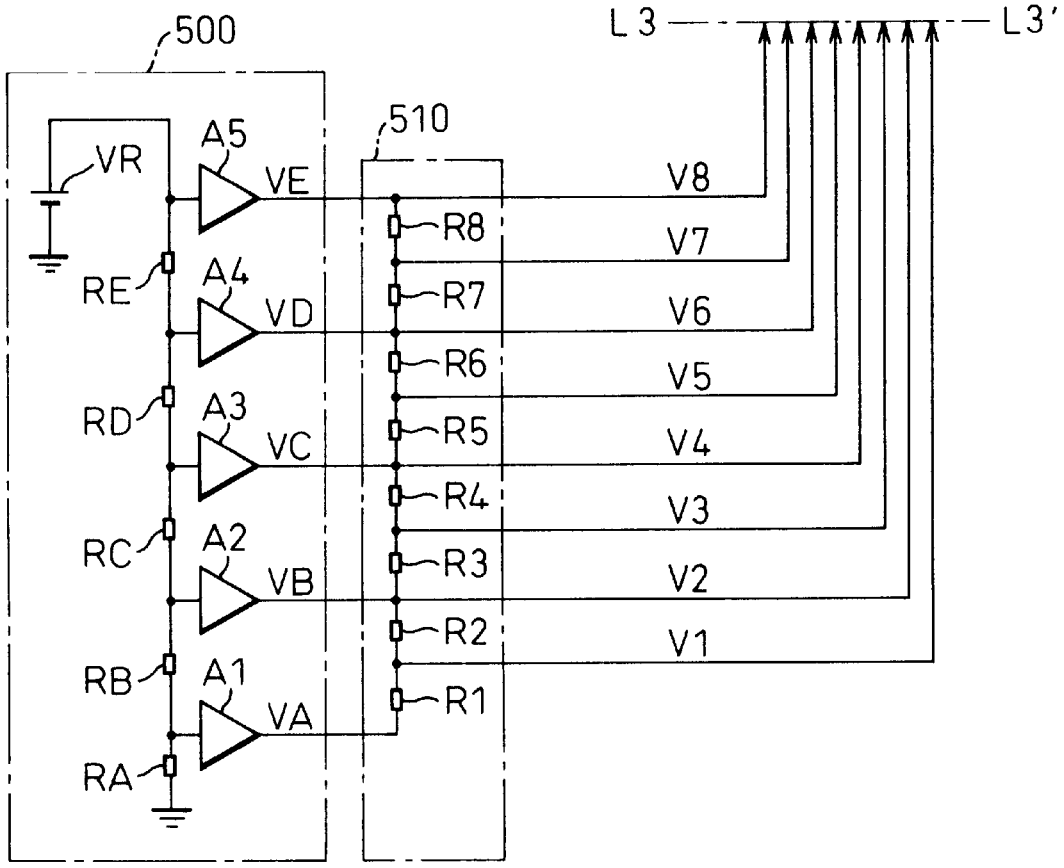
FIG. 4 is a circuit block diagram showing the second portion of the principal part of the liquid crystal display device according to the prior art.
Figure 5:
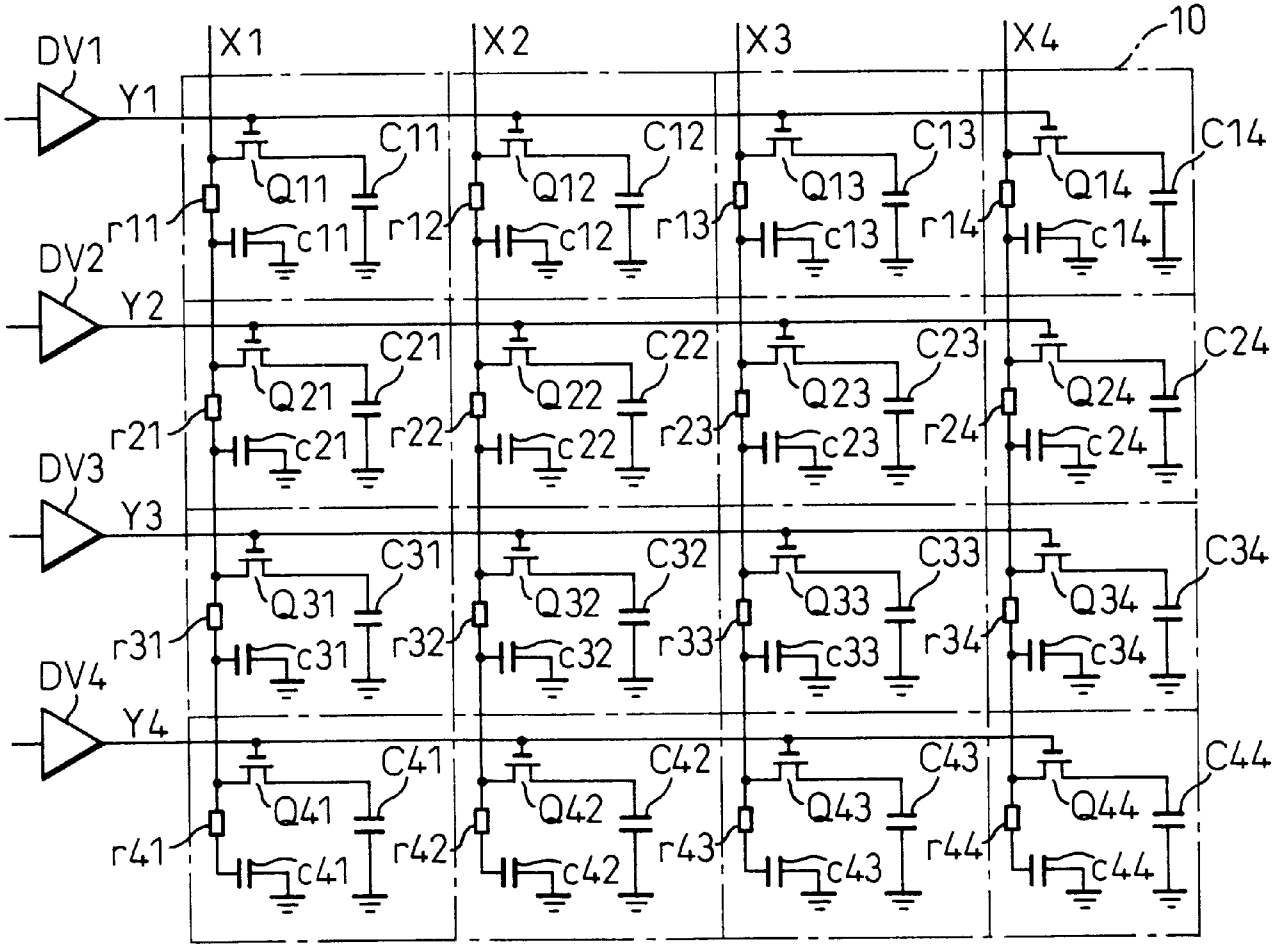
FIG. 5 is a circuit diagram showing a detailed example of a liquid crystal display panel shown in FIG. 2.
Figure 6:
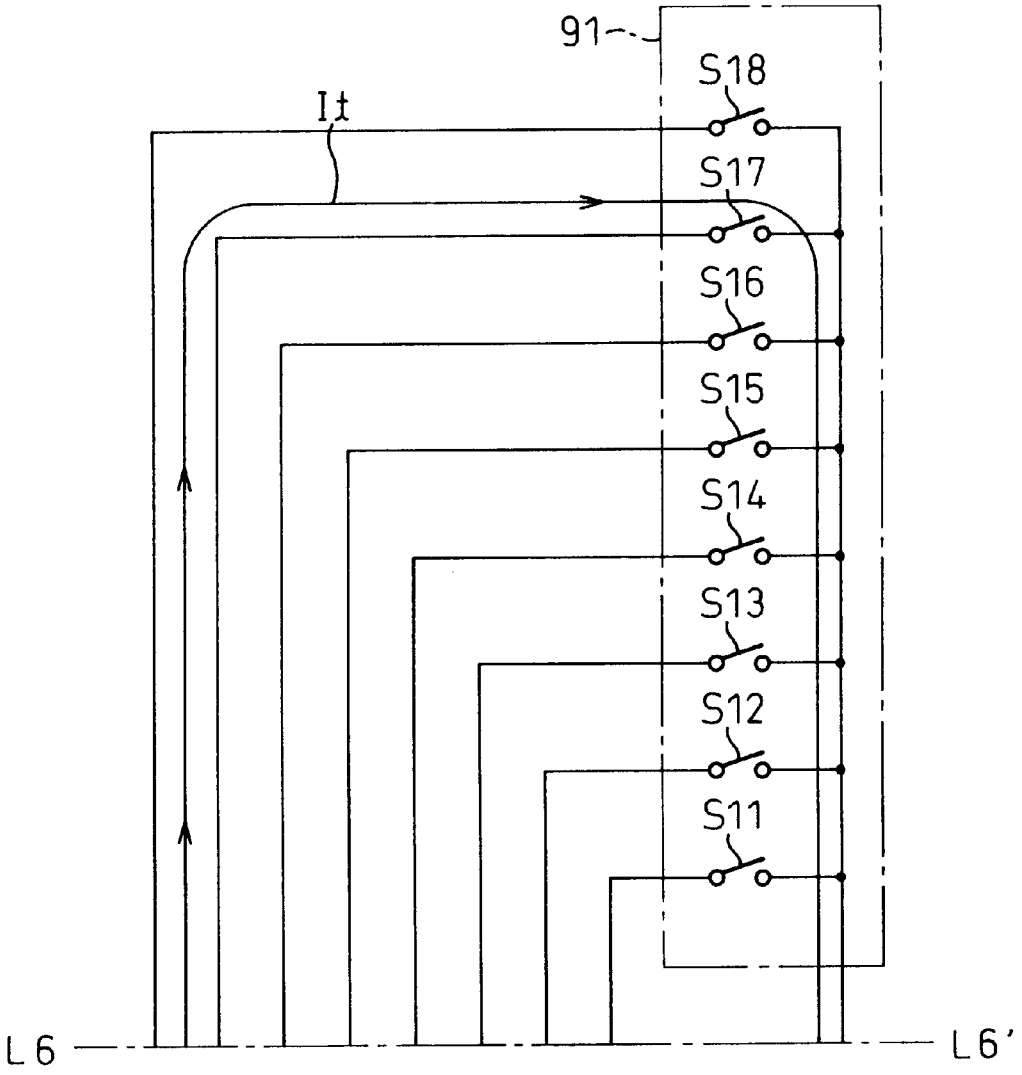
FIG. 6 is a circuit diagram of the first portion for explaining the problem of a drive circuit of a liquid crystal display device according to the prior art.
Figure 7:
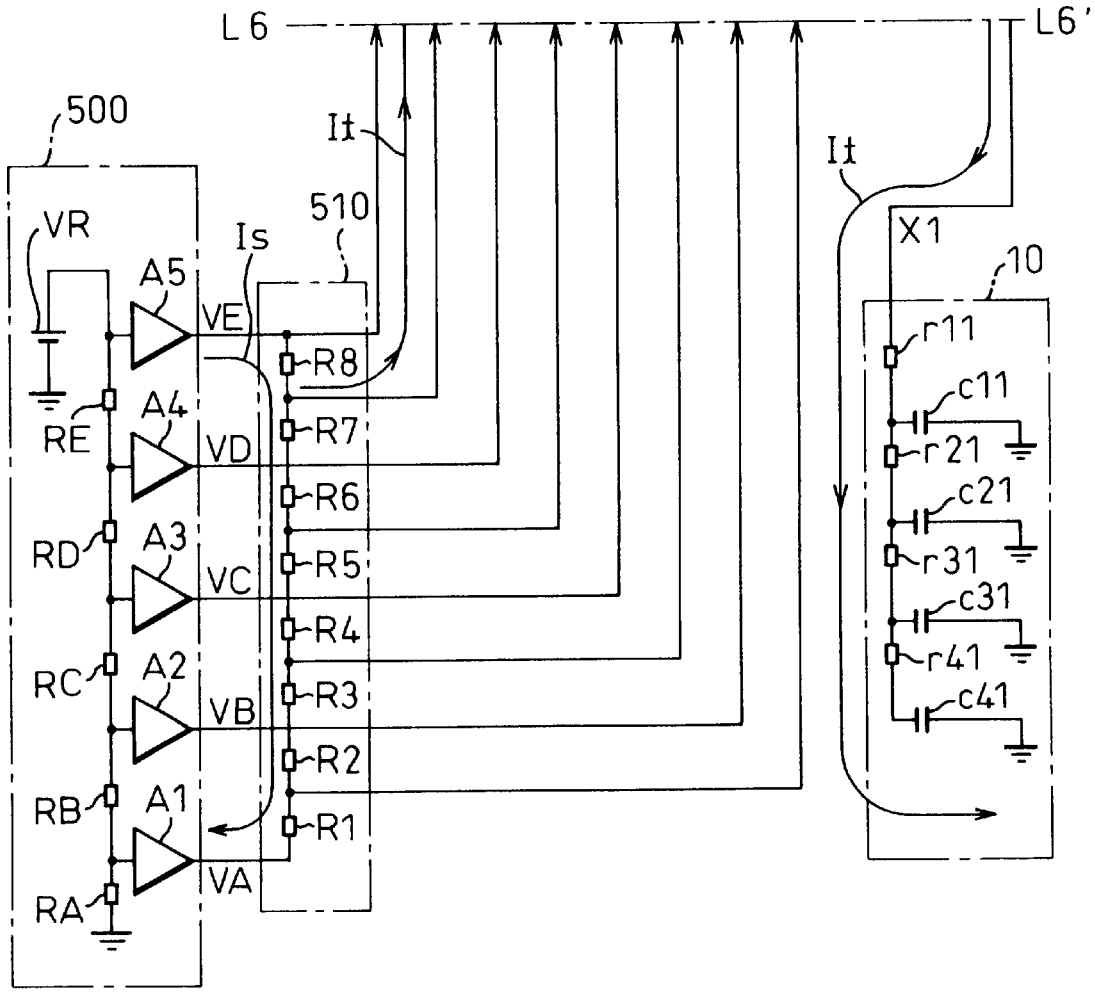
FIG. 7 is a circuit diagram of the second portion for explaining the problem of a drive circuit of a liquid crystal display device according to the prior art.
Figure 8:
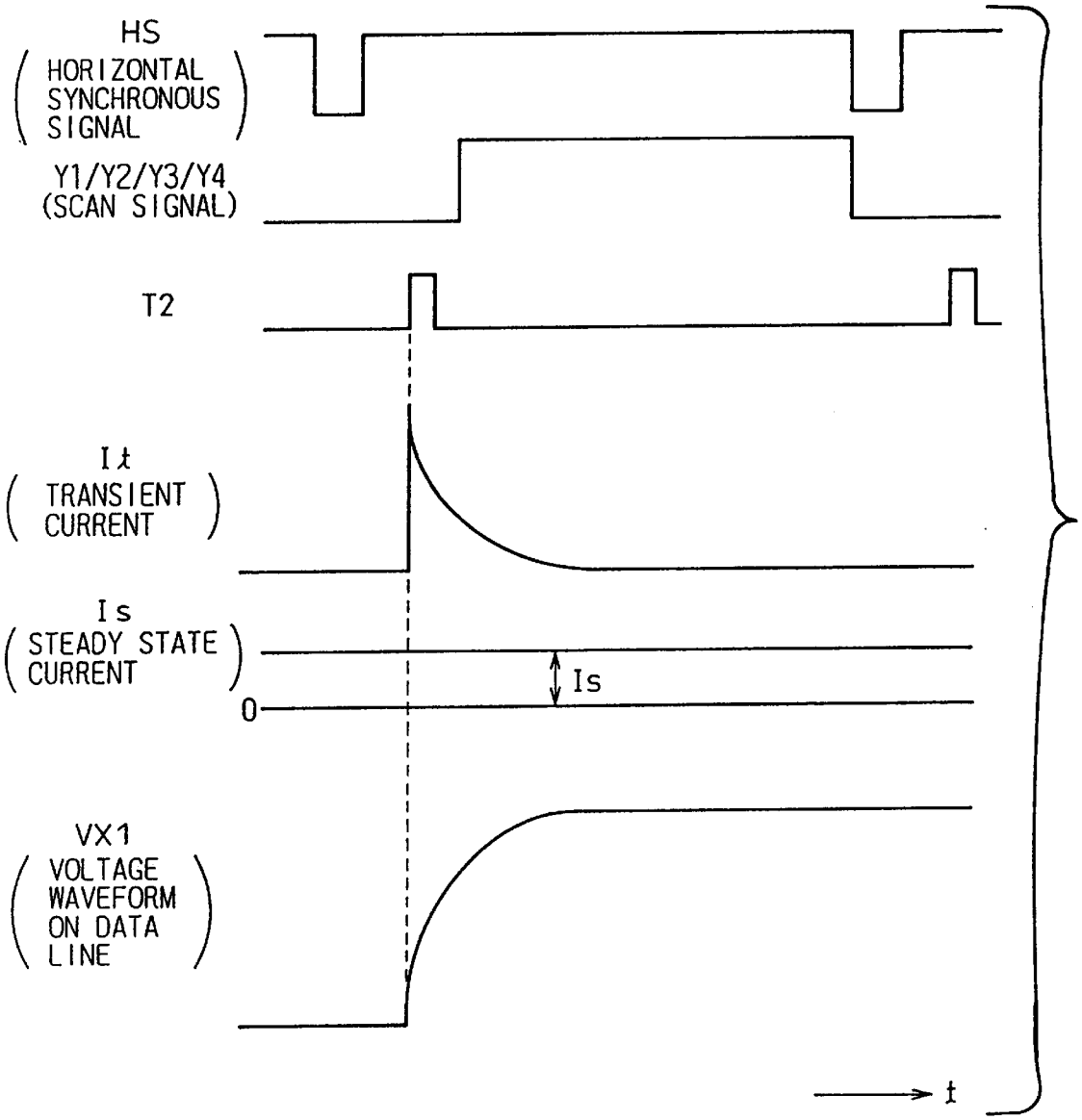
FIG. 8 is a timing chart useful for explaining the problem of a drive circuit of a liquid crystal display device according to the prior art.
Figure 9A:
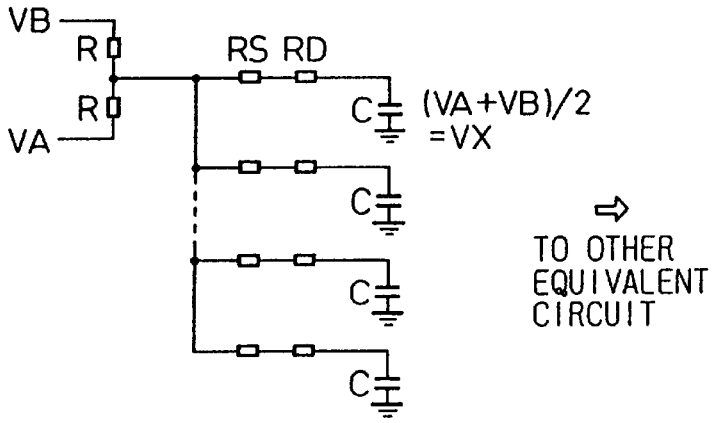
FIG. 9 is an equivalent circuit diagram of the first portion useful for explaining in further detail the problem of a prior art system.
Figure 9B:
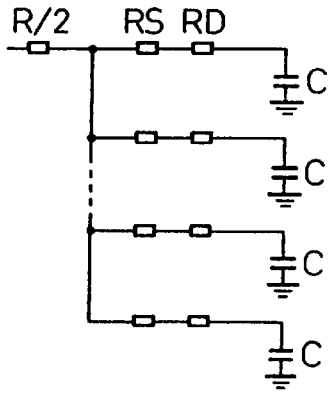
Figure 10A:
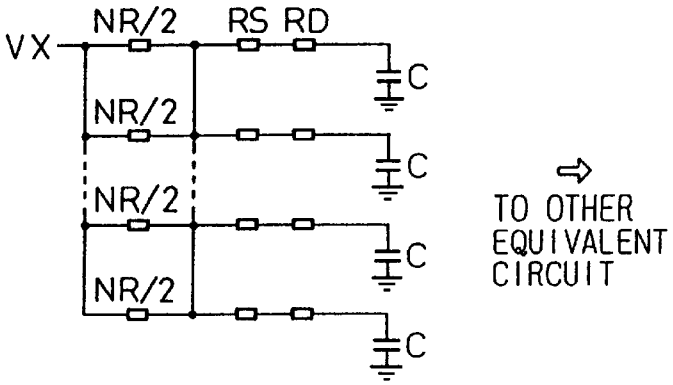
FIG. 10 is an equivalent circuit diagram of the second portion useful for explaining in further detail the problem of a prior art system.
Figure 10B:
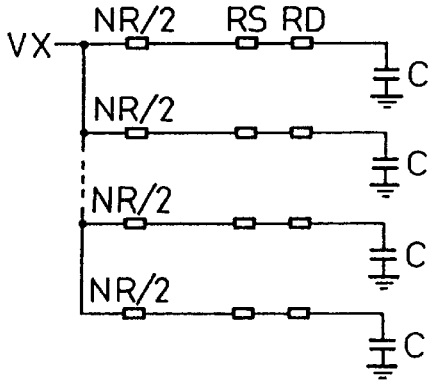
Figure 11:
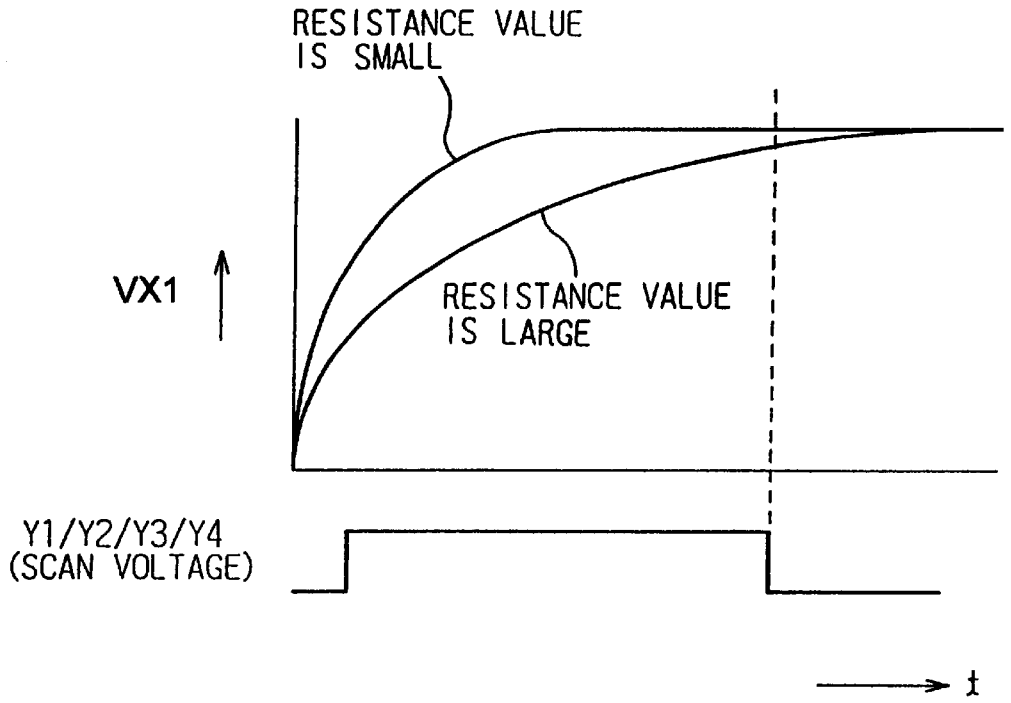
FIG. 11 is a timing chart useful for explaining in further detail the problem of a prior art system.
Figure 12:
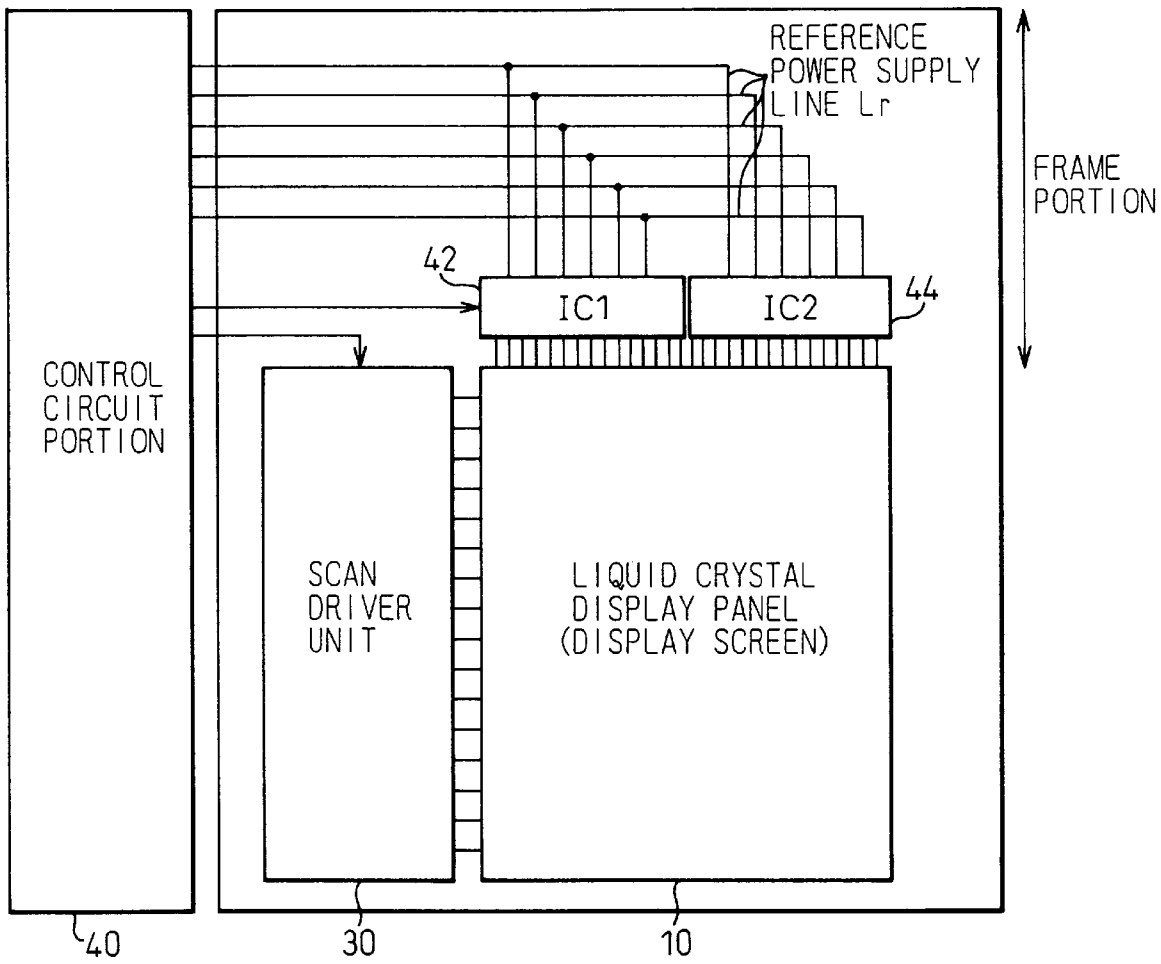
FIG. 12 is a block diagram showing the construction of a frame portion of conventional liquid crystal display devices.

Therefore, when the switch devices S, etc., of the reference voltage selection controlling circuit 7 (or the reference voltage selection controlling circuit 7') on the data line are turned OFF after the charging of the data line has been finished, redistribution of electric charges occurs between the electric charges accumulated in the distributed capacities C11 and the electric charges that have already been accumulated in the liquid crystal capacities C11 as shown in FIG. 4, and the voltage changes consequently. The voltage after this change (synthesized value) can be expressed by the formula VC=(CL×VB+CE×VA)/(CL+CE). Here, CL represents the capacitance value of the liquid crystal capacities, VA represents the initial value of the voltage built up in the distributed capacities, CE represents the total capacitance value in the distributed capacities and VB represents the value of the voltage that has been already built up in the liquid crystal capacities at the time when the switch devices S are turned OFF. A calculation example of this value is given below.

It is assumed that CL=1 pF, VA=5V, CE=100 pF and BV=4V, VC=4.990V. This voltage value exhibits an absolute error of about 10 mV with respect to a correct value 5V, and the value of the relative error is 0.2%. Therefore, no problem occurs in practice. If the value of the voltage corresponding to the electric charges which have been charged into the liquid crystal capacities becomes greater, the error becomes even smaller.

As described above, no practical problem occurs even when the supply of the voltage from the data driver portion is cut off after the charging in the data line is finished, in consideration of the fact that the charging to the liquid crystal capacities is accurately carried out.

According to the second principle of the present invention typified by the basic embodiment shown in FIG. 34, on the other hand, charging in the data line is carried out in two divided periods. In other words, in the first period (i.e., former half period), the data line is charged by the direct output of the buffer amplifier but not by the reference voltage passing through a plurality of voltage dividing resistors. In the second period (i.e., latter half period), the charging is carried out up to the final value by the normal voltage based on the image data.

In other words, in the first period, the voltage value itself applied in the second period or a value approximate to this voltage value is selected, and the charging is effected at high speed by the output of the buffer amplifier having a low output resistance. In the second period, only the voltage corresponding to the difference between the final voltage value and the current voltage value is used for charging. In this way, even when the resistance value of the voltage dividing resistor is increased, the charging can be carried out up to the final value within the necessary period, and a lower power consumption can be accomplished by setting the value of the dividing resistor to a relatively large value. Quite naturally, a driving circuit can be constituted by combining the first principle of the present invention with the second principle thereof, and an effect of reduced power consumption brought about by the present invention becomes larger in such a case.

According to the third principle of the present invention typified by the basic embodiment shown in FIG. 43, the buffer amplifier is disposed at the posterior side of the voltage dividing resistors so that the data line can be charged at a lower output resistance even when the resistance value of the voltage dividing resistors is relatively large. The problem occurring when the buffer amplifier is disposed in the IC data driver portion is that the power source which can be used by the buffer amplifier is only the power source of the voltage for charging the data line, given from the reference power source, or the power source for operating the logic circuit devices.

In this case, the buffer amplifier cannot be disposed for all the voltage dividing resistors. As for this reason, it can be mentioned that when a 5V power source voltage is used, for example, the voltage which the buffer amplifier can output is about 1.5 to 3.5V. Therefore, the diagram of the third principle of the present invention uses the buffer amplifier for only the voltage that can be generated inside the IC data driver, and the power source of the common portion is applied as the reference voltage to the data driver. According to the above-mentioned circuit construction, the value of the voltage dividing resistors can be increased, a lower power consumption can be attained, and the intended object of the present invention can be thus accomplished. Quite naturally, a driving circuit can be constituted by combining the first principle with the third principle, and the effect of reduced power consumption, etc., brought about by the present invention can be further improved in such a case.

As described above, all the switches such as the selector portions inside the reference voltage selecting circuit 9 are turned OFF after the driving voltage is written into the second bus line so as to cut off the steady state current flowing through a plurality of voltage dividing resistors for generating the reference voltage, in the present invention. Therefore, power consumption inside the circuit caused by this steady state current can be saved, and as the charging speed of the liquid crystal capacities of the second bus line is increased by relatively reducing the resistance value of the voltage dividing resistors, a liquid crystal display panel having excellent display quality particularly in the case of multiple gradation display can be accomplished.

In the present invention, further, the charging of the liquid crystal capacities of the second bus line is carried out dividedly in two periods. Namely, in the first period, the voltage value itself that is applied in the second period (i.e., latter half period), or a value approximate to this voltage value, is selected, and the charging is carried out at high speed by the output of the buffer amplifier having a low output resistance. Therefore, even when the resistance value of the voltage dividing resistors is increased, a lower power consumption in the driving circuit and a high speed of the liquid crystal display speed can be accomplished.

In the present invention, further, the buffer amplifier, which is easy for integration, is disposed at the posterior side of a plurality of voltage dividing resistors so that even when the resistance values of these resistors are relatively large, the liquid crystal capacities of the data line can be charged by a low output resistance. Therefore, even when the resistance values of the voltage dividing resistors are increased up to considerably large value, a lower power consumption in the driving circuit and the higher display speed of the liquid crystal can be accomplished while keeping small the area of the frame portion of the liquid crystal display panel.

Hereinafter, some preferred embodiments of the present invention will be explained in detail with reference to FIGS. 17 to 33, FIGS. 35 to 42 and FIGS. 44 to 47 of the accompanying drawings.

Figure 17:
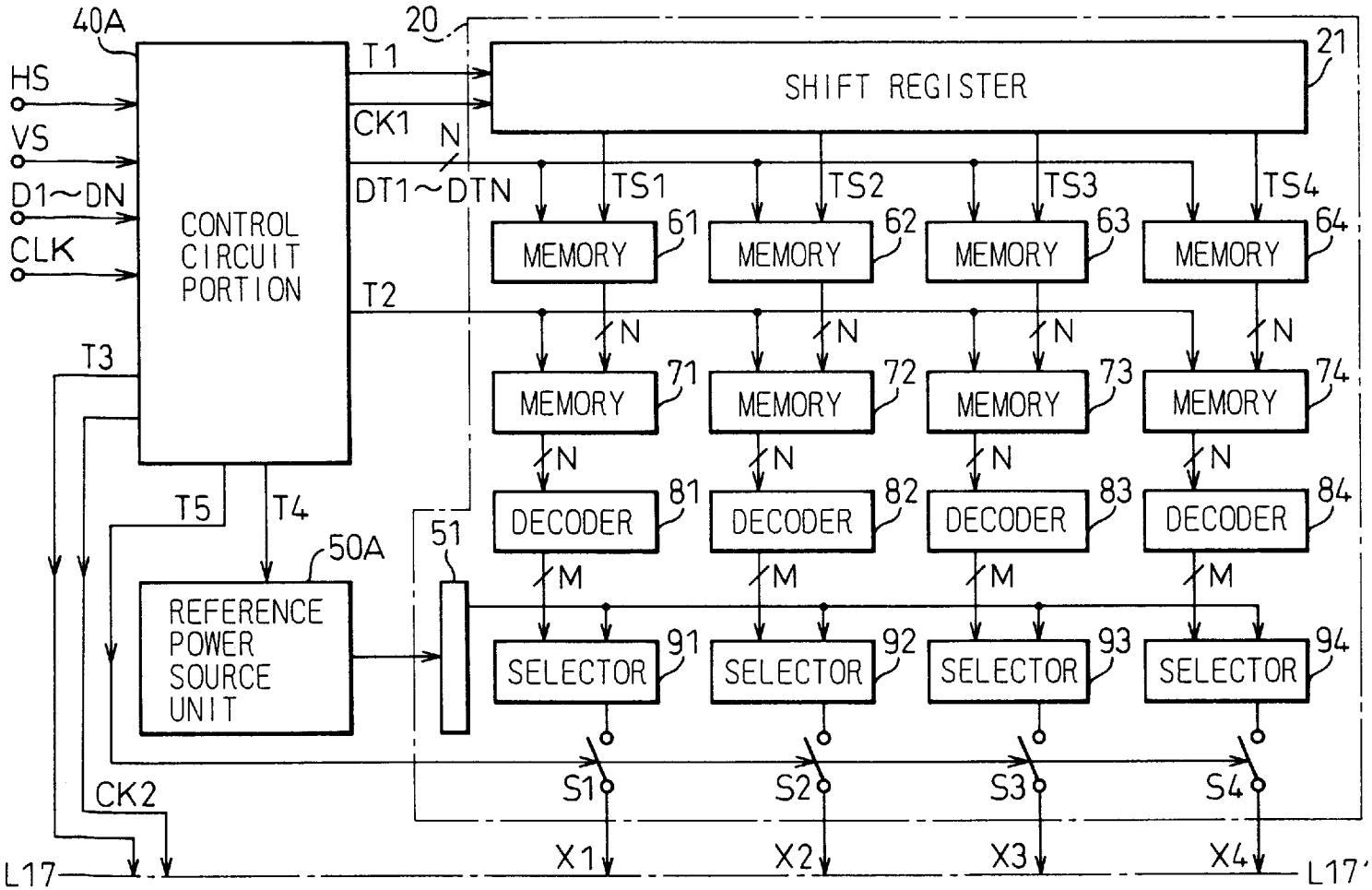
FIG. 17 is a circuit block diagram showing the construction of the first portion of the first preferred embodiment of the present invention.
Figure 18:
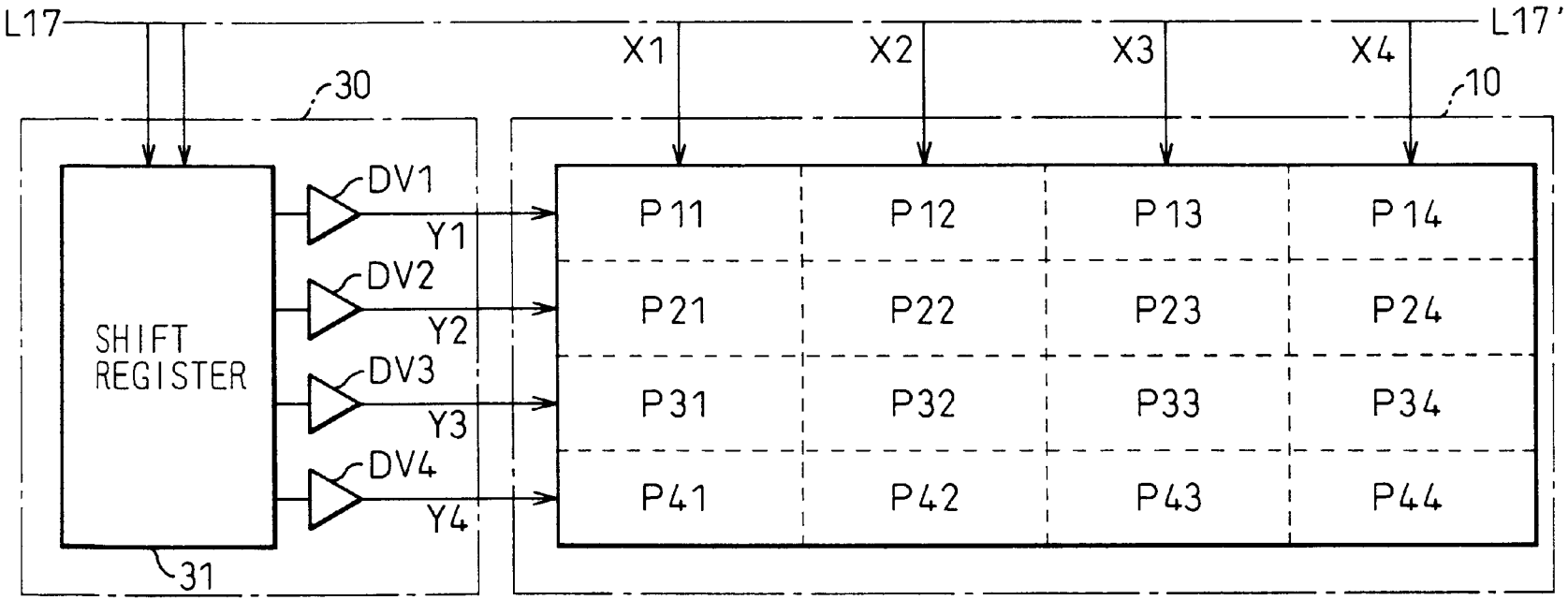
FIG. 18 is a circuit block diagram showing the construction of the second portion of the first preferred embodiment of the present invention.
Figure 19:
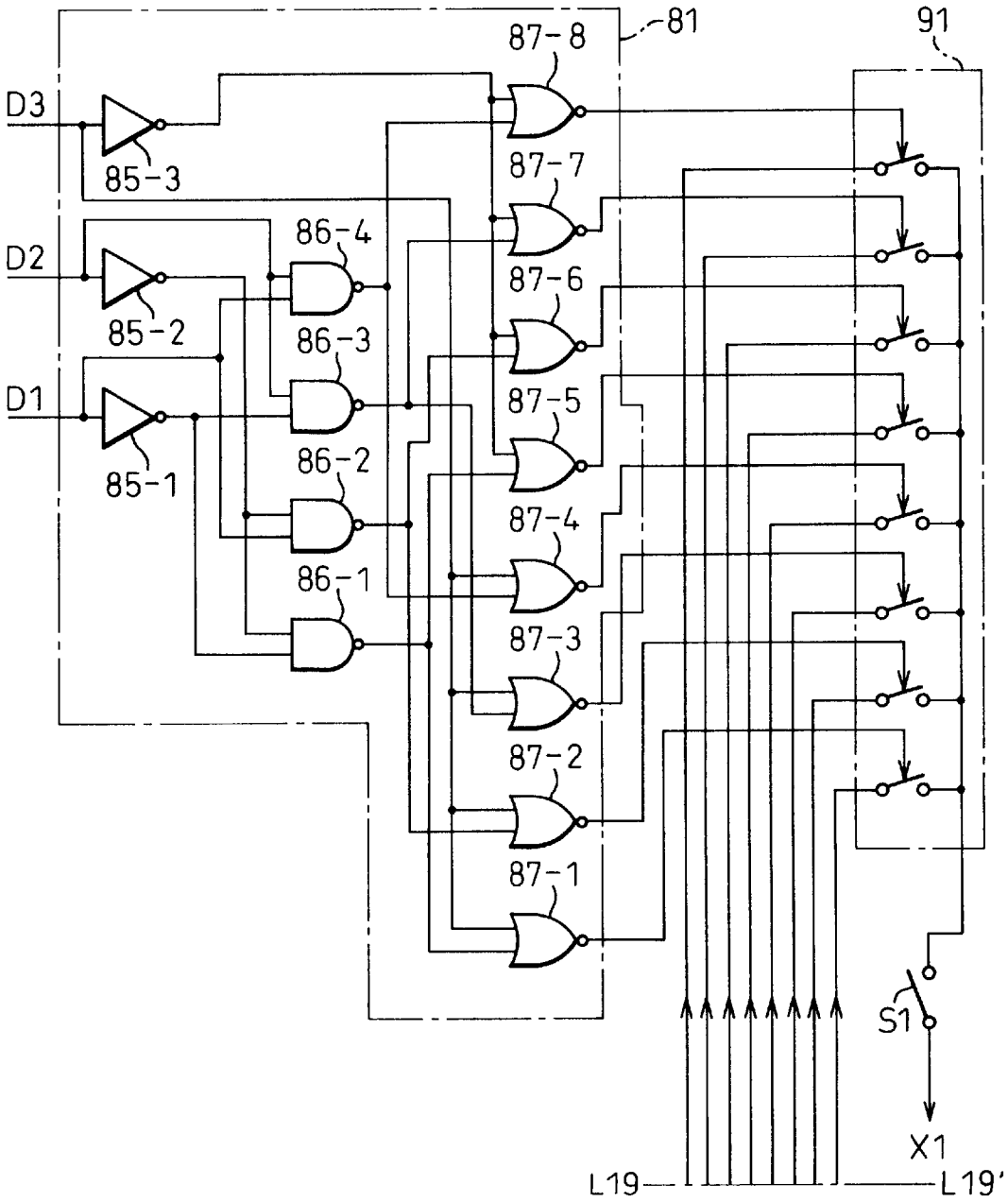
FIG. 19 is a circuit block diagram showing the first portion of the first example of a reference power source unit in the first preferred embodiment of the present invention.
Figure 20:
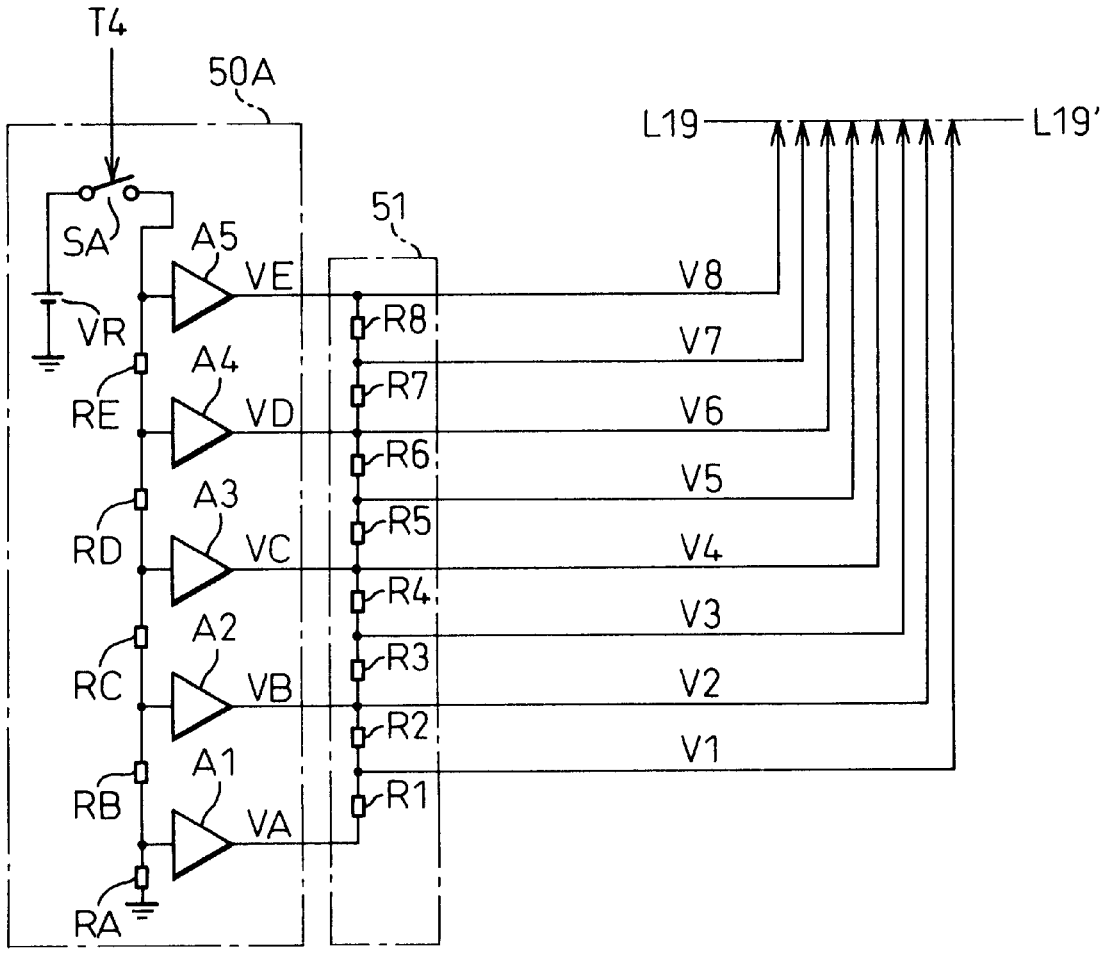
FIG. 20 is a circuit block diagram showing the second portion of the first example of the reference power source unit in the first preferred embodiment of the present invention.

FIGS. 17 and 18 are block diagrams showing the first portion and the second portion of the first preferred embodiment of the present invention, respectively; and FIGS. 19 and 20 are circuit block diagrams showing the first portion and the second portion of the first example of the reference power source unit in the first preferred embodiment of the present invention, respectively. The first preferred embodiment (hereinafter called the "first embodiment") of the present invention shown in FIGS. 17 and 18 corresponds to the first embodiment based on the first principle of the present invention as typified by the basic embodiment shown in FIG. 13. Incidentally, like reference numerals will be used to identify like constituent elements.

In FIGS. 17 and 18, a control circuit portion 40A is disposed as the control circuit portion 4 shown in the afore-mentioned FIG. 13. This control circuit portion 40A controls operations of all the drive circuits including the later-appearing data driver portion 20 and scan driver 30 on the basis of various control signals (control signals Sct, Scs, Scr and Scy shown in FIG. 13). The circuit construction of this control circuit portion 40A is substantially the same as that of the control circuit portion 400 (see FIG. 1) described in the paragraph of the Related Art.

Control signals such as a horizontal sync signal HS representing the scanning cycle at the time of displaying the image data and a vertical sync signal VS for supplying the write voltage to the image data selected on the data line are inputted to this control circuit portion 40A. Further, D1 to DN inputted to the control circuit portion 40A represents binary image data, and N represents the number of bits for effecting gradation display. Further, CLK inputted to the control circuit portion 40A represents the clock signal given in synchronism with the image data. This clock signal sets the timing of writing the image data D1 to DN. It is hereby noted that the clock signal CLK can be generated inside the driving circuit by counting the cycle of the horizontal sync signal HS, and is not essentially necessary as one of interface devices.

In FIG. 17, the display data signal timing determining circuit 2 in the basic embodiment shown in FIG. 13 includes a shift register 21. Inside this shift register 21 are generated control signals such as timing signals TS1 to TS4 for serially writing display data into a memory unit comprising first memories 61 to 64, when a start signal T1 representing the display start of the image data for each line and the clock CK1 for advancing the register are sent from the control circuit portion 40A for each line. Each of the first memories 61 to 64 comprises a memory having an N-bit capacity, and the image data DT1 to DTN of an N-bit parallel system are stored in the first memories 61 to 64, respectively. A memory unit comprising the second memories 71 to 74, too, comprises memories each having an N-bit capacity. In such a circuit construction, after the image data of the parallel system are written into the first memories 61 to 64, the data stored in the first memories 61 to 64 are written by the write control signal T2 before the data of the next scan bus line arrives.

In FIG. 17, further, selectors 91 to 94 functioning as the reference voltage selecting circuit 9 (see FIG. 13) are disposed on the output side of the second memories 71 to 74. These selectors 91 to 94 are a kind of digital-to-analog conversion circuit for generating analog signals corresponding to the digital data stored in the second memories 71 to 74. Decoders 81 to 84 disposed between the selectors 91 to 94 and the second memories 71 to 74 generate signals for turning ON only one analog switch inside the selectors 91 to 94 by decoding the image data given by the binary number. In this way, the selectors 91 to 94 select one of a plurality of kinds (M kinds) of voltages and output it to the data lines X1 to X4. As to the M kind of voltages and the N-bit data stored in the second memories 71 to 74, a relation $M=2^N$ can be established when these data are constituted by all binary numbers.

In FIGS. 17 and 18, further, a plurality of (four, in this case) switch devices S1 to S4 are disposed between the selectors 91 to 94 and the data lines X1 to X4, as the reference voltage selection controlling circuit 7 in the basic embodiment shown in FIG. 13.

The circuit portion including the shift register 21, the first memories 61 to 64, the second memories 71 to 74, the decoders 81 to 84, the selectors 91 to 94 and the switch devices S1 to S4 is preferably constituted as an integrated circuit (IC) as the data driver portion 20.

In FIG. 17, further, the reference voltage generating circuit 5 in the basic embodiment shown in FIG. 13 includes a reference power source unit 50 for generating a plurality of first reference voltages from an arbitrary power source (VR in FIG. 8) by a plurality of voltage dividing resistors (RA to RE in FIG. 8); and a resistor dividing circuit portion 51 for finally generating a plurality of reference voltages by dividing the first reference voltages outputted from the reference power source unit 50A by a plurality of voltage dividing resistors (R1 to R8 in FIG. 8) and sending them to the selectors 91 to 94. The power source controlling circuit 6 in the basic embodiment shown in FIG. 13 preferably comprises the switch devices and can be assembled into the reference power source unit 50A.

The circuit including the shift register 21, the first memories 61 to 64, the second memories 71 to 74, the decoders 81 to 84, the selectors 91 to 94 and the resistor dividing circuit means 51 is preferably integrated (IC) as a whole as the data driver unit 20.

In FIG. 18, further, a scan bus line driving unit 30, having the same construction as that of the scan driver unit according to the prior art (FIG. 2), is disposed as the scan bus line driving unit 3 of the basic embodiment shown FIG. 13. This scan bus line driving unit 30 comprises a shift register 31 which starts the operation thereof by the start signal T3 and advances by the clock CK2, and a plurality of driver units DV1 to DV4 for sending the output signal of this shift register 31 to the scan bus lines Y1 to Y4, respectively. The scan bus line driving unit 30 has the same construction as that of the scan driving unit shown in FIG. 2, and hence, a detailed explanation will be omitted.

As shown in FIGS. 19 and 20, in the principal portions of the first embodiment including the first example of the reference power source unit 50A, the concrete example of the power source controlling circuit 6 in the basic embodiment shown in FIG. 13 corresponds to the switch device SA (FIG. 20) inside the reference power source unit 50A. The difference between the reference power source unit 50A shown in FIG. 19 and the reference power source unit 500 shown in FIG. 4 is that the switch device SA described above is additionally disposed. Further, the switch devices S1 to S4 functioning as the reference voltage selection controlling circuit 7 inside the data driver unit 20 shown in FIG. 19 are controlled by the timing signal T5 as one of the control signals from the control circuit portion 40A, and the switch device SA inside the reference power source unit 50A is controlled by the timing signal T4 as another control signal.

Figure 1:
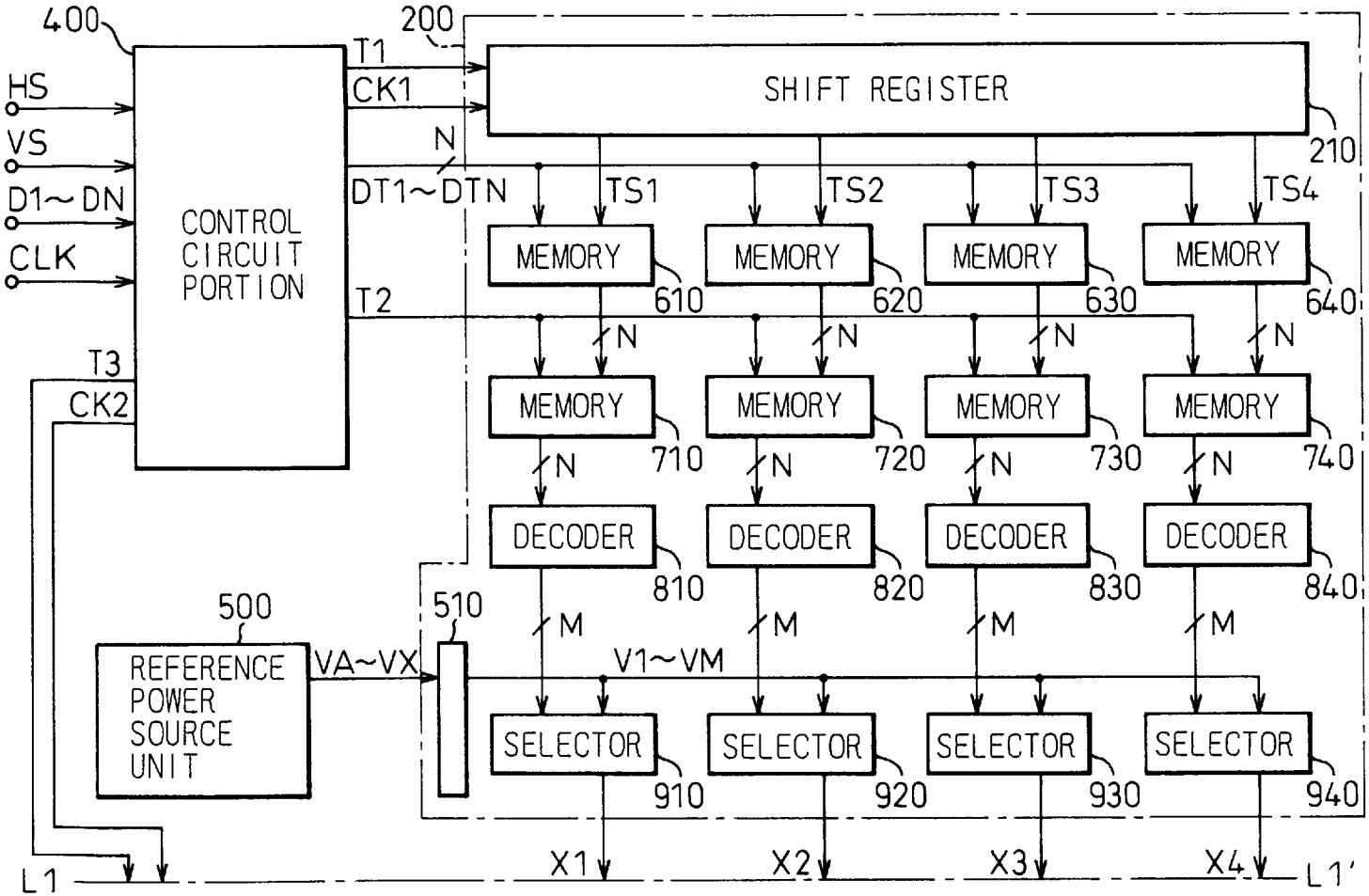
FIG. 1 is a circuit block diagram showing the construction of the first portion of a liquid crystal display device according to the prior art.
Figure 2:
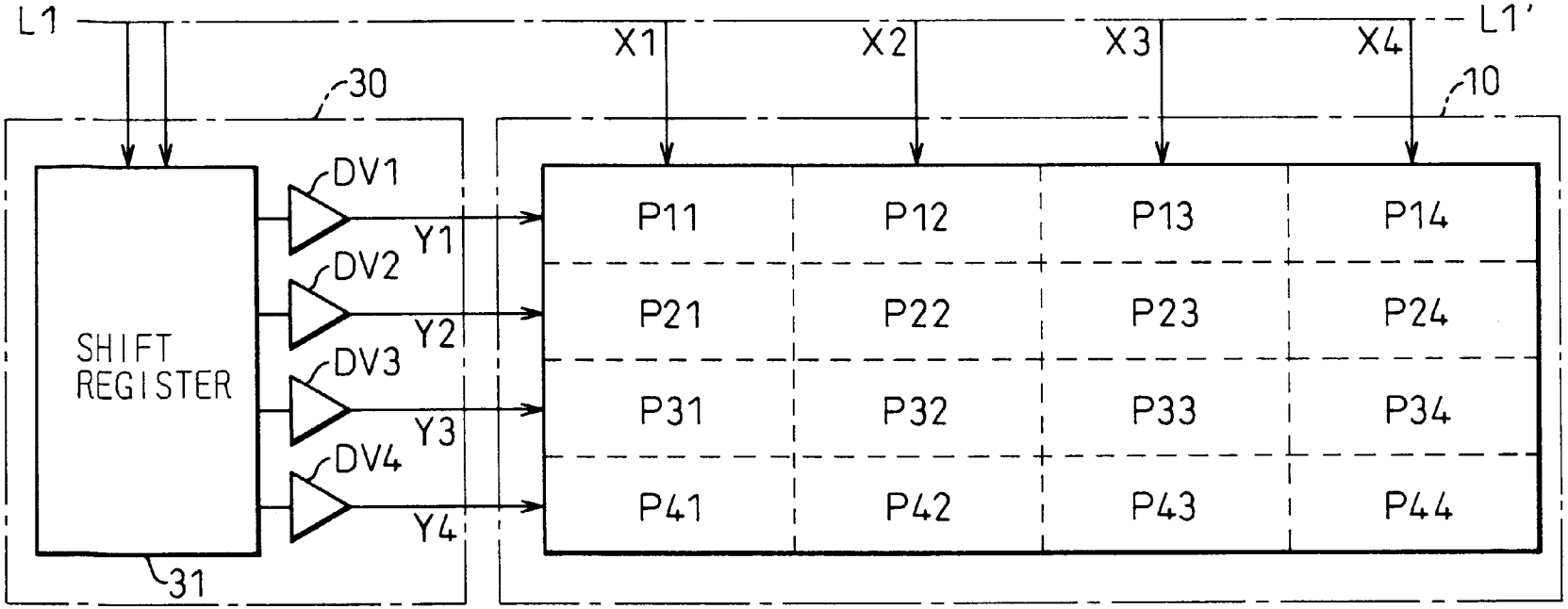
FIG. 2 is a circuit block diagram showing the construction of the second portion of a liquid crystal display device according to the prior art.
Figure 3:
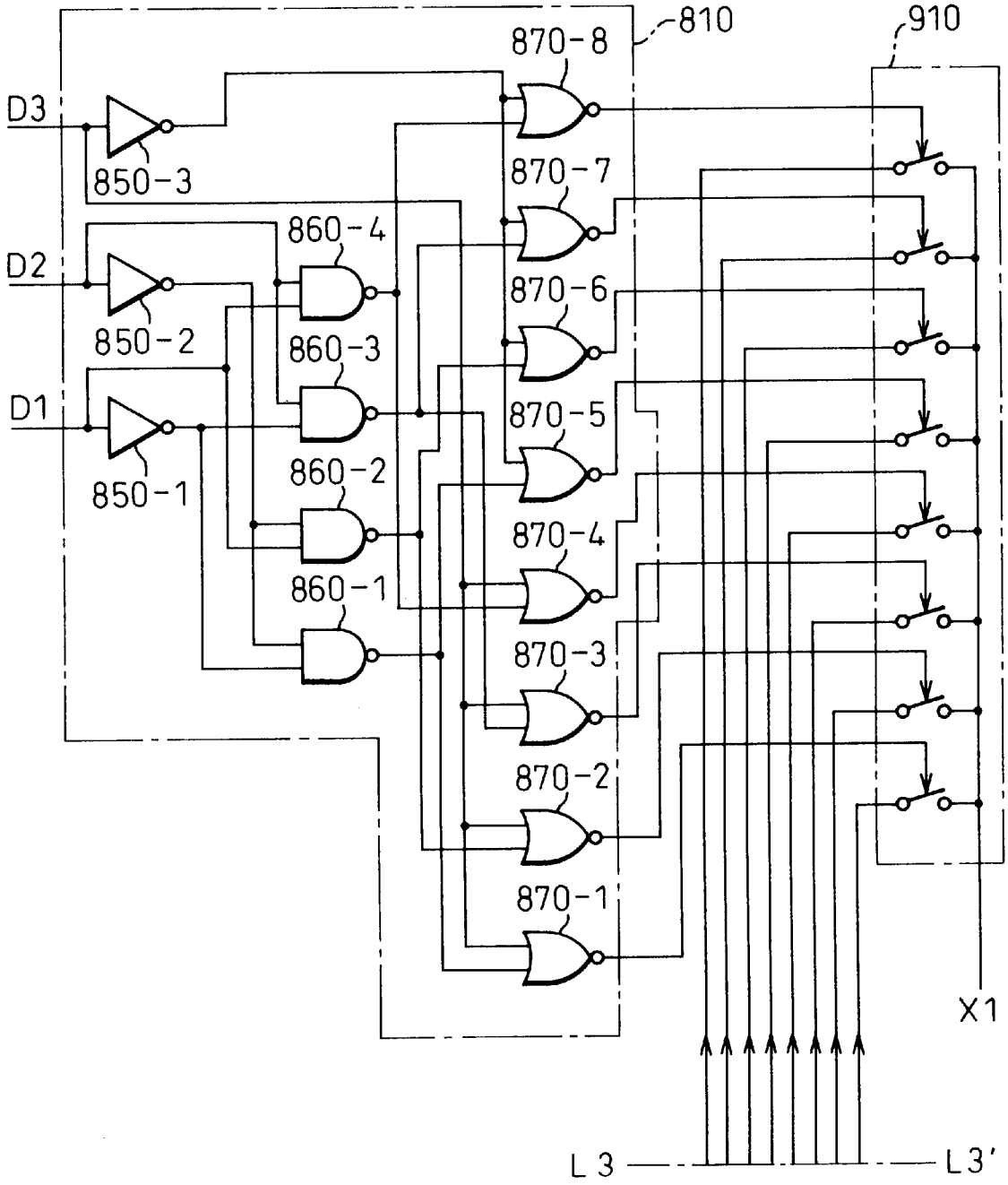
FIG. 3 is a circuit block diagram showing the first portion of the principal part of the liquid crystal display device according to the prior art.

By the way, the constructions of the decoder 81 and the selector 91 and the construction of the resistor dividing circuit portion 51 in FIG. 20 are substantially the same as the constructions of the decoder 810 and the selector 901 shown in FIG. 3 and the construction of the resistor dividing circuit portion 510 shown in FIG. 4. Therefore, a detailed explanation will be omitted.

Figure 24:
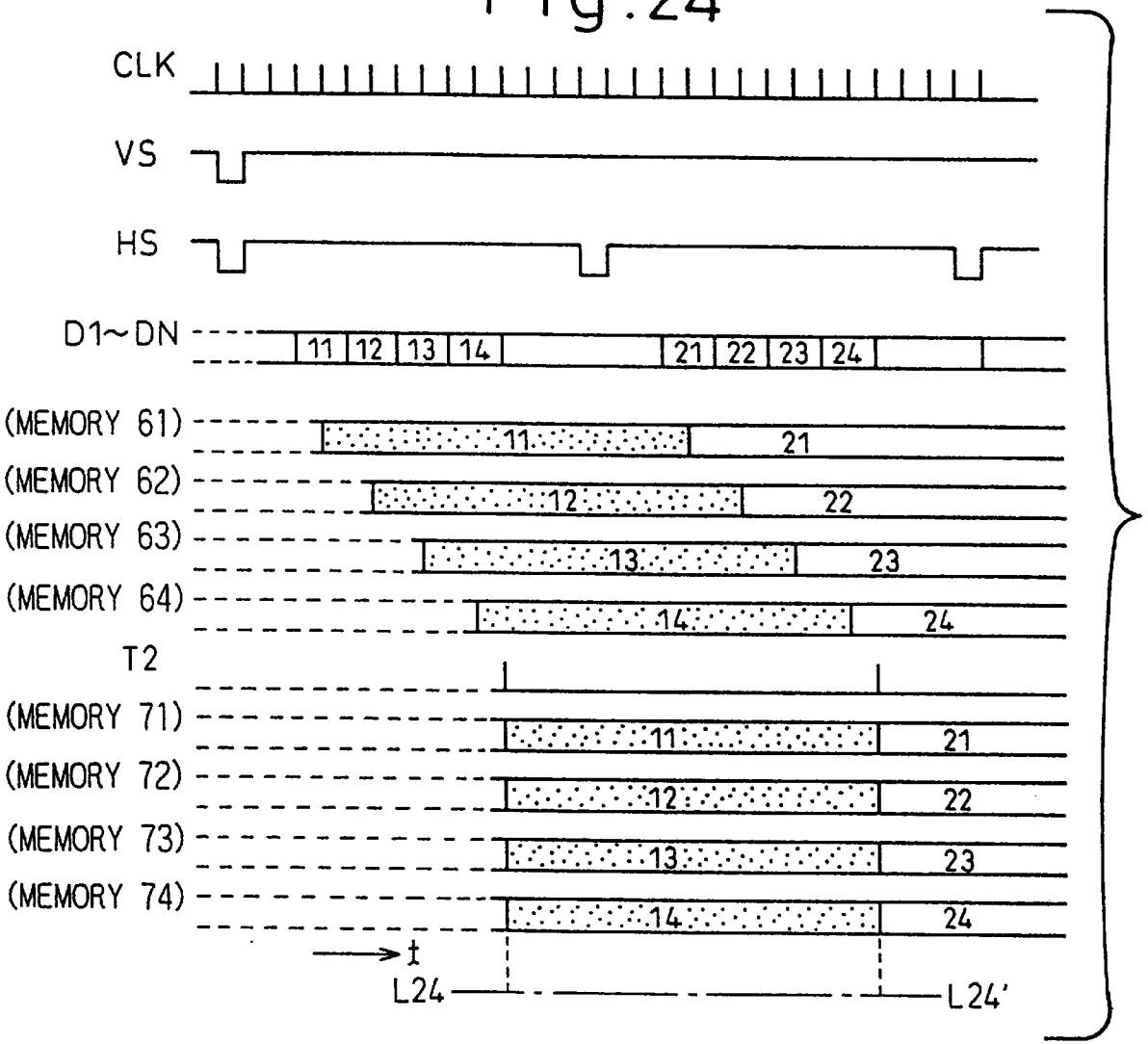
FIG. 24 is a timing chart useful for explaining the former half portion of operations of the first preferred embodiment of the present invention.
Figure 25:
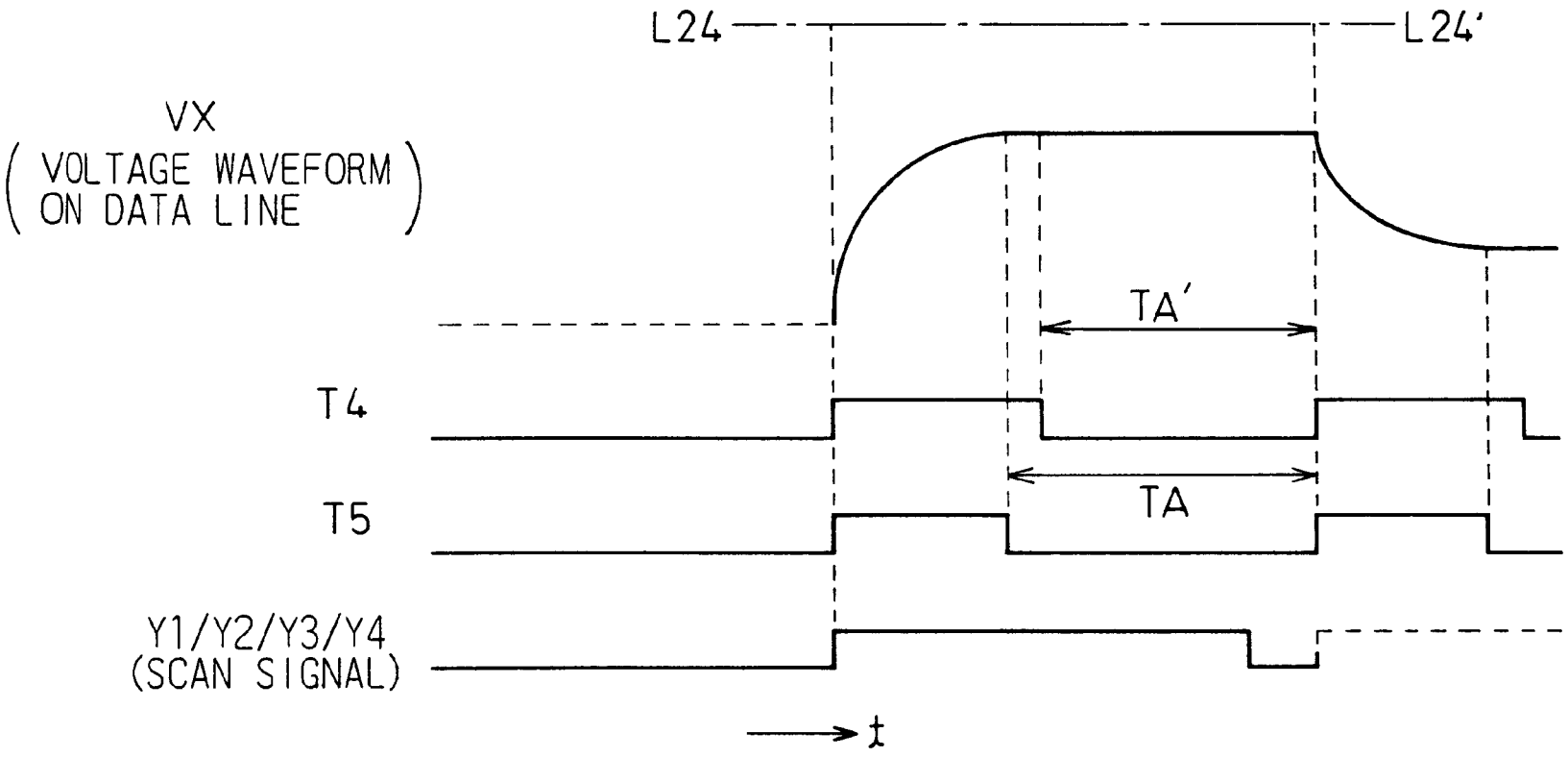
FIG. 25 is a timing chart useful for explaining the latter half portion of operations of the first preferred embodiment of the present invention.

The timing charts of FIGS. 24 and 25 show the relationship between the timing signal and the time change of the voltage waveform on the data line. As shown in FIG. 25, power consumption by the voltage dividing resistors inside the resistor dividing circuit portion 51 does not occur during a period TA' in which the timing signal T4 is "L (Low)" (or turned OFF) and consequently, consumed power can be reduced. In this case, means for adjusting a time period in which the time signal T4 is "H" (High) to the shortest value, within the range in which display quality of the liquid crystal display device does not deteriorate, can be disposed with regard to the timing signal T4. In the case of a full-color display, for example, the timing signal T4 must be elongated so as to improve display quality. However, when a color display by using only 4,096 colors is carried out depending on its applications, no practical problem occurs even when the charging of the liquid crystal capacities in the data line is not completely finished. Therefore, the time period in which the timing signal T4 is "H" can be shortened. As a result, the life of the battery which is particularly important when using a notebook type personal computer can be extended. More concretely, means for setting the duration period of the timing signal T4 by the operator from outside may be provided.

In the timing charts of FIGS. 24 and 25, further, the display data D1 to Dn of the binary numbers are first built up in the first memories 61 to 64 on the basis of the clock signal CLK and the start signal T1. Next, the display data read out from the first memories 61 to 64 are written into the second memories 71 to 71 on the basis of the write control signal T2. Further, the display data read out from the second memories 71 to 71 are decoded by the decoders 81 to 84 on the basis of the timing signal T4 and are inputted as analog display data signals to the selectors 91 to 94. Thereafter, when the charging of the liquid crystal capacities in the data line is finished and the voltage in the same data line becomes substantially constant, the switch devices S1 to S4 are turned OFF on the basis of the timing signal T5. In other words, since the timing signal T5, too, is "L" during the period TA' in which the timing signal T4 is "L", excessive power consumption does not occur.

Figure 21:
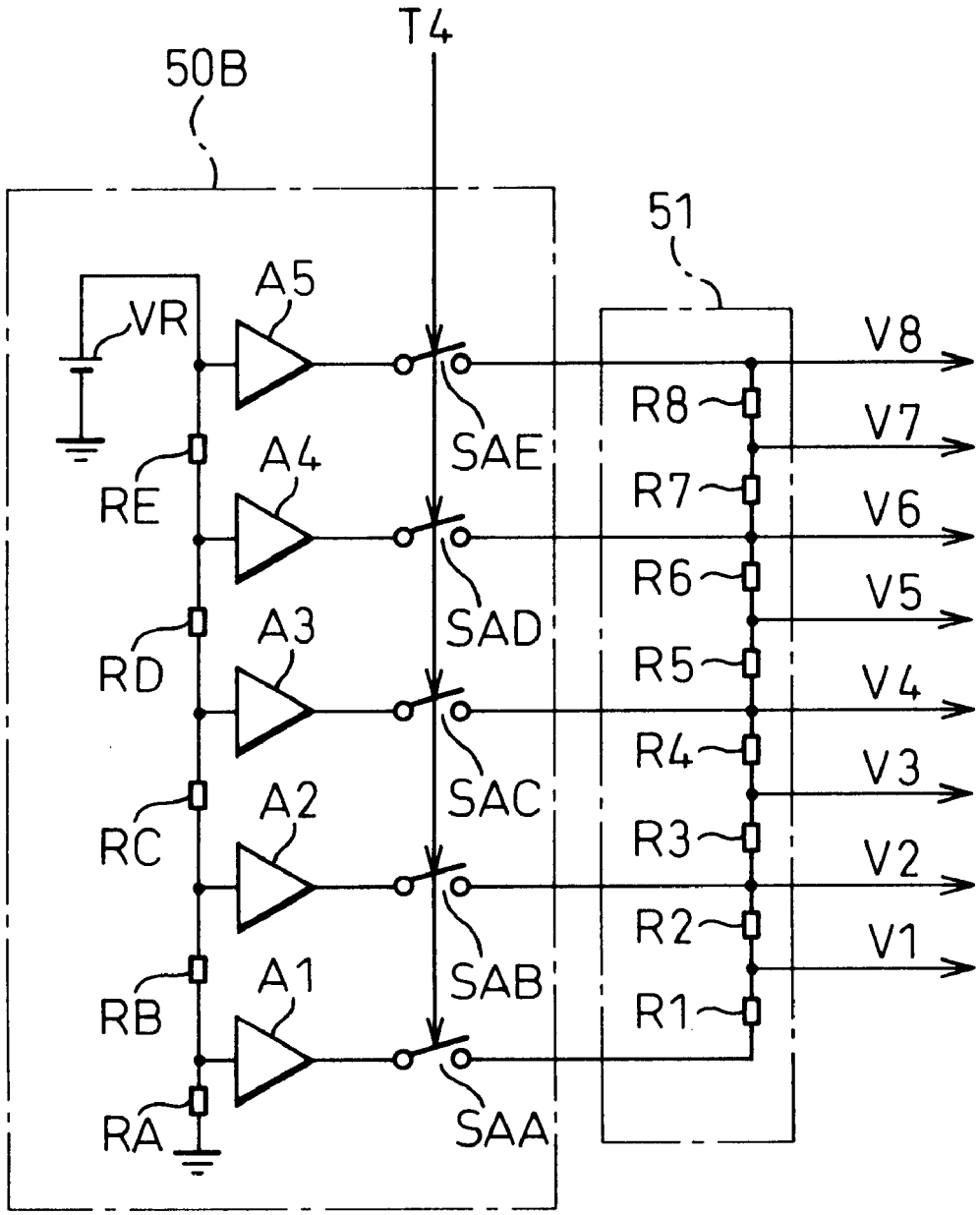
FIG. 21 is a circuit block diagram showing the second example of the reference power source unit in the first preferred embodiment of the present invention.

FIG. 21 is a circuit block diagram showing the second example of the reference power source unit in the first embodiment of the present invention.

The example of the reference power source unit 50B shown in FIG. 21 accomplishes the same function as that of the switch device SA shown in FIG. 20 by disposing a plurality of analog switches SAA to SAE between the buffer amplifiers (driver units) A1 to AT inside the reference power source unit and the voltage dividing resistors R1 to R8. In order to minimize the influences on the steady state current flowing into the resistor dividing circuit portion 51, the ON resistance of the analog switches SAA to SAE at the time when they are turned ON must be small. To accomplish the analog switch having such a small ON resistance, devices for power control called "VMOSs (Vertical Metal Oxide Semiconductors)" are economically available.

Figure 22:
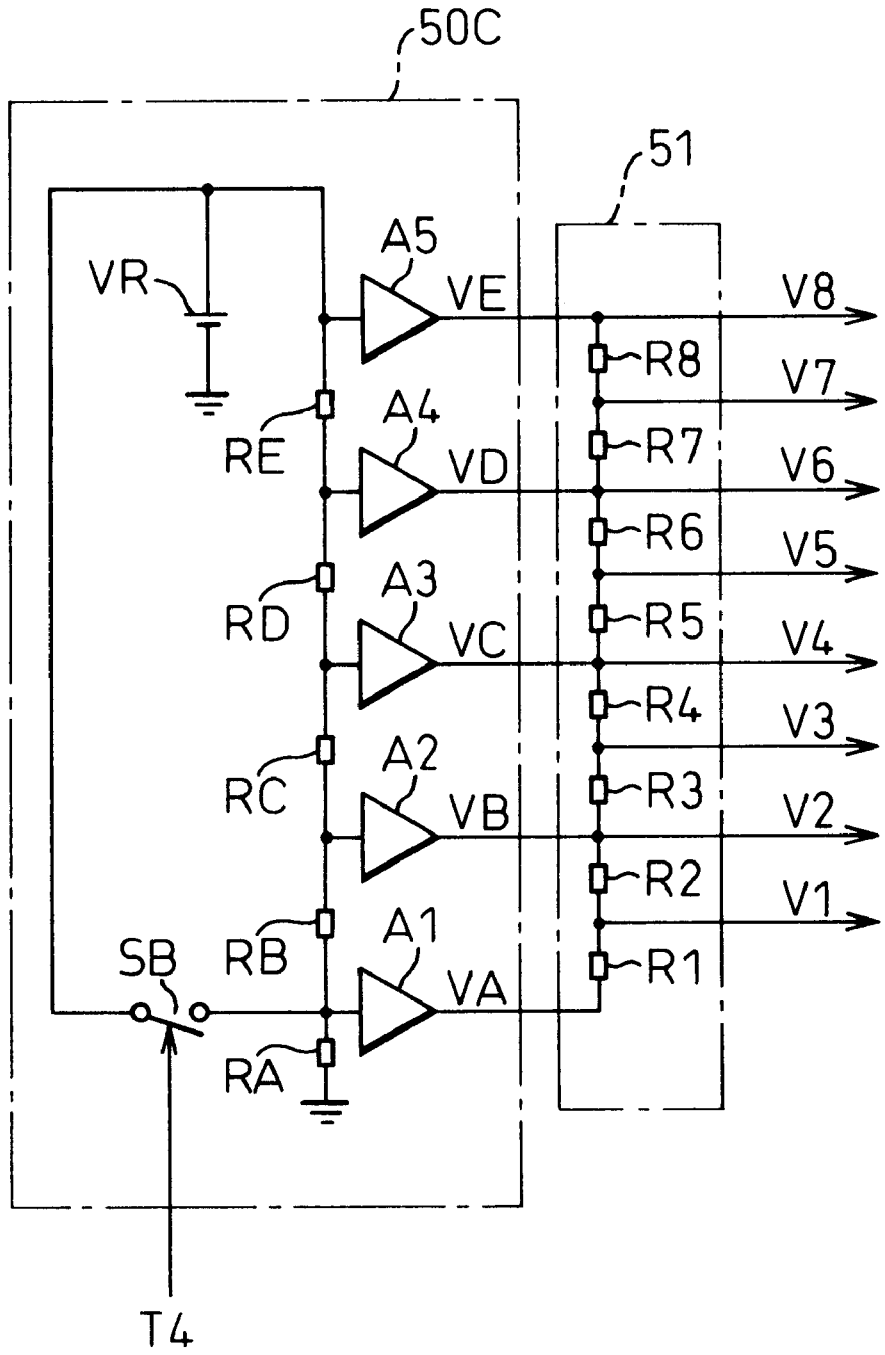
FIG. 22 is a circuit block diagram showing the third example of the reference power source unit in the first preferred embodiment of the present invention.

FIG. 22 is a circuit block diagram showing the third example of the reference power source unit in the first embodiment of the present invention.

In the example of the reference power source unit 50C shown in FIG. 22, a switch device SB having the same function as that of the switch device SA shown in FIG. 20 is connected to the ground terminal side of the power source VR. The switch device VR controls whether or not to supply a voltage to a plurality of voltage dividing resistors from the power source VR on the basis of the timing signal T4 from the control circuit portion.

Figure 23:
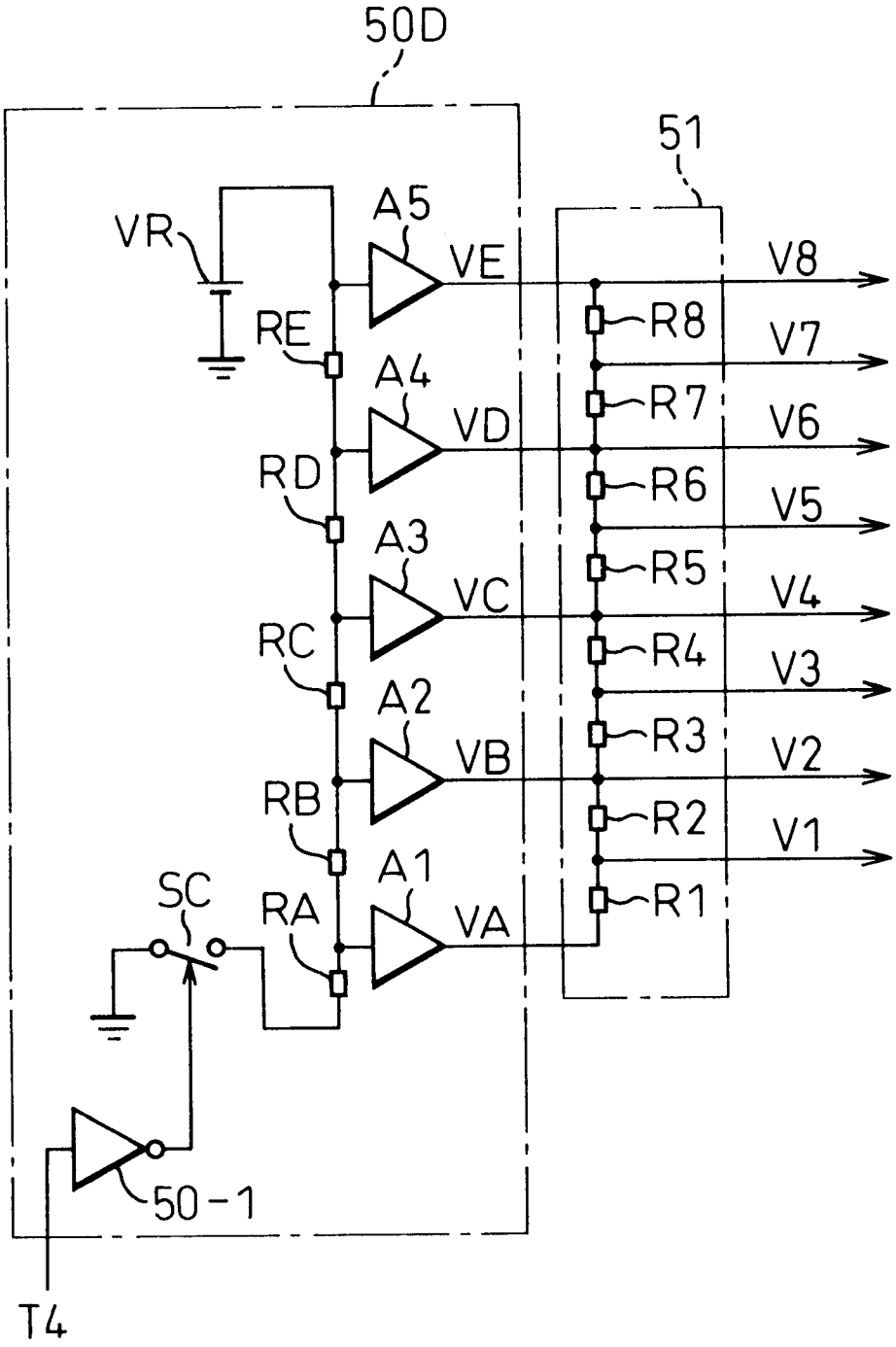
FIG. 23 is a circuit block diagram showing the fourth example of the reference power source unit in the first preferred embodiment of the present invention.

FIG. 23 is a circuit block diagram showing the fourth example of the reference power source unit in the first embodiment of the present invention.

In the example of the reference power source unit 50D shown in FIG. 23, a switch device SC having the same function as that of the switch device SA shown in FIG. 20 is connected to the ground terminal side of the power source VR. Further, since the timing signal T4 from the control circuit portion is supplied to the voltage dividing resistors RA to RE through the buffer device 50-1, the noise contained in the timing signal T4, if any, is shaped by the buffer device 50-1. Therefore, it is possible to prevent noise from entering the data line.

Figure 26:
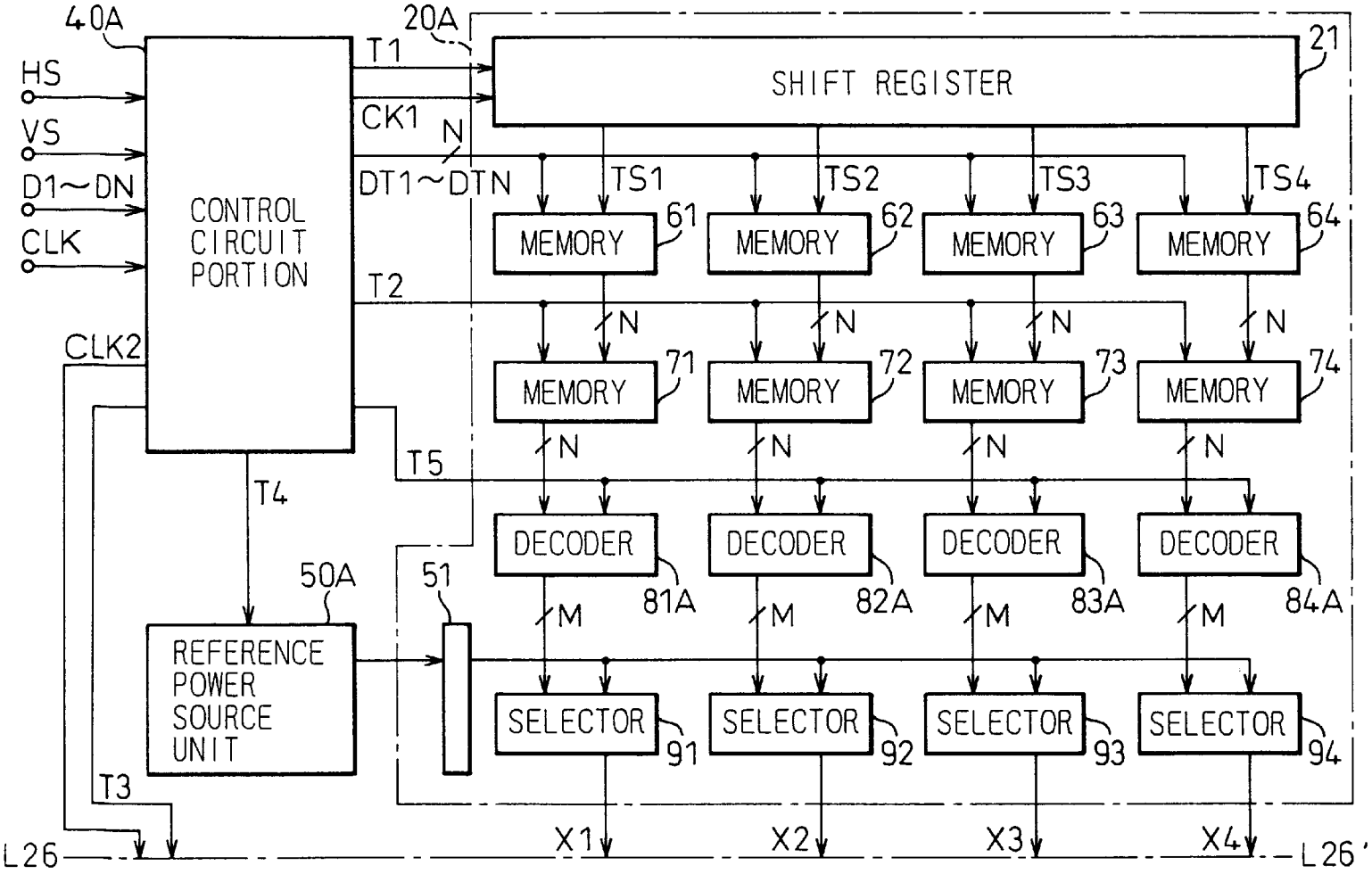
FIG. 26 is a circuit block diagram showing the construction of the first portion of the second preferred embodiment of the present invention.
Figure 27:
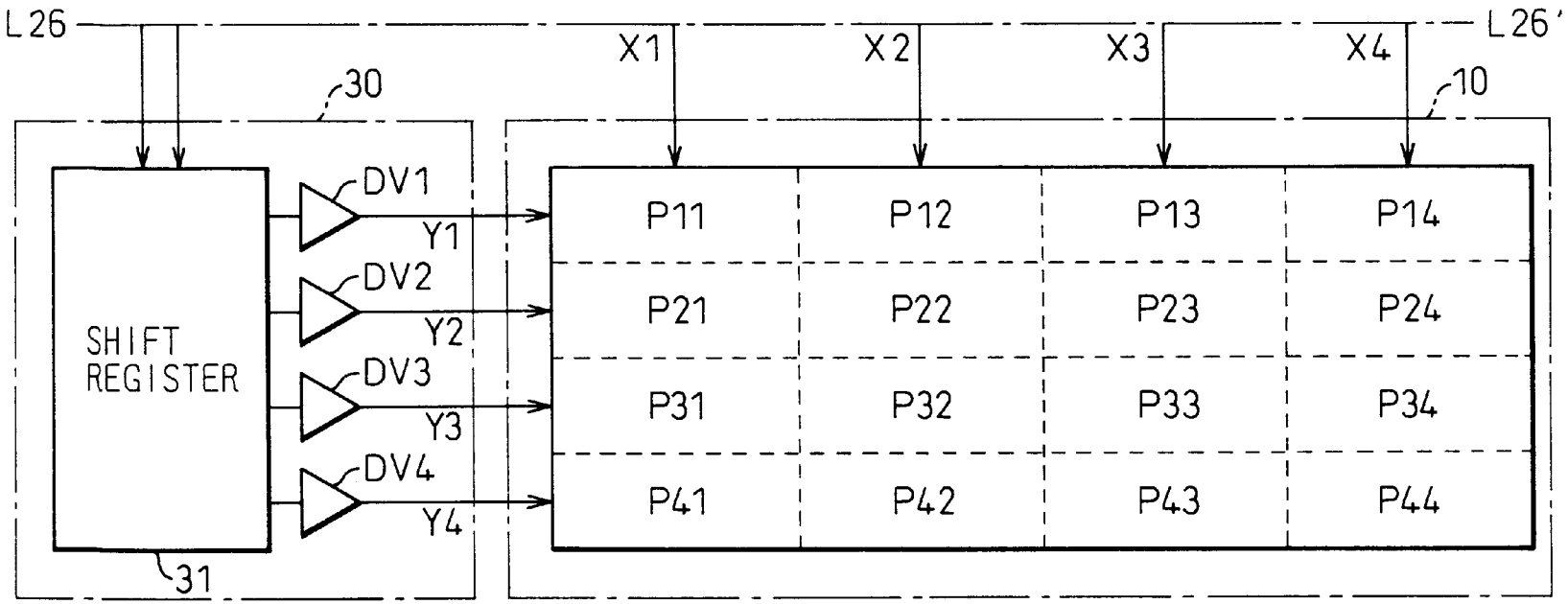
FIG. 27 is a circuit block diagram showing the construction of the second portion of the second preferred embodiment of the present invention.
Figure 28:
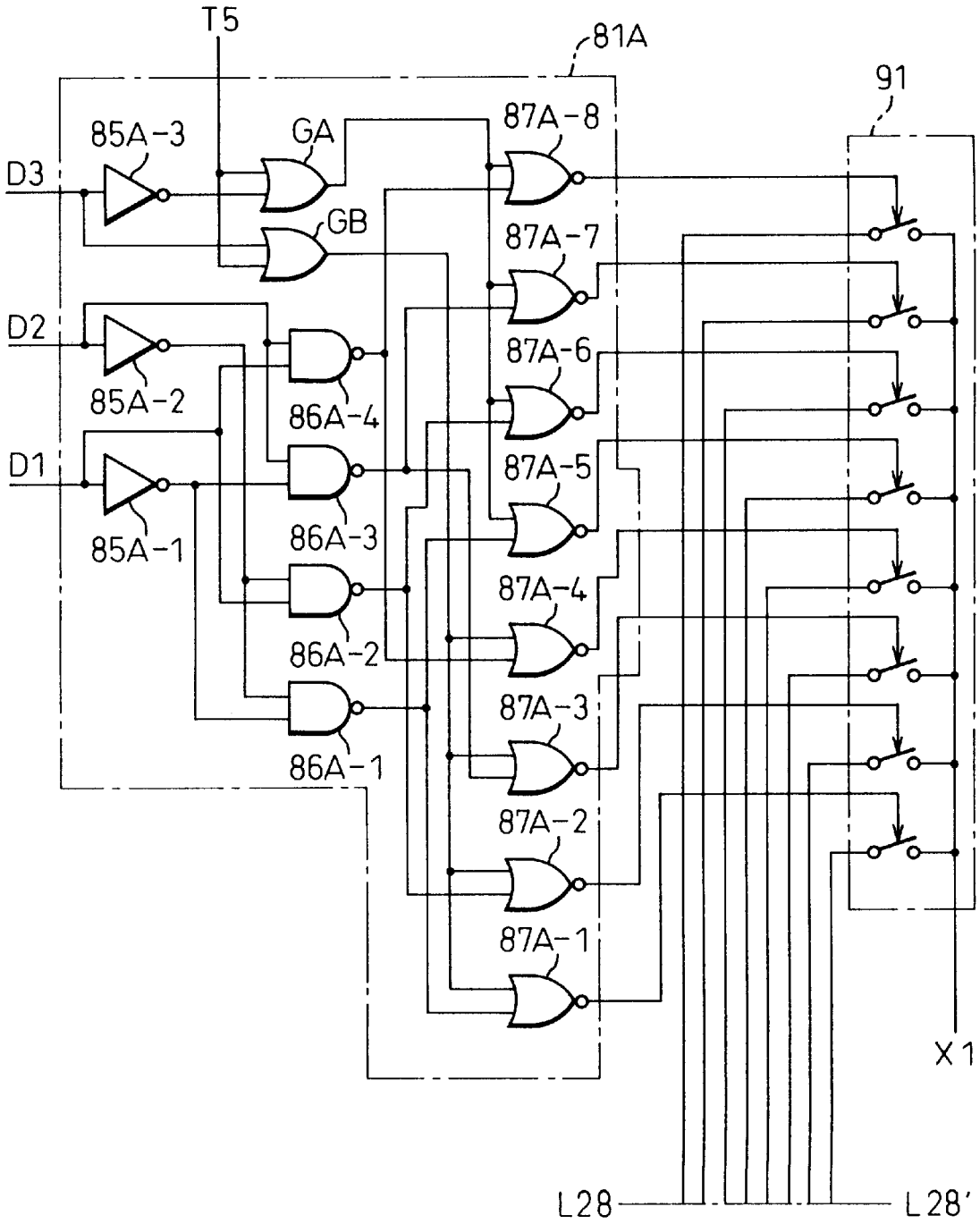
FIG. 28 is a circuit block diagram showing the first portion of the main part of the second preferred embodiment of the present invention.
Figure 29:
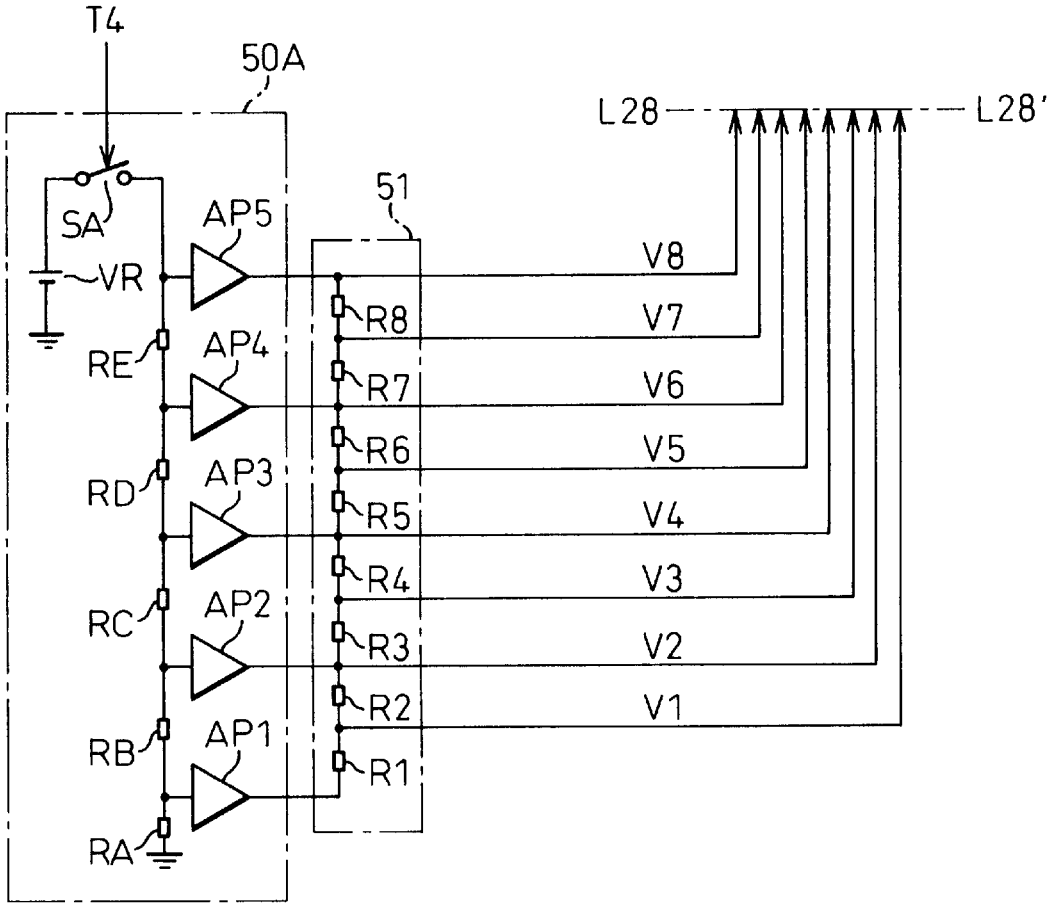
FIG. 29 is a circuit block diagram showing the second portion of the main part of the second preferred embodiment of the present invention.

FIGS. 26 and 27 are circuit block diagrams showing the constructions of the first and second portions of the second preferred embodiment of the present invention, respectively. FIGS. 28 and 29 are circuit block diagrams showing the principal portions of the first and second portions of the second preferred embodiment of the present invention, respectively. The second preferred embodiment of the present invention shown in FIGS. 26 and 27 (hereinafter called the "second embodiment") corresponds to an embodiment based on a modified embodiment of the first principle of the present invention as typically shown in FIG. 14.

The construction of the driving circuit of the liquid crystal display device shown in FIGS. 26 and 27 is substantially the same as the construction of the first embodiment shown in FIGS. 17 and 18, but is different from the latter in that the same function of the switch devices S1 to S4 comprising a series circuit of the analog switches shown in FIGS. 17 and 18 is provided to the decoders 81A to 84A.

In other words, each of a plurality of decoders 81A to 84A in this case has the function of controlling whether or not to supply the reference voltage from the selectors 91 to 94 to the second bus line on the basis of the timing signal T5 from the control circuit portion 40A. According to such a circuit construction, the circuit devices inside the IC data driver unit 20 can be reduced.

Constituent elements inside the data driver unit 20A other than the decoders 81A to 84A, the reference power source unit 50A and the scan driver unit 30 have the same constructions as those of the first embodiment shown in FIGS. 17 and 18. Therefore, a detailed explanation will be omitted.

FIGS. 28 and 29 show the decoder 81A, the selector 91, the reference power source unit 50A and the resistor dividing circuit portion 51 as the main parts of the second embodiment of the present invention. The second embodiment of the present invention is provided with a function of turning OFF all the switches inside the selectors 91 to 94 by the timing signal T5 from the control circuit portion 40A. More concretely, gate circuit devices (NOR devices) GA and GB are assembled afresh into the decoder 81A so as to stop the decoded output of the decoder 81A from the timing signal T5.

A more detailed explanation will be given. The decoder 81A includes three NOT devices 85A-1 to 85A-3 to which binary image data DI to D3 are inputted; four AND devices 86A-1 to 86A-4 for decoding the image data outputted from these NOT devices 85A-1 to 85A-3; NOR devices 87A-1 to 87A-8 connected to the output side of these AND devices 86A-1 to 86A-4, for generating a control signal for turning ON one of the eight analog switches of the selector 91; and gate circuit devices GA and GB for stopping the decoded output of the decoder 81A by the timing signal T5.

Further, the reference power source unit 50A includes one power source VR, five voltage dividing resistors RA to RE for dividing this power source VR and generating five kinds of first reference voltages, and buffer amplifiers (driver units) AP1 to AP5 for sending the reference voltages from these voltage dividing resistors RA to RE to the resistor dividing circuit portion 51, in the same way as in the first embodiment described above.

The resistor dividing circuit means 51, too, includes eight voltage dividing resistors R1 to R8 for dividing further the five kinds of the first reference voltages from the buffer amplifiers AP1 to AP5 and generating eight kinds of second reference voltages V1 to V8, in the same way as in the first embodiment described above.

The advantage of the driving circuit of this second embodiment in comparison with the first embodiment shown in FIGS. 18 and 19 is that since the analog switches S1 to S4 connected in series are eliminated, the influence of the ON resistance of the analog switches S1 to S4 given on the time constant for charging the data line does not exist.

Figure 30:
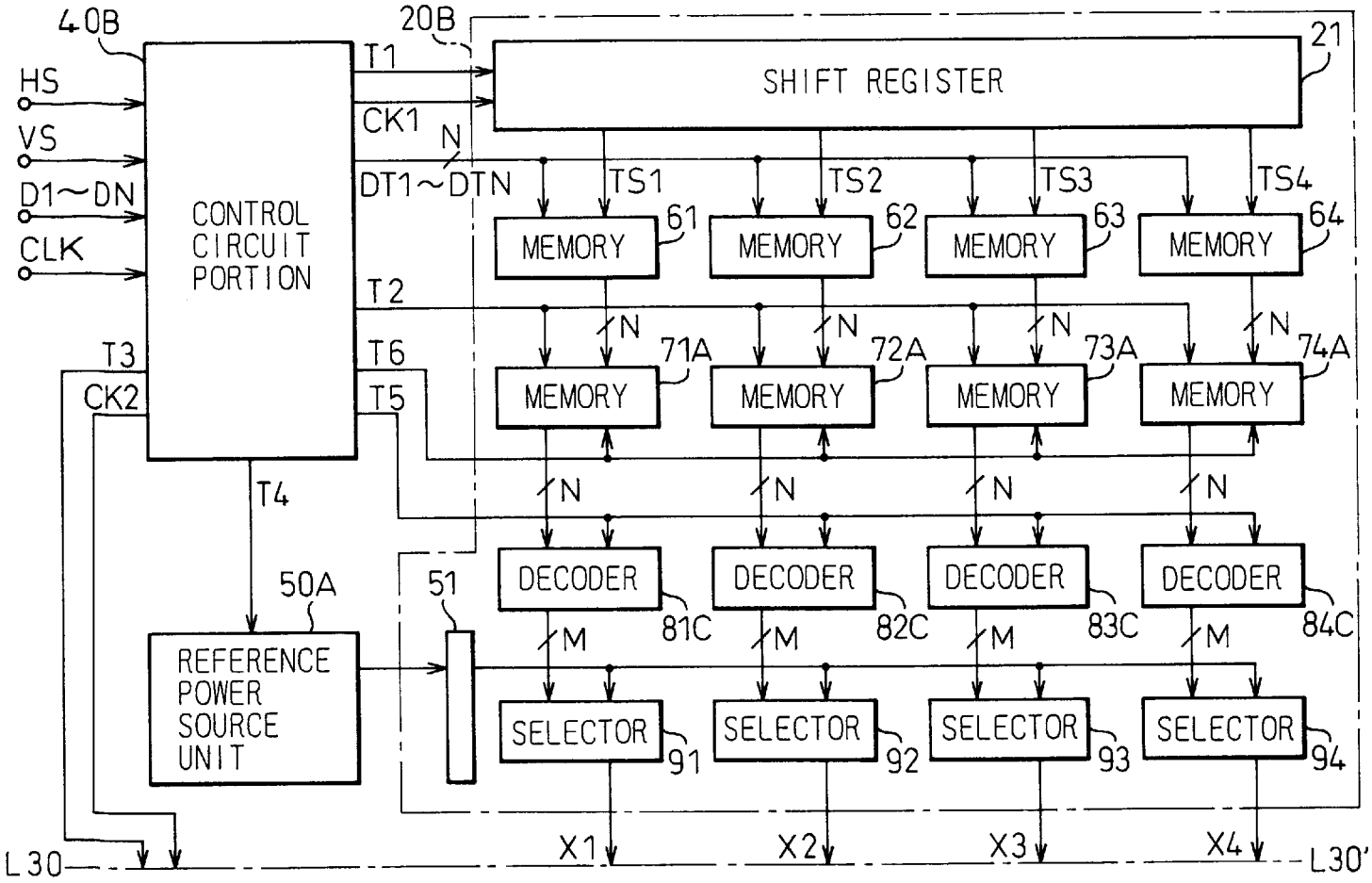
FIG. 30 is a circuit block diagram showing the construction of the first portion of the third preferred embodiment of the present invention.
Figure 31:
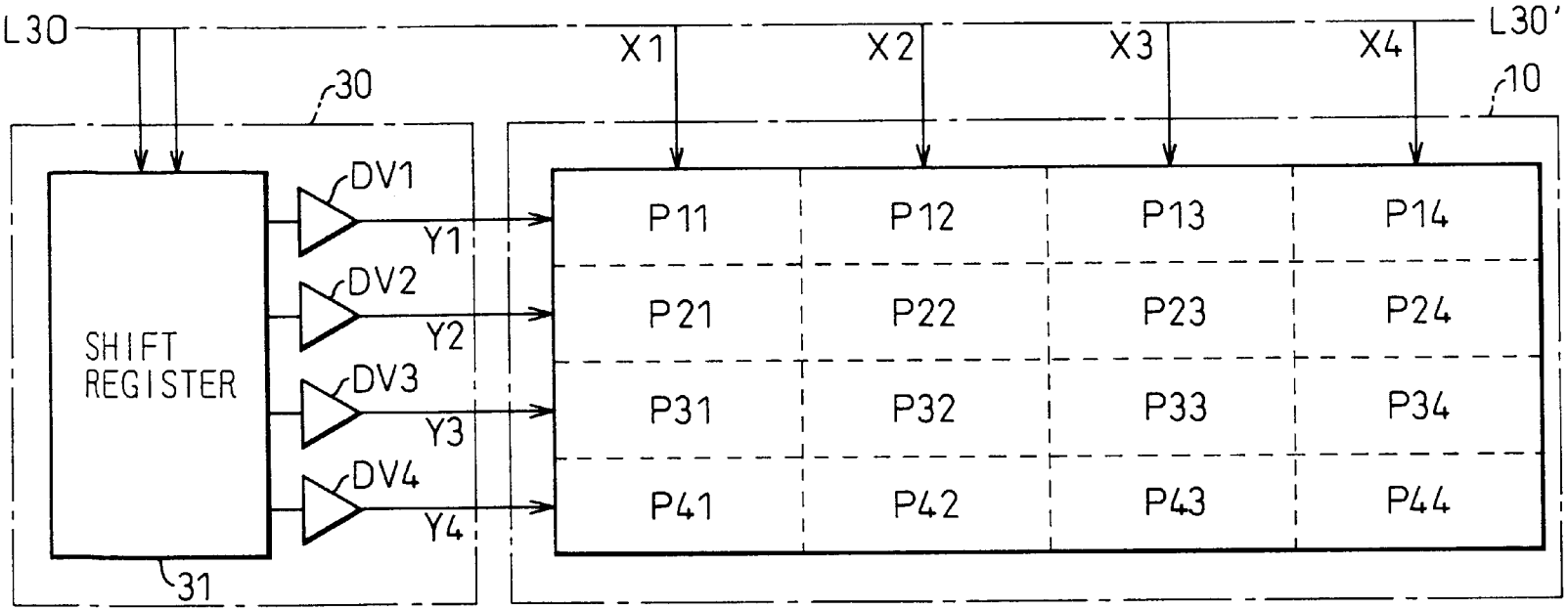
FIG. 31 is a circuit block diagram showing the construction of the third preferred embodiment of the present invention.
Figure 32:
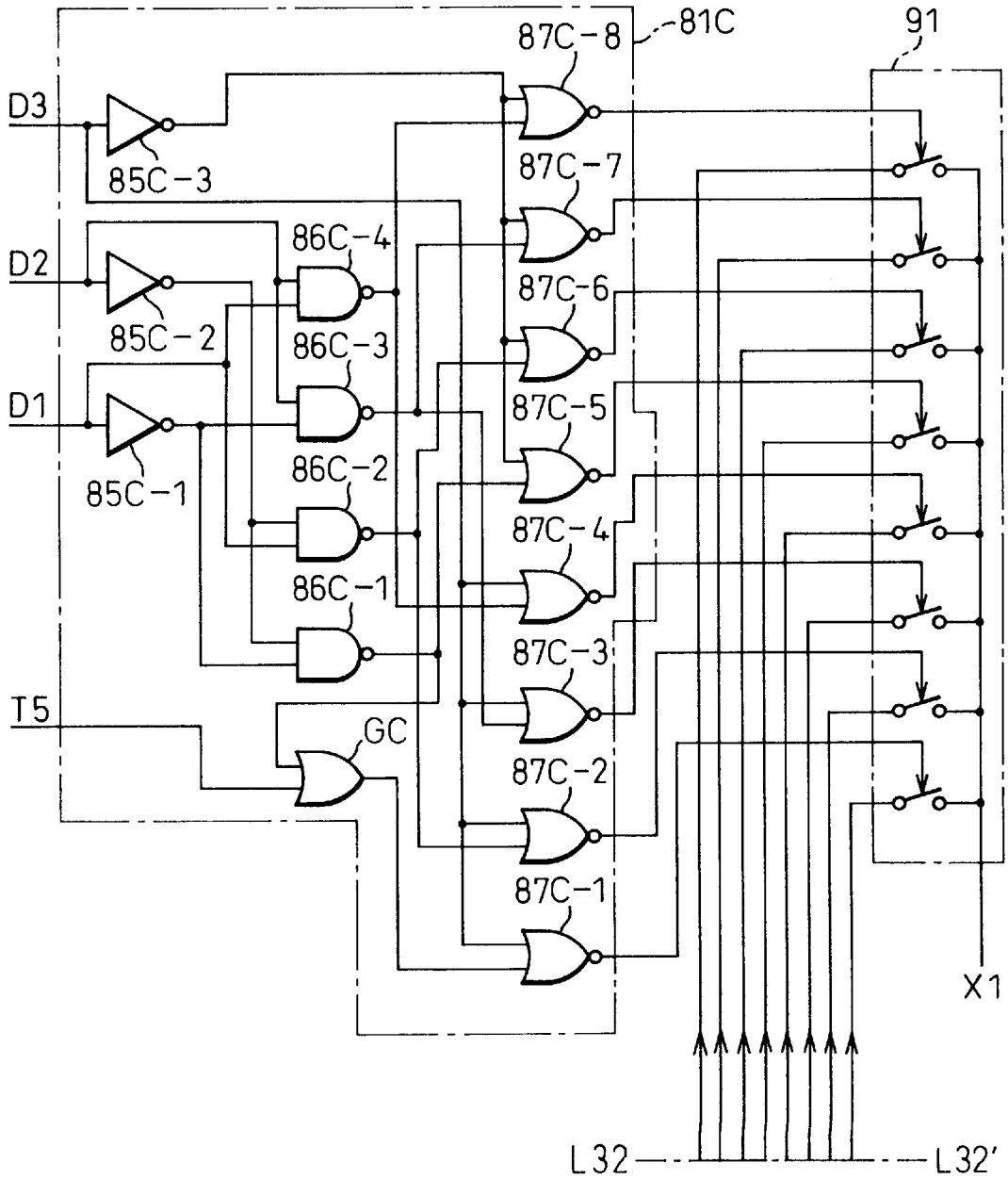
FIG. 32 is a circuit block diagram showing the first portion of the main part of the third preferred embodiment of the present invention.
Figure 33:
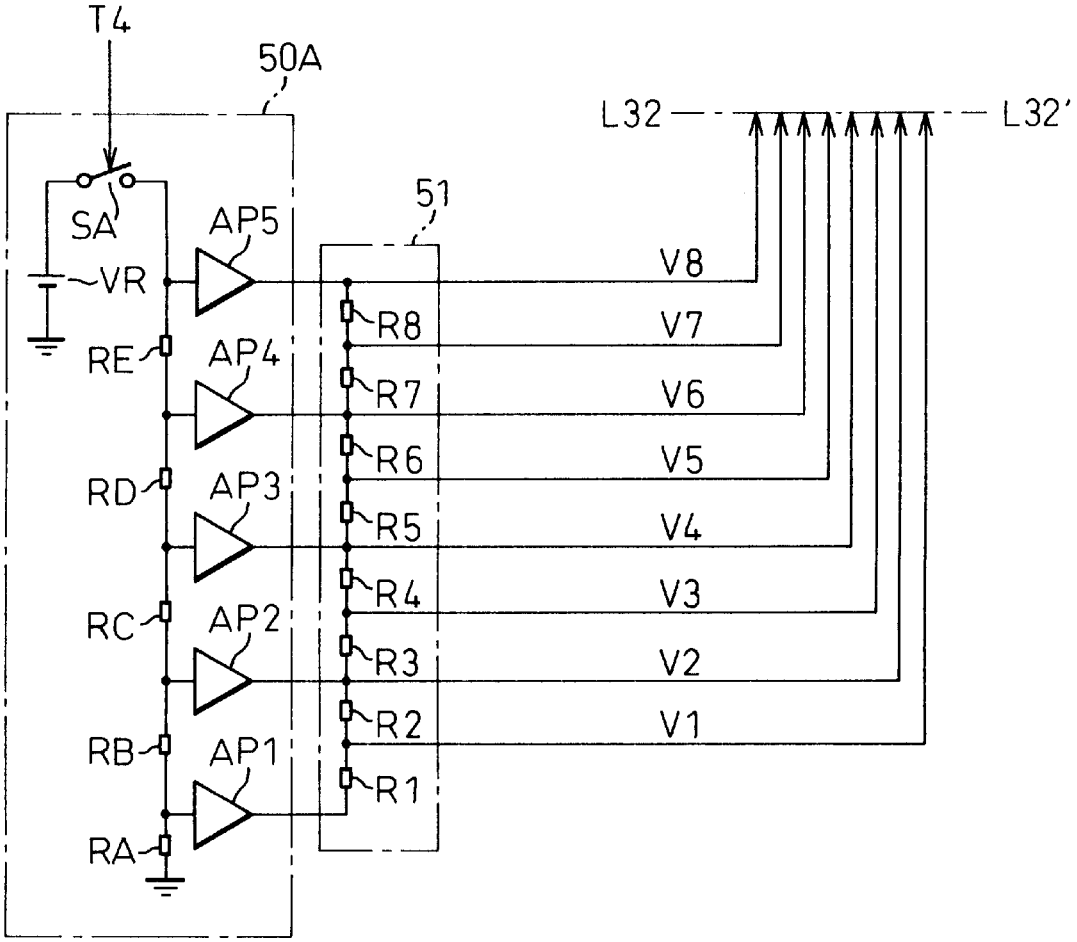
FIG. 33 is a circuit block diagram showing the second portion of the main part of the third preferred embodiment of the present invention.

FIGS. 30 and 31 are circuit block diagrams showing the constructions of the first portion and the second portion of the third preferred embodiment of the present invention, respectively; and FIGS. 32 and 33 are circuit block diagrams showing the first and second portions of the main part of the third preferred embodiment of the present invention, respectively.

The explanation will be given in further detail. Each of a plurality of decoders 81C to 84C described above has the function of controlling whether or not to supply the reference voltage from each selector 91 to 94 to the second bus line on the basis of the timing signal T5 from the control circuit portion 40B, and when the display data signal is outputted from each decoder 81C to 84C, the second memories 71A to 74A are reset on the basis of the control signal from the control circuit portion 40B.

In other words, the third preferred embodiment of the present invention (hereinafter referred to as the "third embodiment") accomplishes the reference voltage controlling function equivalent to that of the second embodiment shown in FIGS. 26 and 27 by a slightly different method. More concretely, the values of the second memories 71A to 74A are reset on the basis of the timing signal from the control circuit portion 40B, and the timing signal T5 is allowed to act on the decoder at the point of time when a decoder output, which turns ON a specific switch inside the selector unit, is generated, to cancel its selection.

FIGS. 32 and 33 show the decoder 81C, the selector 91, the reference power source unit 50A and the resistor dividing circuit portion 51 as the principal portions of the third embodiment of the present invention. The third embodiment of the present invention is provided with a function of turning OFF all the switches inside the selectors 91 to 94 by the timing signal T5 from the control circuit portion 40B. More concretely, the decoded output of the decoder 81C is stopped by the timing signal T5 by assembling afresh a gate circuit device (OR device) GC inside the decoder 81C.

The explanation will be given in further detail. The decoder 81C includes three NOT devices 85C-1 to 85C-3 to which the binary image data D1 to D3 are inputted; four AND devices 86C-1 to 86C-4 for decoding the image data outputted from these NOT devices 85C-1 to 85C-3; NOR devices 87C-1 to 87C-8 connected to the output side of these AND devices 86C-1 to 86C-4, for turning ON one of the eight analog switches of the selector 91; and a gate circuit device GC for stopping the decoded output of the decoder 81C by the timing signal T5 and resetting the second memories 71A to 74A by the timing signal (one of the control signals) T6.

The advantage of the driving circuit according to the third embodiment in comparison with the second embodiment shown in FIGS. 26 and 27 is that the construction of the decoder circuit comprising a plurality of decoders can be simplified. Instead of this, the second memories 71A to 74A for the decoders in the third embodiment of the present invention must have a reset function.

Figure 35:
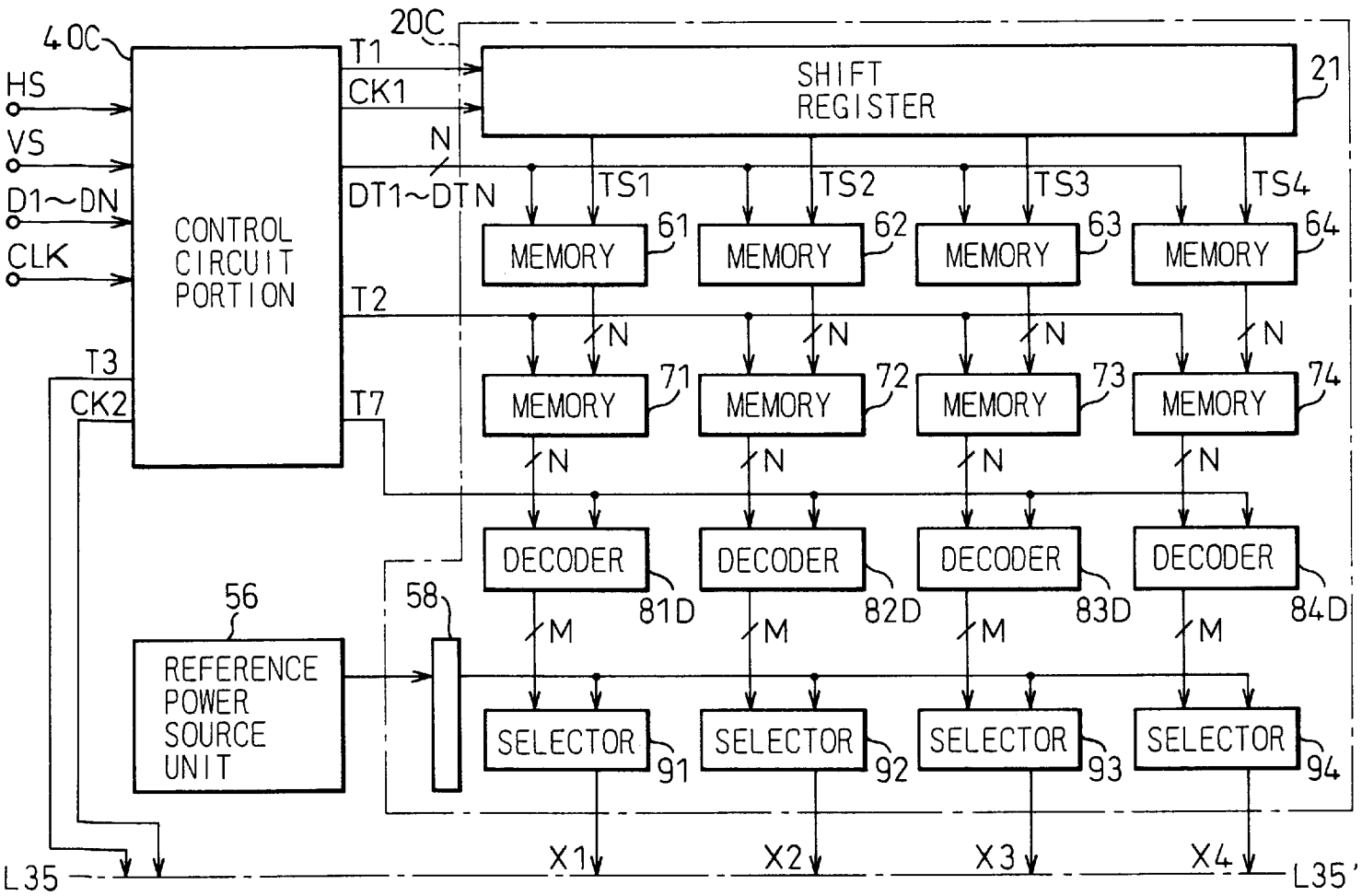
FIG. 35 is a circuit block diagram showing the construction of the first portion of the fourth preferred embodiment of the present invention.
Figure 36:
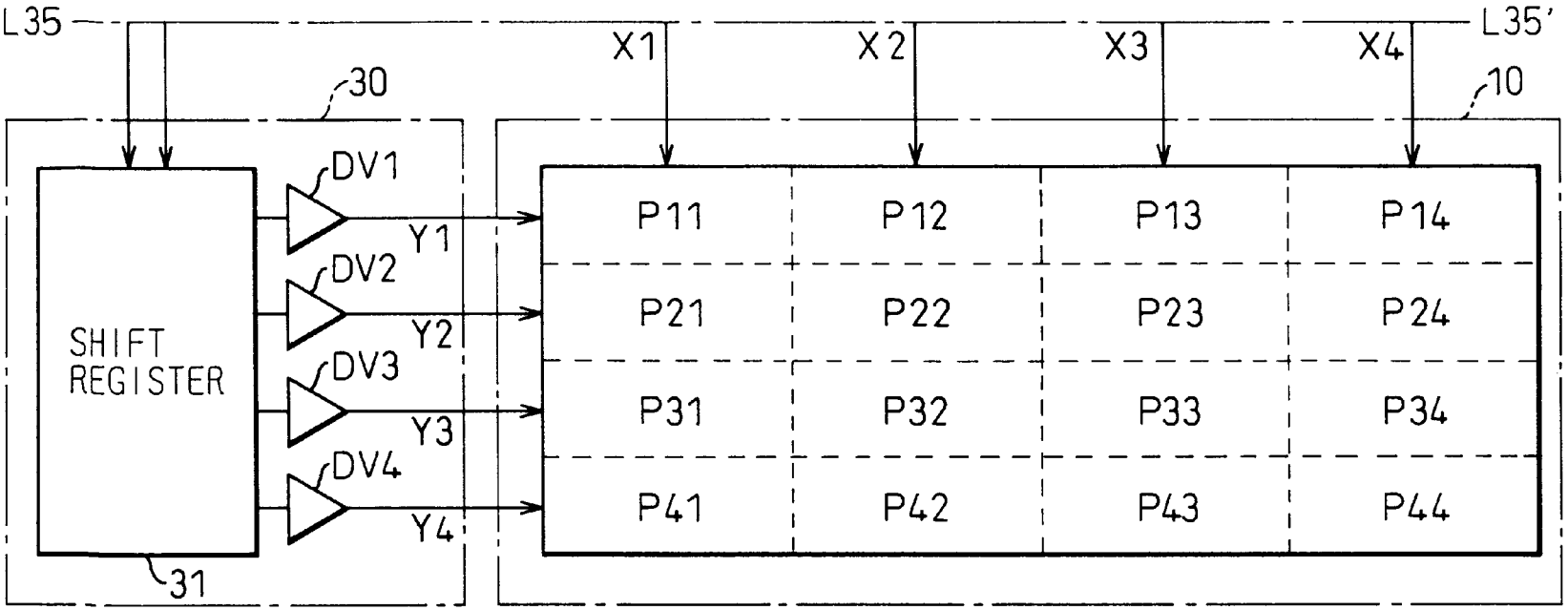
FIG. 36 is a circuit block diagram showing the construction of the second portion of the fourth preferred embodiment of the present invention.
Figure 37:
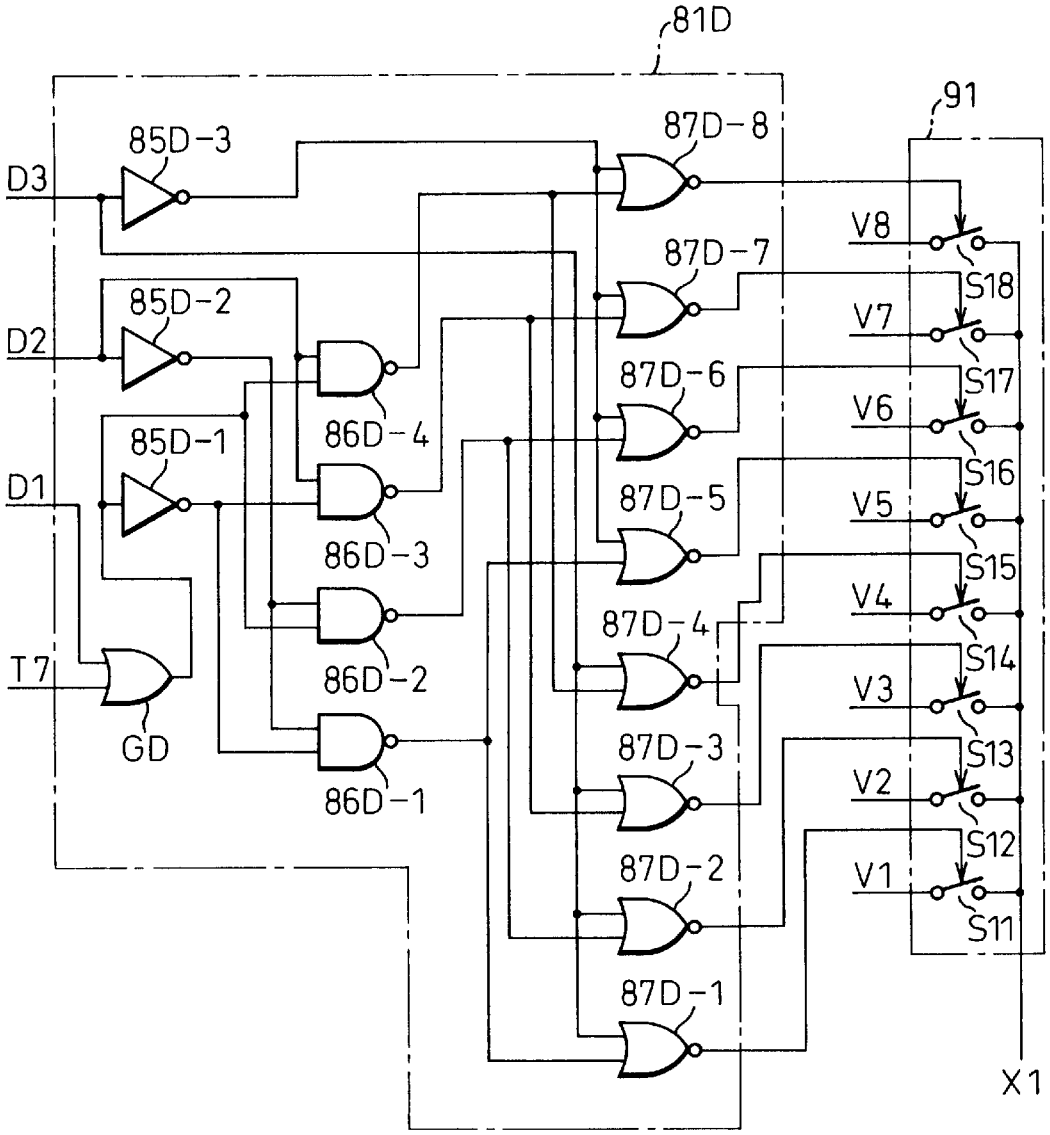
FIG. 37 is a circuit block diagram showing the first portion of the first example of the main part of the fourth preferred embodiment of the present invention.
Figure 38:
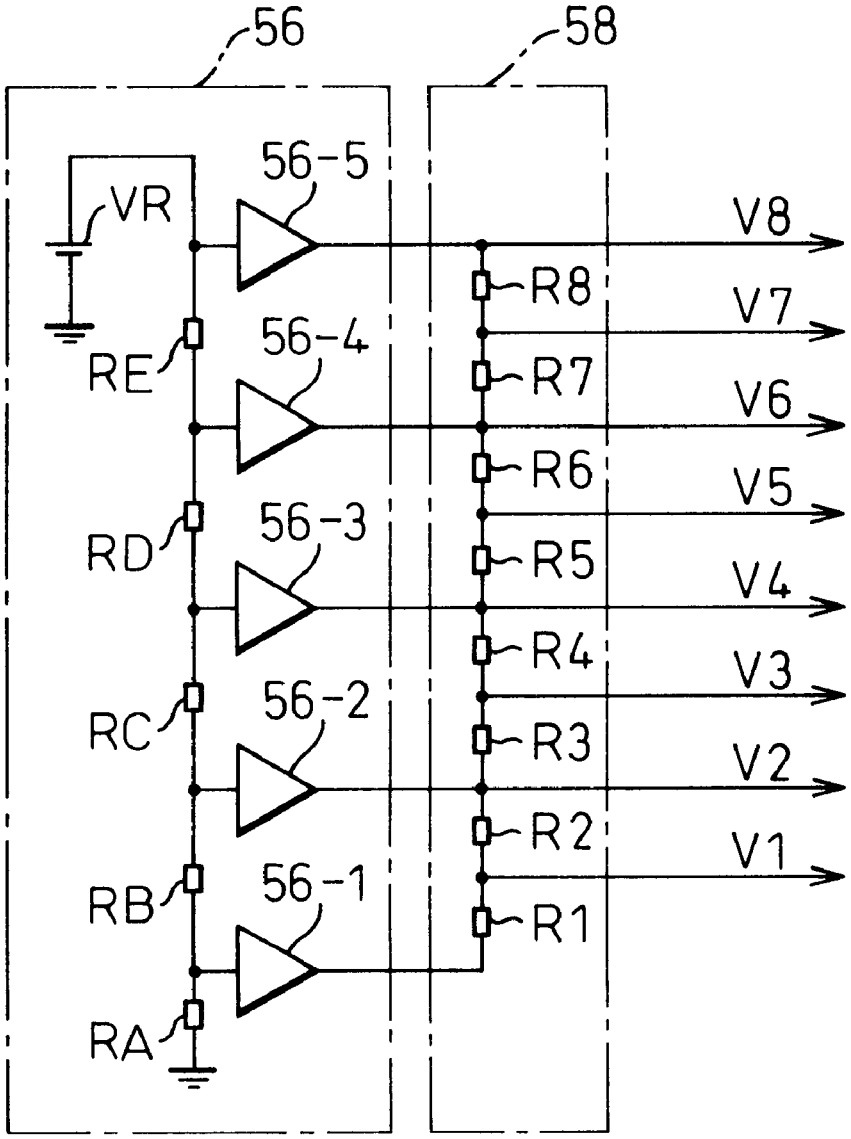
FIG. 38 is a circuit block diagram showing the second portion of the first example of the main part of the fourth preferred embodiment of the present invention.

FIGS. 35 and 36 are block circuit diagrams showing the construction of the first portion and the second portion of the fourth preferred embodiment of the present invention, respectively, and FIGS. 37 and 38 are circuit block diagrams showing the first and second portions of the first example of the main part of the fourth preferred embodiment of the present invention, respectively. The fourth preferred embodiment of the present invention (hereinafter referred to as the "fourth embodiment") shown in FIGS. 36 and 37 corresponds to the embodiment based on the second principle of the present invention as typified by the basic embodiment shown in FIG. 34.

In FIG. 35, a controlling circuit portion 40C for controlling the operations of all the driving circuits inclusive of the data driver unit 20C and the scan driver unit 30 on the basis of various control signals is shown disposed as the control circuit portion 4A of the basic embodiment shown in FIG. 34. The construction of this control circuit portion 40C is substantially the same as that of the control circuit portion 400 described in the paragraph of the Related Art (see FIG. 1).

The horizontal sync signal HS representing the scanning period in which the image data is displayed and the vertical sync signal VS for supplying the write voltage to the image data selected on the data line are inputted to this control circuit portion 40C. Further, symbols D1 to DN inputted to the control circuit portion 40C represent the binary image data, and symbol N represents the bit number for effecting gradation display. Symbol CLK inputted to the control circuit portion 40C represents the clock signal applied in synchronism with the image data. This clock signal sets the write timing of the image data D1 to DN.

In FIG. 35, further, a plurality of decoders 81D to 84D for converting the display data sent from the control circuit portion 40C to the display data signal corresponding to each of the data lines and supplying it to the selectors 91 to 94 on the basis of the timing signal T7 from the control circuit portion 40C, are disposed as the decoder unit 24 of the basic embodiment shown in FIG. 34, inside the data driver unit 20C. In the first period of the charging of the data bus line, the supply of the display data signal from the decoders 81D to 84D to the selectors 91 to 94 is restricted by the timing signal T7 from the control circuit portion 40C and in the second period, the control circuit portion 40C so operates as to permit the supply of the display data signals from the decoders 81D to 84D to the selector units 91 to 94.

In FIG. 35, further, the decoders 81D to 84D inside the data driver unit 20C have the same construction as that of the data driver unit 20 of the afore-mentioned first embodiment (see FIG. 17). The explanation will be given in further detail. The data driver unit 20C includes a shift register 21. In this shift register 21, the timing signals TS1 to TS4 for serially writing the display data are generated inside the memory unit comprising the first memories 61 to 64 when the start signal T1 representing the display start of the image data for each line and the clock CLK1 for advancing the register are delivered from the control circuit portion 40C for each line. Each of these first memories 61 to 64 comprises a memory having an N bit capacity, and N-bit image data DT1 to DTN of a parallel system are stored in the first memories 61 to 64, respectively. The memory unit comprising the second memories 71 to 74, too, comprises memories each having an N-bit memory capacity. In this construction, after the image data of the parallel system are written into the first memories 61 to 64, the data built up in the first memories 61 to 64 are written by the write control signal T2 before the data of the next scan bus line arrives.

The selectors 91 to 94 in FIG. 35 have the function of the selector unit 26 in the basic embodiment shown in FIG. 34. These selectors 91 to 94 are a kind of digital-to-analog conversion circuit for generating analog signals corresponding to the digital data stored in the second memories 71 to 74.

In FIG. 35, there is further disposed a reference power source unit 56 for generating a plurality of first reference voltages from an arbitrary power source (VR in the below-mentioned FIG. 38) by a plurality of voltage dividing resistors (RA to RE in the later-appearing FIG. 38) as the reference voltage generating circuit portion 52 and the buffer amplifier unit 53 in the basic embodiment shown in FIG. 34. A resistor dividing circuit portion 58 for finally generating a plurality of kinds of reference voltages by dividing the first reference voltages outputted from the reference power source unit 56 by a plurality of voltage dividing resistors (R1 to R8 in the below-mentioned FIG. 38) and sending them to the selectors 91 to 94, is disposed as the resistor dividing circuit portion 54 in the basic embodiment shown in FIG. 34.

The circuit including the shift register 21, the first memories 61 to 64, the second memories 71 to 74, the decoders 81D to 84D, the selectors 91 to 94 and the portion of the resistor dividing circuit means 58 is preferably integrated as the data driver unit 20C.

The scan driver unit 30 in FIG. 36 comprises a shift register 31 which starts its operation by the start signal T3 and advances by the clock CK2, and a plurality of driver units DV1 to DV4 which send the output signal of this shift register 31 to the scan bus lines Y1 to Y4, respectively. Since the scan driver unit 30 has substantially the same construction as that of the scan driver unit of the prior art shown in FIG. 2, its detailed explanation will be omitted.

FIGS. 37 and 38 show the decoder 81D, the selector 91, the reference power source unit 56 and the resistor dividing circuit portion 58 as the main part of the fourth embodiment of the present invention.

Since the fourth embodiment of the present invention can easily accomplish the construction based on the second principle of the present invention by merely disposing the gate circuit device GD which operates for the least significant bits (LSB) from the first memories 61 to 64 to the second memories 71 to 74 on the basis of the timing signal T7 from the control circuit 40C, it has high practical utility.

The decoder 81D (one of a plurality of decoders 81D to 84C) in FIG. 37 has the function of controlling whether or not to supply the reference voltage from one of a plurality of analog switches S11 to S18 to the data line on the basis of the timing signal T7 from the control circuit portion 40C.

The explanation will be given in further detail. The decoder 81D includes three NOT devices 85D-1 to 85D-3 to which binary image data D1 to D3 are inputted, four AND devices 86D-1 to 86D-4 which decode the image data outputted from these NOT devices 85D-1 to 85D-3, NOR devices 87D-1 to 87D-8 which are connected to the output side of these AND devices 86D-1 to 86D-4 and generate a control signal for turning ON one of the eight analog switches S11 to S18, and a gate circuit device GD for controlling the least significant bit from the first memories 61 to 64 to the second memories 71 to 74 by the timing signal T7.

This gate circuit device GD executes its logical operation, by inhibiting the output of the display data signal from the decoders 81D to 84D to the selectors 91 to 94 in the first period of the charging of the data line corresponding to the least significant bit, and permitting the output of the display data signal from the decoders 81D to 84D to the selector units 91 to 94 in the second period corresponding to any digits other than the least significant bit.

The reference power source unit 56 shown in FIG. 38 includes five voltage dividing resistors RA to RE for generating five kinds of first reference voltages from one power source VR, and five buffer amplifiers (driver units) 56-1 to 56-5 connected to the junctions of these voltage dividing resistors RA to RE, respectively. On the other hand, the resistor dividing circuit portion 58 includes eight voltage dividing resistors R1 to R8 for finally generating eight kinds of reference voltages V1 to V8 by dividing the output voltage from the five buffer amplifiers 56-1 to 56-5 and sending them to the selector 91.

Figure 39:
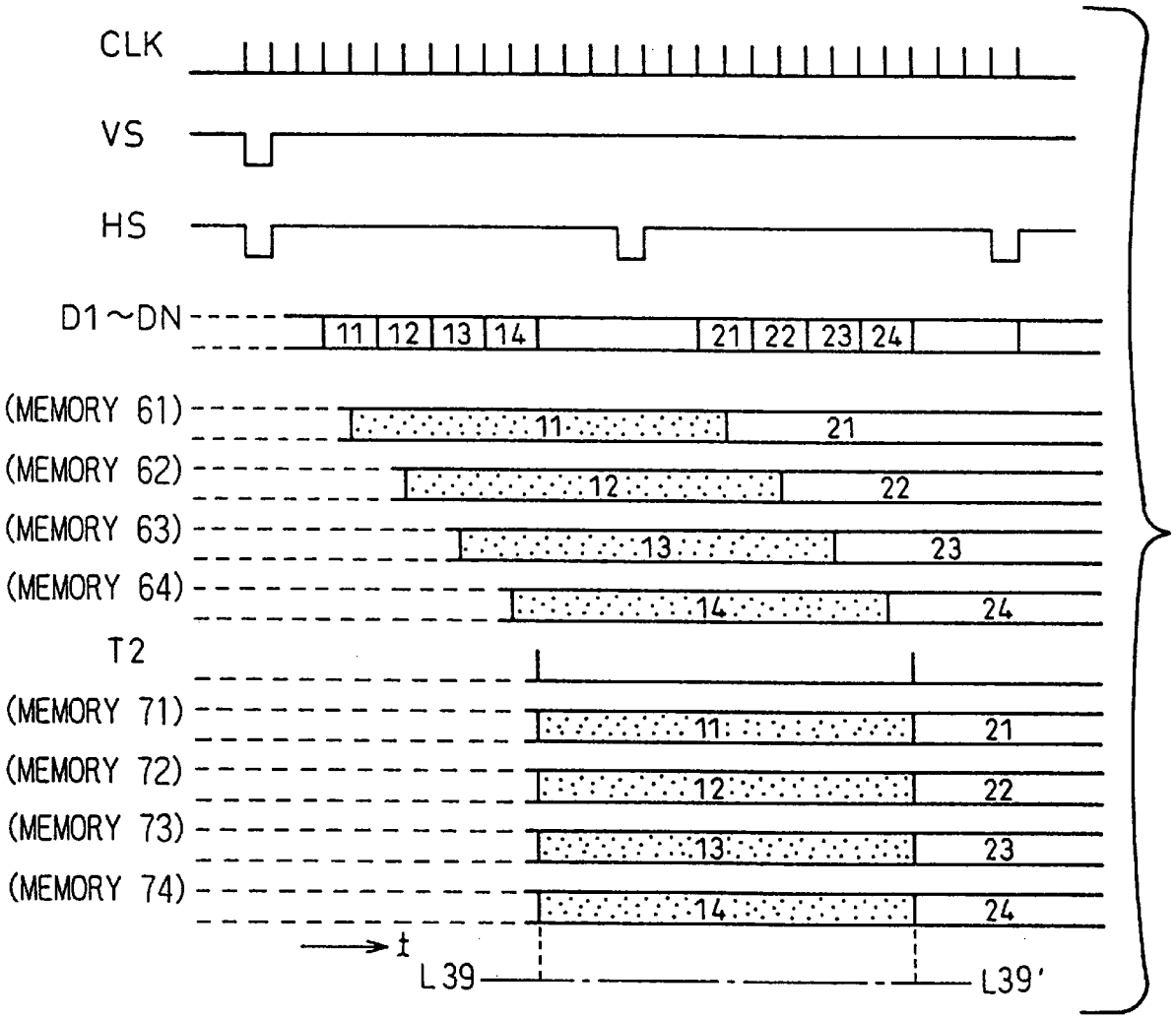
FIG. 39 is a timing shaft useful for explaining the former half portion of operations of the fourth preferred embodiment of the present invention.
Figure 40:
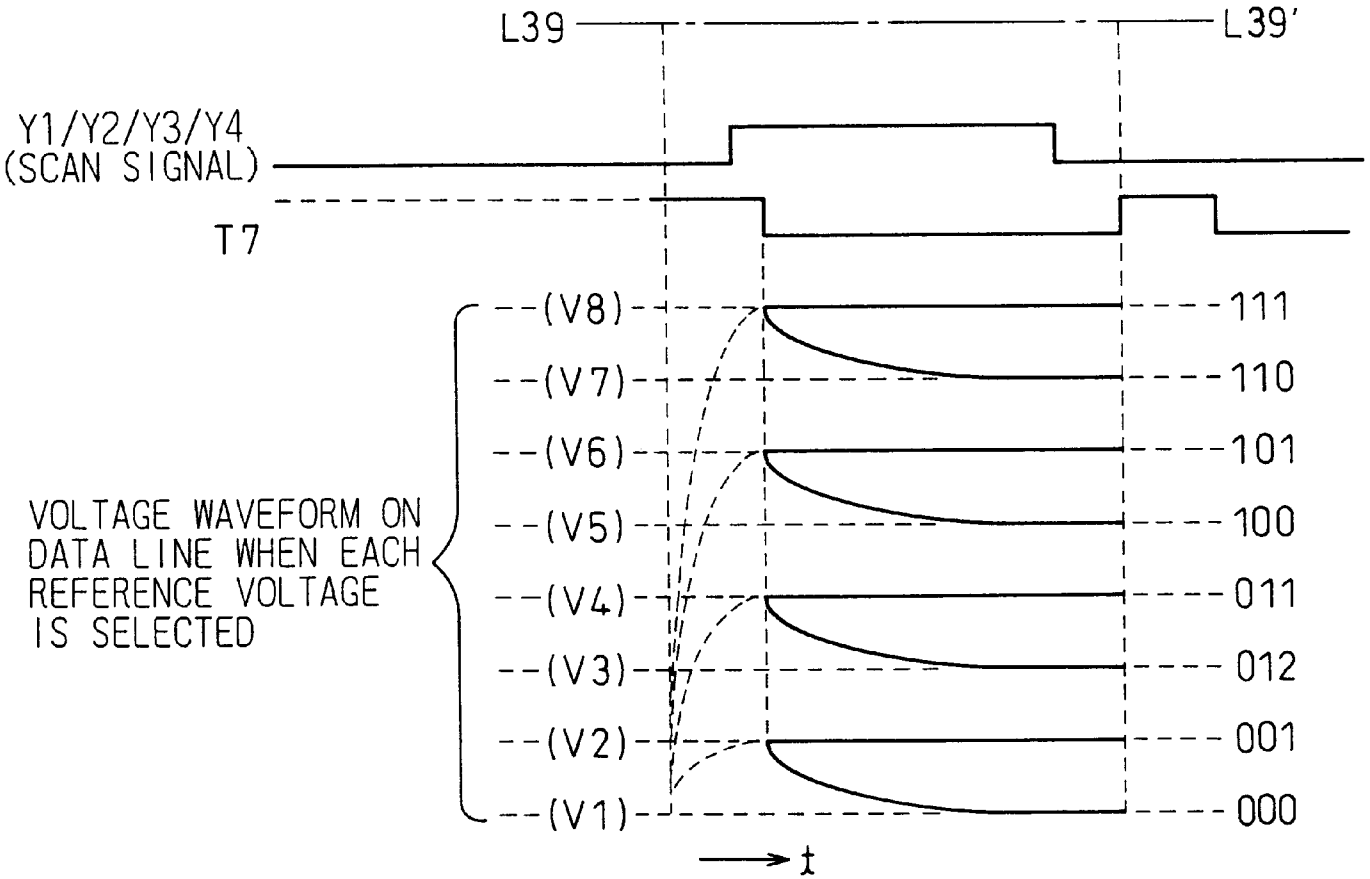
FIG. 40 is a timing chart useful for explaining the latter half portion of operations of the fourth preferred embodiment of the present invention.

FIGS. 39 and 40 are timing charts for explaining the former half portion and the latter half portion of the operation of the fourth embodiment of the present invention, respectively.

In the timing charts shown in FIGS. 39 and 40, the binary display data D1 to DN are first built up in the first memories 61 to 64 on the basis of the clock signal CLK and the start signal T1. Next, the display data read out from the first memories 61 to 64 are written into the second memories 71 to 71 on the basis of the write control signal T2.

Since the data line is charged by the output of the buffer amplifier inside the reference power source unit 56 while the timing signal T7 is "H", its charging speed is high. When the timing signal T7 thereafter falls to the "L" level, there are two cases, that is, the case in which the driving voltage (reference voltage V1 to V8) keeps its value and the case in which the charging is effected through the voltage dividing resistors, depending on the image data. Because the data line has already been charged to a voltage value near the final value, however, the charging can be carried out up to the final value of the data line within a predetermined time even when the values of the voltage dividing resistors are relatively large. Since the charging of the data line to the final value can be sufficiently carried out within a predetermined period even when the values of the dividing resistors are relatively large as described above, a lower power consumption can be eventually accomplished. Moreover, because the second principle of the present invention can be accomplished by merely adding a simple circuit such as the gate circuit device GD, this embodiment is practically advantageous.

As can be understood from FIGS. 39 and 40, the data line is charged by the output of the buffer amplifier while the timing signal T7 is "H", and its charging speed is high. When the timing signal T7 falls to the "L" level, there are two causes, that is, the case in which the driving voltage keeps it value and the case in which the charging is carried out through the voltage dividing resistors, in accordance with the image data. Because the data line has already been charged to a value near the final value, however, the charging of the data line to the final value can be carried out within a predetermined time even when the values of the voltage dividing resistors are relatively large. Because the charging of the data line to the final value is thus possible even when the values of the dividing resistors are relatively large in this way, a lower power consumption can be eventually accomplished. Moreover, since this can be accomplished by merely adding a simple circuit, this embodiment has a high practical advantage.

Figure 41:
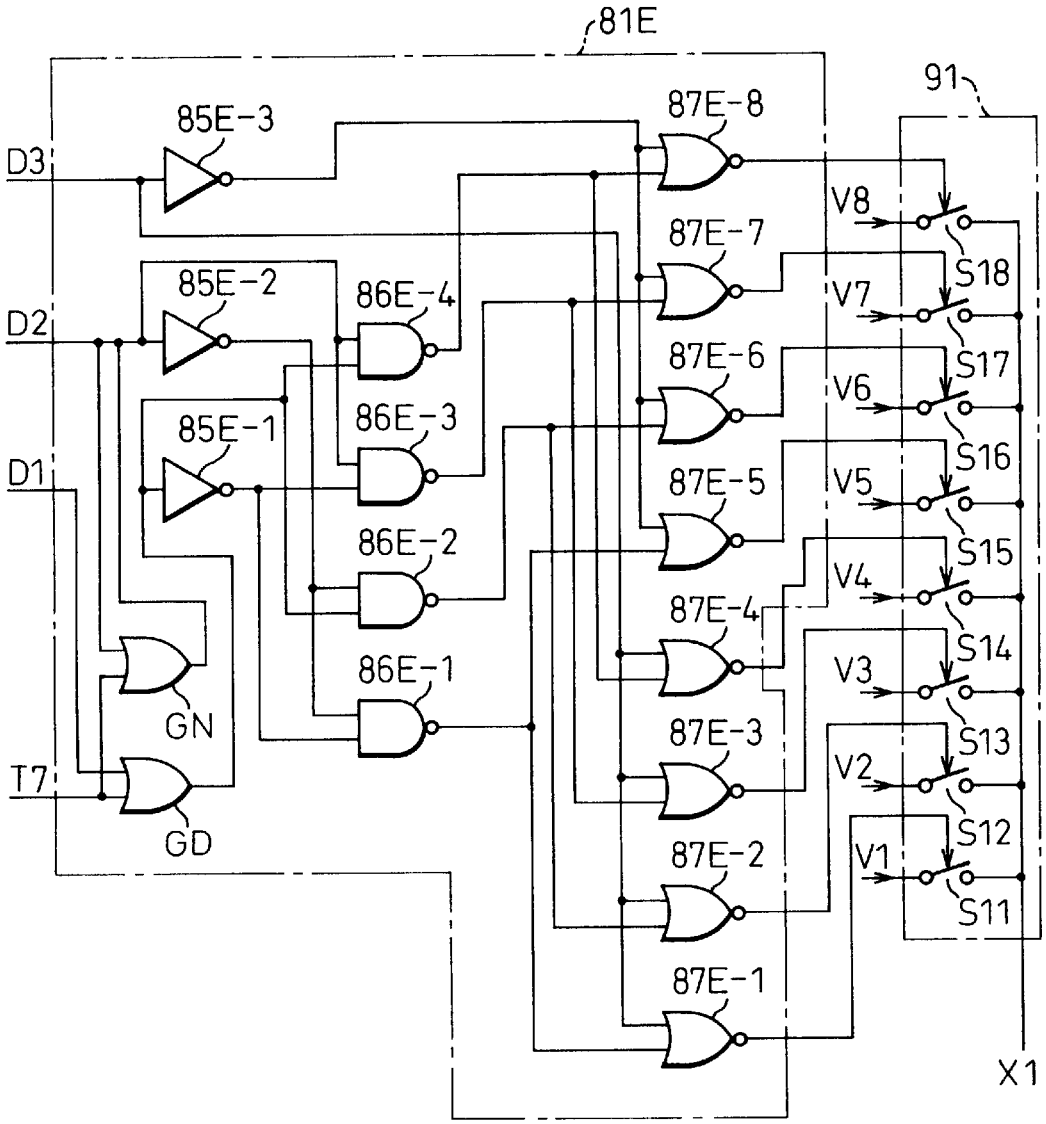
FIG. 41 is a circuit block diagram showing the first portion of the second example of the main part of the fourth embodiment of the present invention.
Figure 42:
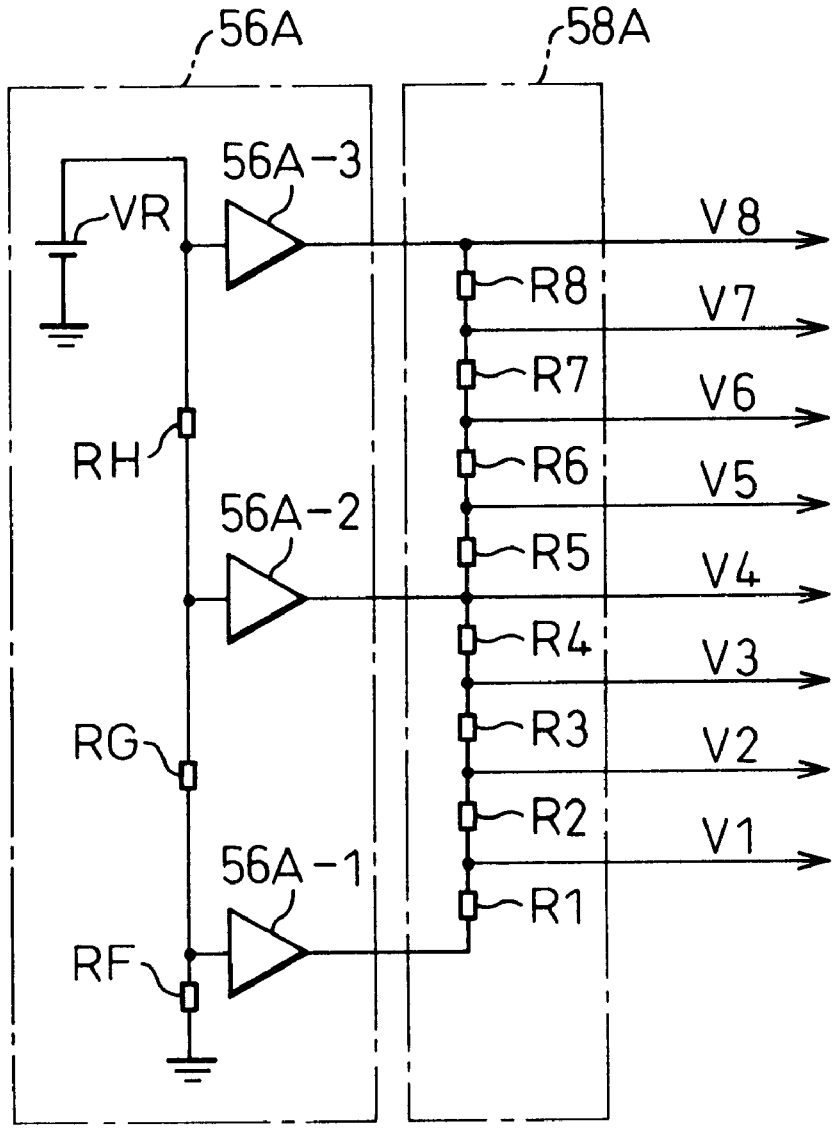
FIG. 42 is a circuit block diagram showing the second portion of the second example of the main part of the fourth embodiment of the present invention.

FIGS. 41 and 42 are circuit block diagrams showing the first portion and the second portion of the second example of the main part of the fourth embodiment of the present invention, respectively.

The decoder 81E (FIG. 41), the selector 91 (FIG. 41), the reference power source unit 56A (FIG. 42) and the resistance dividing circuit portion 58A (FIG. 42) are shown as the main part of the second example of the fourth embodiment shown in FIGS. 41 and 42. This second example represents the example in which the number of dividing resistors disposed between the buffer amplifiers inside the resistance dividing circuit portion 58A is changed from two to four. It can be understood in this case that the gate operation may be effected by the least significant bit (LSB) and the bit next to the least significant bit (NLSB).

The decoder 81E in FIG. 41 (one of a plurality of decoders 81E to 84E) has a function of controlling whether or not to supply the reference voltage from one of a plurality of analog switches S11 to S18 inside the selector 91 to the data line on the basis of the timing signal T7 from the control circuit portion 40C, in the same way as in the case of FIG. 37 already described.

The explanation will be given in further detail. The decoder 81E includes three NOT devices 85E-1 to 85E-3 to which the binary image data D1 to D3 are inputted; four AND devices 86E-1 to 86E-4 which decode the image data outputted from these NOT devices 85E-1 to 85E-3; NOR devices 87E-1 to 87E-8 which are connected to the output side of these AND devices 86E-1 to 86E-4 and generate the control signal for turning ON one of the eight analog switches S11 to S18 of the selector 91; a gate circuit device GD which controls the least significant bit from the first memories 61 to 64 to the second memories 71 to 74 by the timing signal T7; and a gate circuit device GN which controls the bit next to the least significant bit.

The gate circuit device GD inhibits the output of the display data signal from the decoders 81E to 84E to the selectors 91 to 94 in the first period of charging of the data line corresponding to the least significant bit. Further, when the charging period of the data line corresponding to the least significant bit is not sufficient, the charging period of the data line corresponding to the bit of the next digit of the least significant bit is set, and the output of the display data signal from the decoders 81E to 84E to the selectors 91 to 94 is kept inhibited. In the second period corresponding to any digits other than the bits described above, the logical operation is executed by permitting the output of the display data signal from the decoders 81E to 84E to the selector units 91 to 94.

The reference power source unit 56A in FIG. 42 includes three voltage dividing resistors RF to RH for generating three kinds of first reference voltages from one power source VR, and three buffer amplifiers 56A-1 to 56A-3 connected to the junctions of these voltage dividing resistors RF to RH, respectively. On the other hand, the resistor dividing circuit portion 58A includes eight voltage dividing resistors R1 to R8 for dividing the output voltage from the three buffer amplifiers 56A-1 to 56A-3 to finally generate eight kinds of reference voltages V1 to V8 and to send them to the selector 91.

Figure 44:
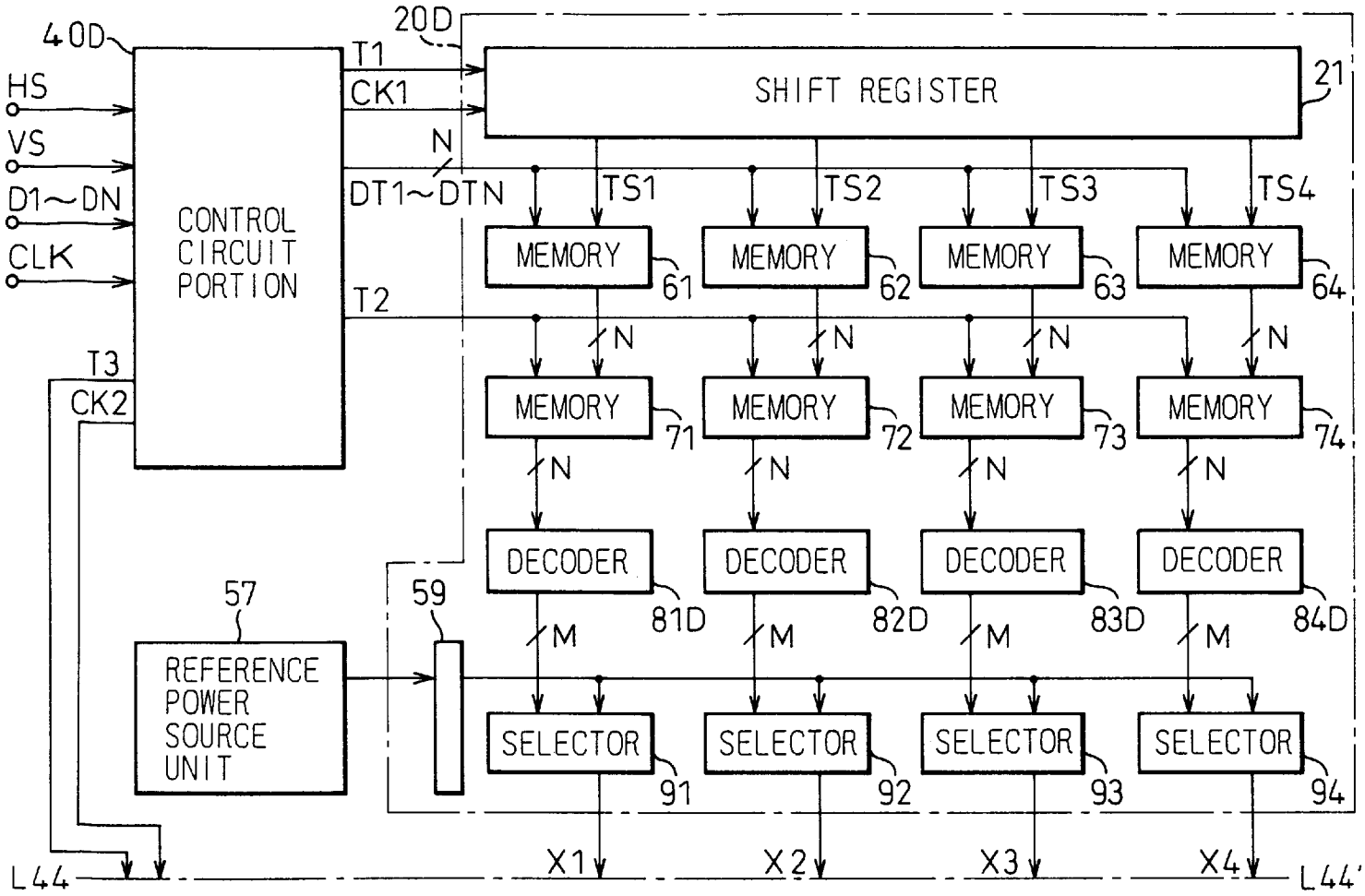
FIG. 44 is a circuit block diagram showing the construction of the first portion of the fifth preferred embodiment of the present invention.
Figure 45:
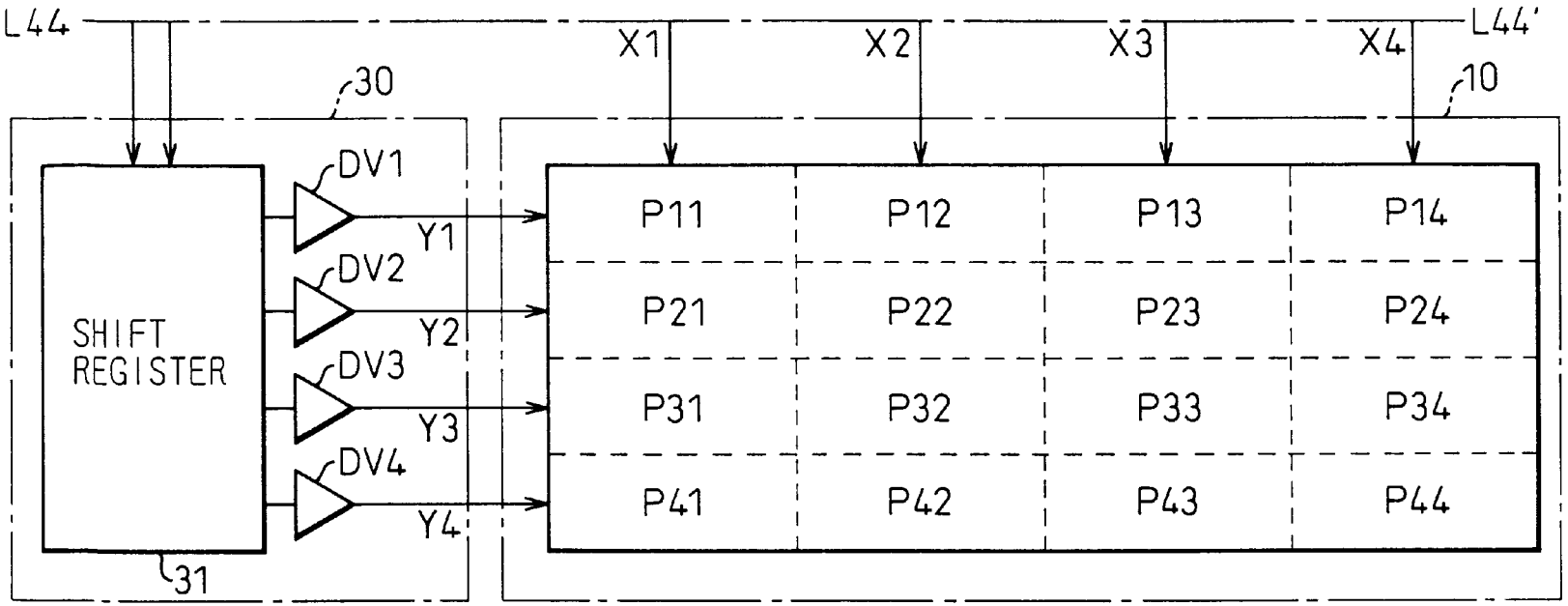
FIG. 45 is a circuit block diagram showing the construction of the second portion of the fifth preferred embodiment of the present invention.

FIGS. 44 and 45 are circuit block diagrams showing the construction of the first portion and the second portion of the fifth preferred embodiment of the present invention, respectively. The fifth preferred embodiment of the present invention (hereinafter referred to as the "fifth embodiment") shown in FIGS. 35 and 36 corresponds to an embodiment based on the second principle of the present invention as typified by the basic embodiment shown in FIG. 43.

In FIG. 44, a control circuit portion 40D for controlling the operations of all the driving circuits inclusive of the data driver unit 20D and the scan driver units 30 on the basis of various control signals is shown disposed as the control circuit portion 4B in the basic embodiment based on the third principle shown in FIG. 43. The construction of this control circuit portion 40D is substantially the same as that of the control circuit portion (FIG. 1) explained in the paragraph of the Related Art.

A horizontal sync signal HS representing the scanning cycle in which the image data are displayed and a vertical sync signal VS for supplying the write voltage to the image data selected on the data line, are inputted to this control circuit portion 40D. Symbols D1 to DN inputted to the control circuit portion represents the binary image data, and symbol N represents the bit number for effecting gradation display. Further, CLK inputted to the control circuit portion 40D represents the clock signal given in synchronism with the image data. This clock signal sets the timing for writing the image data D1 to DN.

In FIG. 44, further, a plurality of decoders 81E to 84E for converting the display data sent from the control circuit portion 40D to a display data signal corresponding to each of the data lines and supplying it to each selector 91 to 94 is disposed, as the decoder unit 25 in the basic embodiment shown in FIG. 43, inside the data driver unit 20D.

In FIG. 44, further, the circuit portion of the decoders 81E to 84D inside the data driver unit 20D has the same construction as that of the data driver unit 20 of the above-mentioned first embodiment (FIG. 17). More concretely, the data driver unit 20D includes the shift register 21. The shift register 21 generates the timing signals TS1 to TS4 for serially writing the display data into the memory unit comprising the first memories 61 to 64 when the start signal T1 representing the display start of the image data for each line and the clock CK1 for advancing the register are sent from the control circuit portion 40C for each line. Each of these first memories 61 to 64 comprises a memory having an N-bit capacity, and the image data DT1 to DTN having an N-bit parallel system are stored in the first memories 61 to 64, respectively. The memory unit comprising the second memories 71 to 74, too, comprises memories each having an N-bit memory capacity. In this construction, after the image data of the parallel system are written into the first memories 61 to 64, the data stored in these first memories 61 to 64 are written by the write control signal T2 before the data of the next scan bus line arrives.

Further, each of the selectors 91 to 94 in FIG. 44 has the function of the selector unit 27 of the basic embodiment shown in FIG. 43. These selectors 91 to 94 are a kind of digital-to-analog conversion circuit for generating analog signals corresponding to the digital data stored in the second memories 71 to 74.

In FIG. 44, further, there is shown disposed a reference power source unit 57 which generates a plurality of first reference voltages from an arbitrary power source by a plurality of voltage dividing resistors. In FIG. 44, there is further disposed resistor dividing circuit portion 59 for generating finally a plurality of kinds of reference voltages by dividing the first reference voltage outputted from the reference power source unit by a plurality of voltage dividing resistors and sending them to the selectors 91 to 94.

This resistor dividing circuit means 59 further includes buffer circuit unit 59P comprising a plurality of buffer amplifiers 59-1 to 59-2 (FIG. 43) disposed between the junctions of a plurality of voltage dividing resistors and the selector unit 27. In this case, the period in which the second reference voltage is applied to the second bus line is divided into two periods. In the first period, the output voltages passed through a plurality of buffer amplifiers inside the buffer circuit unit 59P are supplied to the second bus line, and in the second period, the control circuit portion 40D operates so as to supply the second reference voltage corresponding to the driving voltage for displaying the image data to the second bus line.

The overall circuit including the portions of the shift register 21, the first memories 61 to 64, the second memories 71 to 74, the decoders 81E to 84E, the selectors 91 to 94 and the resistor dividing circuit means 59 is preferably integrated as the data driver unit 20D.

The scan driver unit 30 in FIG. 45 comprises the shift register 31 which starts its operation by the start signal T3 and advances by the clock CK2, and a plurality of driver units DV1 to DV4 for sending the output signal of this shift register 31 to the scan bus lines Y1 to Y4, respectively. Since this scan driver unit 30 has the same construction as that of the scan driver of the prior art shown in FIG. 2, a detailed explanation will be omitted.

According to the fifth embodiment described above, the buffer amplifiers having a low output resistance are interposed between the junctions of a plurality of voltage dividing resistors and the selector units, and in this way, the values of the dividing resistors can be increased. Therefore, the object of the present invention, that is, realizing a lower power consumption in the overall circuit, can be easily accomplished.

It should be noted, however, that in the fifth embodiment described above, only the power source of the reference voltage given from the reference power source unit 57 or the power source for operating the logical circuit devices inside the data driver is available as the power source that can be utilized as the buffer amplifier. Further, the voltage of such a power source is generally 5V, whereas the voltage the buffer amplifier can output is as high as about 1.5 to about 3.5V. It is to be noted, therefore, that disposition of the buffer amplifiers for all the voltage dividing resistors is practically difficult.

Figure 46:
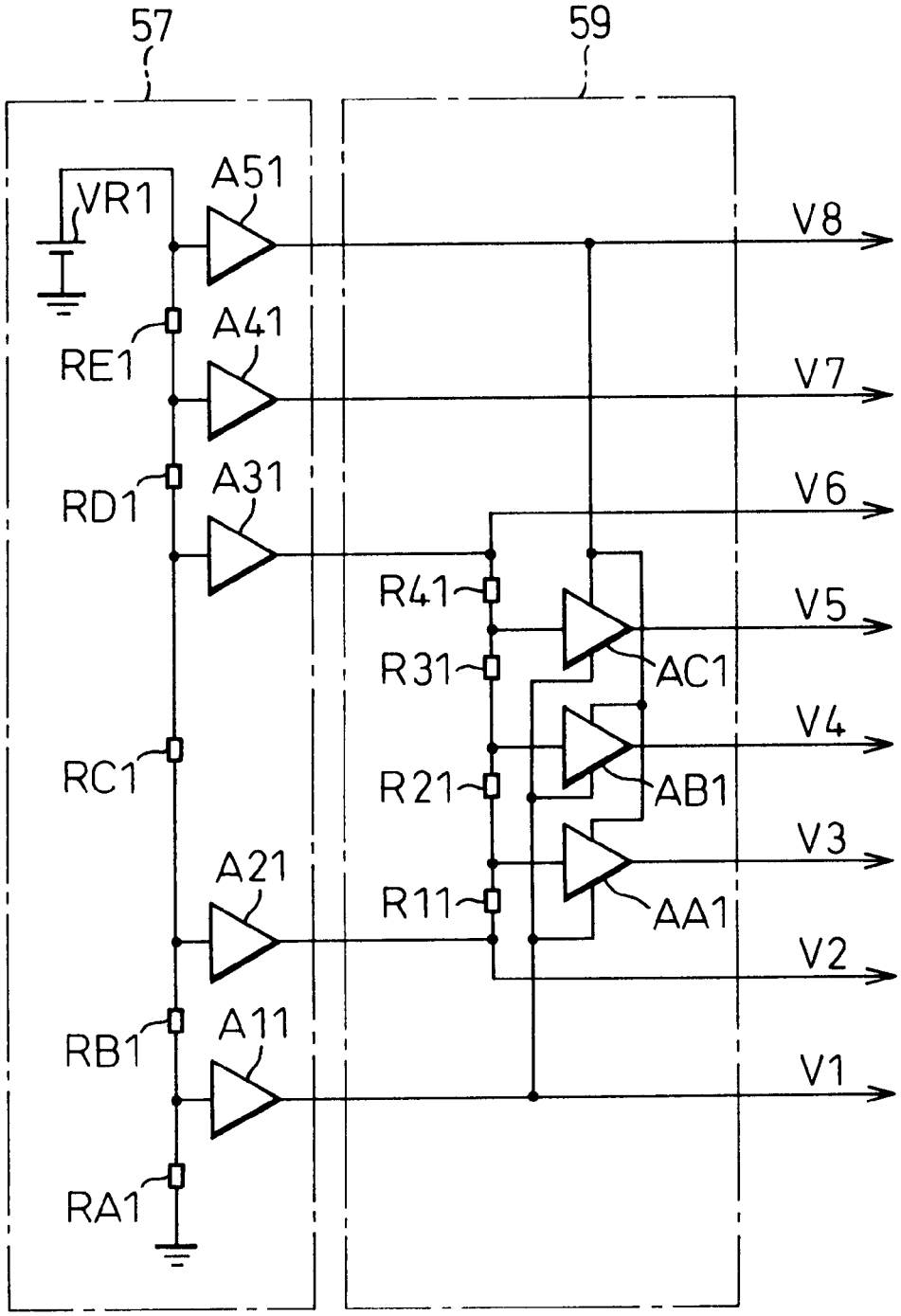
FIG. 46 is a circuit block diagram showing the first portion of the first example of the main part of the fifth preferred embodiment of the present invention.

FIG. 46 is a circuit block diagram showing the first example of the principal portions of the fifth embodiment of the present invention. Here, the reference power source unit 57 and the resistor dividing circuit portion 59 are shown as the first example of the principal portions of the fifth embodiment. In this case, the power source for a plurality of buffer amplifiers AA1 to AC1 interposed between the junctions of a plurality of dividing resistors R11 to R41 inside the resistor dividing circuit portion 59 and the selector units 27 is taken from the reference power source unit 57.

In FIG. 46, the reference power source unit 57 includes a plurality of voltage dividing resistors RA1 to RE1 for generating a plurality of first reference voltages from one power source VR1 and a plurality of buffer amplifiers A11 to A51 for sending the first reference voltages obtained from these voltage dividing resistors RA1 to RE1 to the resistor dividing circuit portion 59 or sending directly to the selector unit 27.

In FIG. 46, further, the resistor dividing circuit portion 59 has functions of finally generating a plurality of kinds of reference voltages V2 to V5 by dividing the first reference voltages outputted from the reference power source unit 57 by the voltage dividing resistors R11 to R41 and sending them to the selectors 91 to 94 through the buffer amplifiers AA1 to AC1. By the way, the reference voltages V1, V2 and V6 to V8 are sent from the buffer amplifiers A11 to A51 inside the reference power source unit 57 to the selectors 91 to 94 so as to reduce the load of the power source to be supplied from the reference power source unit 57 to the buffer amplifiers AA1 to AC1 inside the resistor dividing circuit portion 59.

Figure 47:
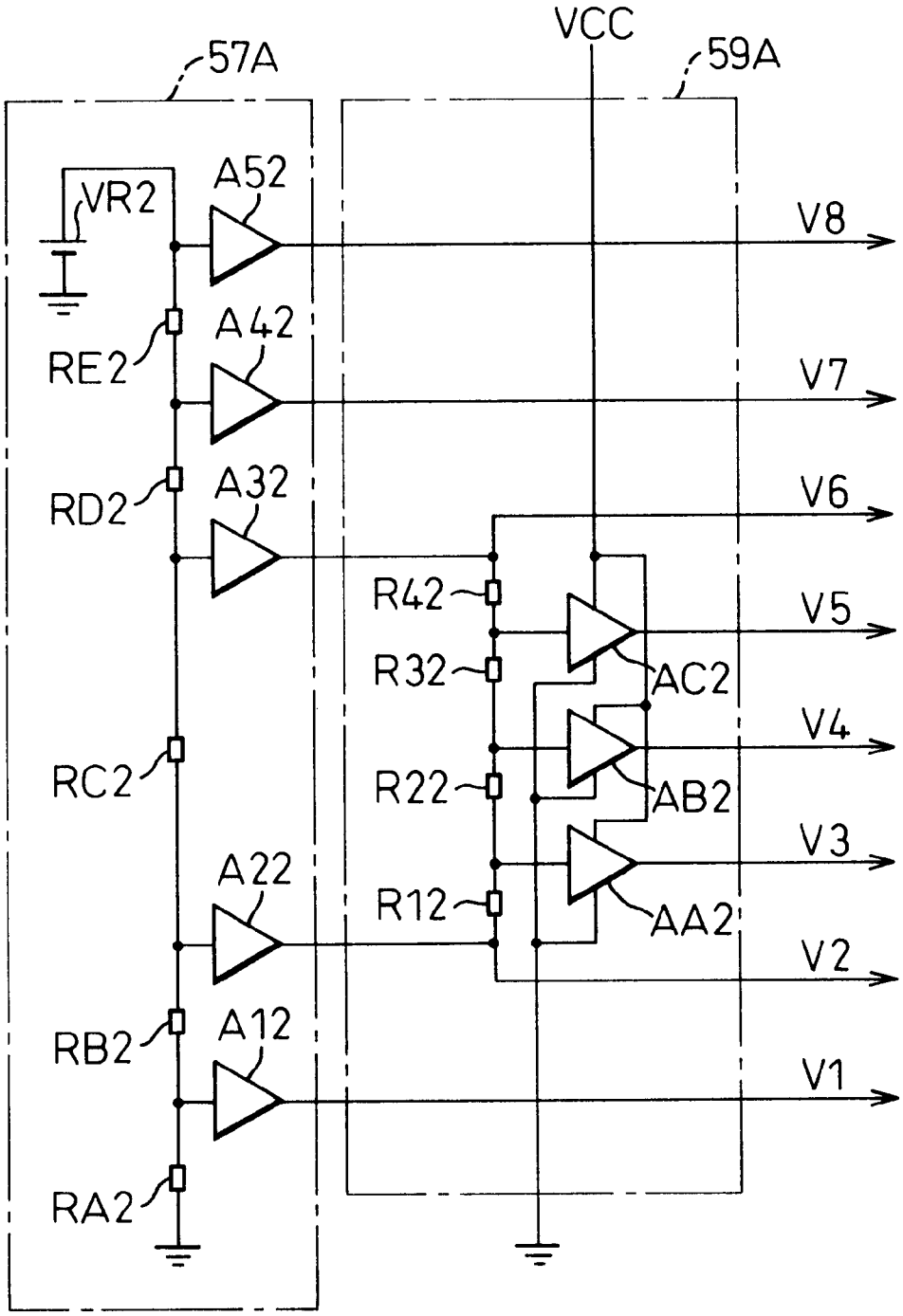
FIG. 47 is a circuit block diagram showing the second portion of the second example of the main part of the fifth preferred embodiment of the present invention.

FIG. 47 is a circuit block diagram showing the second example of the main part of the fifth embodiment of the present invention. Here, the reference power source unit 57A and the resistor dividing circuit portion 59A are shown as the second example of the main part of the fifth embodiment. In this case, the power source for a plurality of buffer amplifiers AA2 to AC2 interposed between the junctions of a plurality of voltage dividing resistors R12 to R42 inside the resistor dividing circuit portion 59A and the selector units 27 is taken out from the power source VCC for the logical circuit devices inside the integrated (IC) data driver unit.

In FIG. 47, the reference power source unit 57A includes a plurality of voltage dividing resistors RA2 to RE2 for generating a plurality of first reference voltages from one power source VR2 and a plurality of buffer amplifiers A12 to A52 for sending the first reference voltages obtained from these dividing resistors RA2 to RE2 to the resistor dividing circuit portion 59A or sending directly the first reference voltages to the selector units 27A.

In FIG. 47, further, the resistor dividing circuit portion 59A has functions of finally generating a plurality of kinds of reference voltages V2 to V5 by dividing the first reference voltages outputted from the reference power source unit 57A by the dividing resistors R12 to R42, and sending them to the selectors 91 to 94 through the buffer amplifiers AA2 to AC2. By the way, the reference voltages V1, V2 and V6 to V8 are sent from the buffer amplifiers A12 to A52 inside the reference power source unit 57A to the selectors 91 to 94 so as the reduce the load on the power source for the logical circuit devices in the same way as in the case of FIG. 34.

According to the several preferred embodiments of the present invention described above, after the driving voltage corresponding to the selected reference voltage is written into the second bus line by the drive circuit of the liquid crystal display device, in the first place, the switches inside the reference voltage selecting means are all turned OFF so as to cut off the steady state current flowing through a plurality of dividing resistors for generating the reference voltages. Therefore, even when the resistance values of the dividing resistors are made relatively small so as to improve the charging speed of the second bus line, power consumption inside the circuit caused by the steady state current inside the dividing resistors can be saved, and a liquid crystal display panel which is advantageous for multiple gradation display and has excellent display quality can be accomplished.

According to the preferred embodiments of the present invention, in the second place, the timing for turning off the switches inside the reference voltage selecting circuit, the timing for starting and stopping the supply of the driving voltage to the second bus lines and the timing for stopping the supply of the voltage to a plurality of dividing resistors are generated by the control circuit portion having substantially the same construction as that of the prior art circuits. Therefore, the consumed power in the driving circuit can be reduced by a simple circuit construction, and the charging speed of the second bus line can be improved.

According to the preferred embodiment of the present invention, in the third place, means for turning off all the switches inside the reference voltage selecting means such as the selectors after the driving voltage is written into the second bus line is constituted by a plurality of switch devices, and means for cutting off the steady state current flowing through a plurality of dividing resistors for generating the reference voltages is constituted by one switch device. Accordingly, a lower power consumption in the drive circuit can be accomplished by readily integrating these switches devices into the IC while retaining the small size of the frame portion of the liquid crystal display device.

According to the preferred embodiments of the present invention, in the fourth place, power controlling semiconductor devices such as economical analog switches having a small ON resistance and called "VMOSs" are interposed between the reference power source unit and a plurality of dividing resistors as means for cutting off the steady state current flowing through a plurality of dividing resistors for generating the reference voltage after the driving voltage is written into the second bus line. Therefore, the size of the liquid crystal display device can be reduced, and a lower power consumption in the drive circuit can be accomplished.

According to the preferred embodiments of the present invention, in the fifth place, means for cutting off the steady state current flowing through a plurality of voltage dividing resistors for generating the reference voltages, such as the switch device, after the driving voltage is written into the second bus line, is connected to the ground terminal side of the power source. Therefore, the voltage between the second data lines becomes the same potential, and no current flows through the voltage dividing resistors.

According to the preferred embodiments of the present invention, in the sixth place, means for cutting off the steady state current flowing through a plurality of voltage dividing resistors for generating the reference voltages, such as the switch device, after the driving voltage is written into the second bus line, is connected to the ground terminal side of the power source and the control signal from the control circuit portion is supplied to the switch device through the buffer device. Therefore, the function equivalent to the above can be accomplished.

According to the preferred embodiments of the present invention, in the seventh place, the function of turning OFF all the switches such as the selector units inside the reference voltage selecting circuit after the driving voltage is written into the second bus line is provided to the decoder in place of the analog switch. Therefore, the time constant for charging the second bus line is not affected by the ON resistance of the analog switch, the charging speed of the second bus line becomes relatively higher, and a liquid crystal display panel having excellent display quality can be accomplished.

According to the preferred embodiments of the present invention, in the eighth place, the function of turning OFF all the switches such as the selector units inside the reference voltage selecting circuit is provided to the decoder in place of the analog switch, and at the same time, a plurality of memory units are reset on the basis of the control signal from the control circuit portion when the display data signal is outputted from the decoder. In consequence, the ON/OFF operations of the switches such as the selector units can be executed without errors by a simple circuit construction, and a lower power consumption in the drive circuit can be accomplished.

According to the preferred embodiments of the present invention, in the ninth place, the charging operation of the second bus line is dividedly carried out in the two periods. In the first period, the value of the voltage itself applied in the second period or a value approximate to this value is selected, and the charging is carried out at high speed by the output of the buffer amplifiers having a low output resistance. Therefore, even when the resistance value of the dividing resistors is increased, power consumption in the driving circuit can be saved and the liquid crystal display speed can be improved.

According to the preferred embodiments of the present invention, in the tenth place, when the charging operation of the second bus line is carried out by dividing the period into two periods, the least significant bit for data display from the memory unit to the decoder is controlled by the gate circuit device, and the supply of the display data signal from the decoder unit to the selector unit is inhibited in the first period corresponding to this least significant bit. Therefore, a lower power consumption in the drive circuit can be accomplished by merely adding the simple logical circuit device.

Further, according to the preferred embodiments of the present invention, in the eleventh place, buffer amplifiers, which can be easily integrated into the IC and have a low output resistance, are disposed at the posterior side of a plurality of voltage dividing resistors for generating a plurality of reference voltages so as to charge the data line. Therefore, even when the resistance values of the dividing resistors are increased to considerable extents, a lower power consumption in the driving circuit and a higher liquid crystal display speed can be accomplished while keeping small the area of the frame portion of the liquid crystal display panel.

According to the preferred embodiments of the present invention, in the twelfth place, a plurality of buffer amplifiers having a low output resistance are disposed at the posterior side of a plurality of voltage dividing resistors for generating a plurality of reference voltages. Further, the output voltages passing through the buffer amplifiers are supplied to the second bus lines in the first period of the charging of the second bus lines and in the second period, the reference voltage corresponding to the driving voltage for displaying the image data is supplied to the second bus lines. Therefore, even when the resistance value of the voltage dividing resistors is increased to a considerable extent, a lower power consumption in the drive circuit and a higher liquid crystal display speed can be accomplished by a simple circuit construction.

According to the preferred embodiment of the present invention, in the thirteenth place, the power source voltages for a plurality of buffer amplifiers are supplied from the reference power source unit for generating a plurality of reference voltages. Therefore, the power source can be simplified and the size of the liquid crystal display device can be reduced.

Further, according to the preferred embodiments of the present invention, in the fourteenth place, the power source voltages for a plurality of buffer amplifiers are supplied from a power source which is in common with other logical circuit devices constituting the drive circuit. Therefore, an integration of the drive circuit can be easily accomplished, and the present invention has great practical utility.

I claim:

1. A drive circuit for a liquid crystal display device which disposes first bus lines for serially scanning a plurality of pixels constituting a liquid crystal display panel of a liquid crystal display device for said pixels, and second bus lines for supplying a driving voltage for displaying predetermined image data to said pixels selected on said first bus lines, said drive circuit comprising:

a reference voltage generating circuit portion for generating a plurality of first reference voltages by dividing an arbitrary power source by a plurality of voltage dividing resistors;

a resistor dividing circuit unit for further dividing a plurality of said first reference voltages outputted from said reference voltage generating circuit portion and generating a plurality of second reference voltages inclusive of driving voltages of all the magnitudes;

a selector unit for selecting a second reference voltage corresponding to the driving voltage for displaying predetermined image data from a plurality of said second reference voltages outputted from said resistor dividing circuit unit and supplying it to said second bus lines; and a buffer amplifier unit comprising a plurality of buffer amplifiers interposed between said reference voltage generating circuit portion and said resistor dividing circuit unit;

wherein the period in which said second reference voltage is applied to said second bus line is divided into at least two periods; and wherein the output voltage passed through a plurality of said buffer amplifiers inside said buffer amplifier unit is supplied to said second bus lines during the first period, and said second reference voltage corresponding to the driving voltage for displaying said predetermined image data is supplied to said second bus line during the second period.

2. A drive circuit for a liquid crystal display device according to claim 1, which further comprises:

a control circuit portion for controlling the timing of a scanning of said pixels and the timing of displaying the image data to said selected pixels; and a decoder unit for converting the display data sent from said control circuit portion to a display data signal corresponding to each of said second bus lines on the basis of said control circuit portion, and supplying it to said selector unit;

wherein the supply of said display data signal from said decoder unit to said selector unit is stopped by the control signals from said control circuit portion during said first period, and the supply of said display data signal from said decoder unit to said selector unit is permitted during said second period.

3. The drive circuit of claim 1 comprising:

a selector control circuit for stopping the supply of said driving voltage by said selector unit after said driving voltage is supplied to said second bus lines for a predetermined period.

4. The drive circuit of claim 3 comprising:

a power source control circuit for stopping the supply of the voltage from said power source to said voltage dividing resistors after said driving voltage is applied to said second bus lines for a predetermined period.

5. The drive circuit of claim 4, which further comprises:

a control circuit portion for controlling the scanning timing of said pixels and the display timing of said image data to said selected pixels; and wherein the timing of a start of the supply of said driving voltage by said selector circuit to said second bus lines, the timing of a stop of the supply of said driving voltage by said selector control circuit and the timing of a stop of the supply of the voltage by said power source control circuit to said voltage dividing resistors are determined by control signals sent from said control circuit portion.

6. The drive circuit of claim 5, wherein said selector circuit comprises a plurality of selectors for selecting a reference voltage corresponding to said driving voltage and supplying it to said second bus lines;

said reference voltage selection control circuit having a plurality of switch devices interposed between said selectors and said second bus lines, for controlling whether or not to supply said reference voltage from said selectors to said second bus lines on the basis of the control signals from said control circuit portion; and said power source control circuit has a switch device connected to a power source terminal side of said power source, for controlling whether or not to supply a voltage from said power source to a plurality of said voltage dividing resistors on the basis of the control signals from said control circuit portion.

7. The drive circuit of claim 5, wherein said selector circuit comprises a plurality of selectors for selecting a reference voltage corresponding to said drive voltage and supplying it to said second bus lines, respectively;

said selector control circuit comprises a plurality of switch devices interposed between said selectors and said second bus lines, respectively, for controlling whether or not to supply said reference voltage from said selectors to said second bus lines on the basis of the control signals from said control circuit portion; and said power source control circuit comprises a plurality of analog switches mounted with a plurality of said voltage dividing resistors, for controlling whether or not to supply said reference voltage from a plurality of said voltage dividing resistors to said reference voltage selecting circuit on the basis of the control signals from said control circuit portion.

8. The drive circuit of claim 5, wherein said selector circuit comprises a plurality of selectors for selecting a reference voltage corresponding to said driving voltage and supplying it to said second bus lines, respectively;

said selector control circuit comprises a plurality of switch devices interposed between said selectors and said second bus lines, for controlling whether or not to supply said reference voltage from said selectors to said second bus lines on the basis of the control signals from said control circuit portion; and said power source control circuit comprises a switch device connected to a ground terminal side of said power source, for controlling whether or not to supply a voltage from said power source to a plurality of said voltage dividing resistors on the basis of the control signal from said control circuit portion.

9. The drive circuit of claim 5, wherein said selector circuit comprises a plurality of selectors for selecting a reference voltage corresponding to said driving voltage and supplying it to said second bus lines, respectively;

said selector control circuit comprises a plurality of switch devices interposed between said selectors and said second bus lines, for controlling whether or not to supply said reference voltage from said selectors to said second bus lines on the basis of the control signals from said control circuit portion;

said power source control circuit comprises a switch device connected to a ground terminal side of said power source, for controlling whether or not to supply a voltage from said power source to a plurality of said voltage dividing resistors on the basis of the control signals from said control circuit portion; and said control signals from said control circuit portion are supplied to said switch device through a buffer device.

10. A drive circuit for a liquid crystal display device according to claim 5, wherein said reference voltage selecting circuit comprises a plurality of selectors for selecting a reference voltage corresponding to said driving voltage and supplying it to said second bus lines, respectively;

a plurality of memory units for temporarily storing display data outputted from said control circuit portion so as to display said display data for each scanning period of said first bus lines are disposed;

a plurality of decoders for converting the display data read out from a plurality of said memory units to display data signals corresponding to said second bus lines and supplying them to a plurality of said selectors on the basis of the control signals from said control circuit portion are further disposed; and a plurality of said decoders have the function of controlling whether or not to supply said reference voltage from said selectors to said second bus lines on the basis of the control signals from said control circuit portion.

11. The drive circuit of claim 5, wherein said selector circuit comprises a plurality of selectors for selecting a reference voltage corresponding to said driving voltage and supplying it to said second bus lines, respectively;

a plurality of memory units for temporarily storing display data outputted from said control circuit portion so as to display said display data for each scanning period of said first bus lines are disposed;

a plurality of decoders for converting the display data read out from a plurality of said memory units to display data signals corresponding to said second bus lines, respectively, and supplying them to a plurality of said selectors are further disposed;

a plurality of said decoders have the function of controlling whether or not to supply said reference voltage from said selectors to said second bus lines on the basis of the control signals from said control circuit portion; and a plurality of said memory units are reset on the basis of the control signals from said control circuit portion at the point of time when said display data signals are outputted form a plurality of said decoders.

12. The drive circuit of claim 1 comprising:

a power source control circuit for stopping the supply of the voltage from said power to said voltage dividing resistors after said driving voltage is applied to said second bus lines for a predetermined period.

13. A drive circuit for a liquid crystal display device which disposes first bus lines for serially scanning a plurality of pixels constituting a liquid crystal display panel of a liquid crystal display device for said pixels, and second bus lines for supplying a driving voltage for displaying predetermined image data to said pixels selected on said first bus lines, said drive circuit comprising:

a reference power source unit for generating a plurality of first reference voltages by dividing an arbitrary power source by a plurality of voltage dividing resistors;

a resistor dividing circuit portion for further dividing a plurality of said first reference voltages outputted from said reference power source unit and generating a plurality of second reference voltages inclusive of driving voltages of all the magnitudes; and a selector unit for selecting a second reference voltage corresponding to a driving voltage for displaying said predetermined image data from a plurality of said second reference voltages outputted from said resistor dividing circuit portion and supplying it to said second bus lines;

wherein said resistor dividing circuit portion includes a buffer circuit unit comprising a plurality of voltage dividing resistors for outputting a plurality of said second reference voltages and a plurality of buffer amplifiers interposed between the junctions of a plurality of voltage dividing resistors and said selector unit; and wherein the period in which said second reference voltage is applied to said second bus lines is divided into at least two periods, the output voltage passing through a plurality of buffer amplifiers inside said buffer circuit unit is supplied to said second bus lines in the first period, and a second reference voltage corresponding to a driving voltage for displaying said predetermined image data is supplied to said second bus lines during the second period.

14. A drive circuit for a liquid crystal display device according to claim 13, which further comprises:

a control circuit portion for controlling the timing of a scanning of said pixels and the timing of displaying the image data to said selected pixels; and a decoder unit for converting the display data sent from said control circuit portion to a display data signal corresponding to each of said second bus lines, and supplying it to said selector unit on the basis of the control signals from said control circuit portion;

wherein the supply of said display data signal from said decoder unit to said selector unit is restricted by the control signals from said control circuit portion during said first period, and the supply of said display data signal from said decoder unit to said selector unit is permitted during said second period.

15. A drive circuit for a liquid crystal display device according to claim 13, wherein a power source voltage for a plurality of said buffer amplifiers inside said buffer circuit unit is supplied from said reference power source unit.

16. A drive circuit for a liquid crystal display device according to claim 13, wherein a power source voltage for a plurality of said buffer amplifiers inside said buffer circuit unit is supplied from a power source commonly used for other logical circuit devices constituting said drive circuit.

17. A drive circuit for a liquid crystal display device according to claim 14, wherein a power source voltage for a plurality of said buffer amplifiers inside said buffer circuit unit is supplied from said reference power source unit.

18. A drive circuit for a liquid crystal display device according to claim 14, wherein a power source voltage for a plurality of said buffer amplifiers inside said buffer circuit unit is supplied from a power source commonly used for other logical circuit devices constituting said drive circuit.

19. The drive circuit of claim 13 comprising;

a selector unit control circuit for stopping the supply of said driving voltage by said selector unit after said driving voltage is supplied to said second bus lines for a predetermined period.

20. The drive circuit of claim 13 comprising a power source unit control circuit for stopping the supply of the voltage from said power source unit to said drive voltage dividing resistors after said driving voltage is applied to said second bus lines for a predetermined period.

21. The drive circuit of claim 19 comprising a power source unit control circuit for stopping the supply of the voltage from said power source unit to said drive voltage dividing resistors after said driving voltage is applied to said second bus lines for a predetermined period.

22. A driving method of a liquid crystal display device which disposes a plurality of pixels, first bus lines for serially scanning said pixels, and second bus lines for supplying a driving voltage for displaying predetermined image data to said pixels selected on said first lines, said driving method comprising steps of:

generating a plurality of first reference voltage by dividing an arbitrary power source by a plurality of voltage dividing resistors, outputting said first reference voltages through buffer amplifiers, and further dividing said first reference voltages by a plurality of voltage dividing resistors to generate second reference voltages; and dividing a period in which said second reference voltages are applied to said second bus lines into at least two periods, supplying the output voltage passing through said buffer amplifiers to said second bus lines in said first period, and supplying said second reference voltage corresponding to said driving voltage for displaying said predetermined image data to said second bus lines during said second period.

23. A driving method of a liquid crystal display device which disposes a plurality of pixels, first bus lines for serially scanning said pixels and second bus lines for supplying a driving voltage for displaying predetermined image data to said pixels selected on said first bus lines, said driving method comprising steps of:

generating a plurality of first reference voltages by dividing an arbitrary power source by a plurality of voltage dividing resistors, dividing further said first reference voltages by a plurality of voltage dividing resistors to generate second reference voltages, and outputting the outputs from the junctions of said voltage dividing resistors, among said second reference voltages, through buffer amplifiers; and dividing the period in which said second reference voltages are applied to said second bus lines, into at least two periods, supplying the output voltages passing through said buffer amplifiers to said second bus line during said first period, and supplying said second reference voltage corresponding to the driving voltage for displaying said predetermined image data to said second bus lines during said second period.

* * * * *